US005279010A

United States Patent [19]

Ferrand et al.

[11] Patent Number: 5,279,010

[45] Date of Patent: Jan. 18, 1994

[54] PATIENT CARE SYSTEM

[75] Inventors: Robert J. Ferrand, Burlingame; Marc M. Thomas, Portola Valley; Lincoln J. Alvord, Redwood City; Stephen D. Smith, San Francisco; Steven N. Roe, Los Altos; Richard W. O'Connor, Palo Alto; William A. Gilmartin, Los Altos Hills; William Loh, San Ramon; William R. Fish, San Jose; Jonathan Salsado, Sunnyvale; Charles W. Neder, Mountain View; William Silva, Fremont; Wesley E. Grass, Atherton, all of Calif.

[73] Assignee: American Life Support Technology, Inc., Redwood City, Calif.

[21] Appl. No.: 864,881

[22] Filed: Apr. 3, 1992

Related U.S. Application Data

[63] Continuation-in-part of Ser. No. 641,697, Jan. 16, 1991, Pat. No. 5,138,729, which is a continuation of Ser. No. 511,842, Apr. 20, 1990, Pat. No. 5,023,967, which is a continuation of Ser. No. 172,264, Mar. 23, 1988, abandoned.

[51] Int. Cl.[5] ..... A61G 7/00

[52] U.S. Cl. ..... 5/600; 5/610; 5/624; 5/507.1; 5/602

[58] Field of Search ..... 5/53.1, 53.3, 600, 601, 5/602, 610, 624, 178, 183, 280, 507.1, 662

[56] References Cited

U.S. PATENT DOCUMENTS 99,455 2/1870 Menzer ..... 5/183

(List continued on next page.)

FOREIGN PATENT DOCUMENTS 716981 1/1942 Fed. Rep. of Germany ..... 5/600

(List continued on next page.)

OTHER PUBLICATIONS

Brochure on the Pegasus Airwave System, published by Pegasus Airwave Limited of Portsmouth, Hampshire, England, Publication Date Unknown.

(List continued on next page.)

*Primary Examiner*—Michael F. Trettel

*Attorney, Agent, or Firm*—Flehr, Hohbach, Test, Albritton & Herbert

[57] ABSTRACT

A patient support system comprises an inflatable mattress supported on a platform of articulable links by a support system mounted on a weigh frame. The weigh frame is supported on a base frame supported relative to a floor. A pneumatic system includes a platform-mounted blower directing air through passageways in the articulable links. An exhaust passageway parallels the pressure passageway for exhausting opposite the blower. Air flow into and out of air cells in the mattress are controlled by valves coupling the pressurized air chamber and exhaust chamber to cell ports. A connector assembly is used to couple the cells to the platform, to adjacent cells, and to tubes connected to other cells. A footboard assembly is formed as two gates that swing out from the foot of the bed. Each gate has a storable tray that is positionable on either side of the gate. A headboard has a removable central panel for providing emergency patient access. Additionally, each corner of the headboard has a telescoping equipment support post positionable at a variety of heights and having equipment supports that automatically drop into place upon removal from storage in the headboard. A three-point weight sensing system tracks patient weight and generates pre-exit and exit alarms based on sensed movement of the patient on the mattress. A portable control unit wraps around a guard rail to provide both patient and nurse controls, and uses a unitary membrane to cover exposed faces of the controls and resiliently wrap around the guard rail. Selectively engagable guide or fifth wheels are mounted to the base frame to provide direction stability during bed movement. The platform is articulable to allow a patient to enter or exit the bed in a standing position. An adjustable stand up board is selectively positionable at the foot of the bed to take the patient's weight during this process. A vertically telescoping guard rail elevation system provides energy storage to resist lowering and assist raising the guard rail. A brace is provided for seating the platform on the weigh frame when the bed is in a low position and to assist in movement of the bed longitudinally when in the low position.

9 Claims, 66 Drawing Sheets

U.S. PATENT DOCUMENTS

| | | | |
|---|---|---|---|
| 535,945 | 4/1895 | Donald . | |
| 2,217,783 | 10/1940 | Bell . | |
| 2,401,999 | 6/1946 | Wolfe | 5/315 |
| 2,707,137 | 4/1955 | Hollstein . | |
| 2,757,997 | 8/1956 | Lee | 5/624 X |
| 3,063,066 | 11/1962 | Peck et al. | 5/331 |
| 3,081,463 | 3/1963 | Williams et al. | 5/63 |
| 3,195,151 | 7/1965 | Boyer | 5/624 |
| 3,218,103 | 11/1965 | Boyce | 297/384 |
| 3,220,020 | 11/1965 | Nelson . | |
| 3,220,022 | 12/1965 | Nelson | 5/624 X |
| 3,220,024 | 12/1965 | Nelson . | |
| 3,237,212 | 1/1966 | Hillenbrand et al. | 5/68 |
| 3,327,328 | 6/1967 | Slivoski | 5/317 |
| 3,336,606 | 8/1967 | Beitzel | 5/610 |
| 3,344,445 | 10/1967 | Crawford | 5/331 |
| 3,393,198 | 7/1975 | Blair . | |
| 3,434,165 | 3/1969 | Keane . | |
| 3,452,662 | 8/1969 | Morrison . | |
| 3,462,772 | 8/1969 | Morrison . | |
| 3,540,479 | 11/1970 | Thompson . | |
| 3,564,627 | 2/1971 | Allard et al. | 5/507.1 |
| 3,608,102 | 9/1971 | Goodman . | |
| 3,611,452 | 10/1971 | Turko et al. . | |
| 3,611,453 | 10/1971 | Lukken . | |
| 3,613,732 | 10/1971 | Willson et al. . | |
| 3,644,945 | 2/1972 | Goodman et al. . | |
| 3,674,019 | 7/1972 | Grant | 128/33 |
| 3,678,519 | 7/1972 | Szucs . | |
| 3,724,003 | 4/1973 | Ellwanger et al. . | |
| 3,724,004 | 4/1973 | Behrens . | |
| 3,733,623 | 5/1973 | Croxton . | |
| 3,742,527 | 7/1973 | Johnston et al. | 5/63 |
| 3,754,749 | 8/1973 | Lyon et al. . | |
| 3,757,193 | 12/1973 | Pageot et al. . | |
| 3,839,753 | 10/1974 | Benoit et al. | 5/68 |
| 3,900,906 | 8/1975 | Berthelsen . | |
| 3,997,926 | 12/1976 | England . | |
| 4,025,972 | 5/1977 | Adams et al. . | |
| 4,099,276 | 7/1978 | Hunt et al. . | |
| 4,130,265 | 12/1978 | Sakakibara et al. . | |
| 4,183,015 | 1/1980 | Drew et al. | 340/286 R |
| 4,193,149 | 3/1980 | Welch . | |
| 4,205,669 | 6/1980 | Hamann | 128/134 |
| 4,224,706 | 9/1980 | Young et al. . | |
| 4,225,989 | 10/1980 | Corbett et al. . | |
| 4,255,824 | 3/1981 | Pertchik . | |
| 4,310,935 | 1/1982 | Stevens et al. | 5/624 X |
| 4,356,577 | 11/1982 | Taylor et al. . | |
| 4,371,996 | 2/1983 | Nahum . | |
| 4,371,997 | 2/1983 | Mattson . | |
| 4,409,695 | 10/1983 | Johnston et al. | 5/601 |
| 4,439,880 | 4/1984 | Koncelik et al. | 5/249 |
| 4,494,260 | 1/1985 | Olds et al. . | |
| 4,525,885 | 7/1985 | Hunt et al. . | |
| 4,534,078 | 8/1985 | Viesturs et al. . | |
| 4,539,560 | 9/1985 | Fleck et al. | 340/573 |
| 4,542,547 | 9/1985 | Sato . | |
| 4,572,493 | 2/1986 | Hubert . | |
| 4,669,136 | 6/1987 | Waters et al. | 5/66 |
| 4,685,159 | 8/1987 | Octiker . | |
| 4,686,727 | 8/1987 | Wilkinson | 5/503 |
| 4,724,555 | 2/1988 | Poehner et al. . | |
| 4,736,587 | 4/1988 | Suzuki . | |
| 4,747,171 | 5/1988 | Einsele et al. | 5/425 |
| 4,768,249 | 9/1988 | Goodwin . | |
| 4,803,744 | 2/1989 | Peck et al. | 5/453 |
| 4,821,348 | 4/1989 | Pauna | 4/547 |
| 4,864,671 | 9/1989 | Evans . | |
| 4,926,951 | 5/1990 | Carruth et al. | 177/144 |
| 4,935,968 | 6/1990 | Hunt et al. | 5/453 |
| 4,945,590 | 8/1990 | Ogura . | |
| 4,949,413 | 8/1990 | Goodwin . | |
| 4,949,414 | 8/1990 | Thomas et al. . | |
| 4,973,024 | 11/1990 | Homma . | |
| 4,993,920 | 2/1991 | Harkleroad et al. . | |
| 5,003,654 | 4/1991 | Vrzalik . | |
| 5,035,016 | 7/1991 | Mori et al. . | |

FOREIGN PATENT DOCUMENTS

| | | | |
|---|---|---|---|
| 61-17789 | 1/1986 | Japan . | |
| 523334 | 7/1940 | United Kingdom . | |
| 2141333 | 12/1984 | United Kingdom | 5/453 |

OTHER PUBLICATIONS

Guyton, M. D., "Capillary Pressure", Textbook of Medical Physiology, 7th Ed., 1986, W. B. Saunders Co., pp. 353–354.

Hargest, "Problems of Patient Support: The Air Fluidised Bed as a Solution", pp. 269–275.

Advertising brochure of Kinetics Concepts of San Antonio, Texas, "New Therapulse Pulsating Air Suspension Therapy", 12 pages, 1988.

Meer, "The Tissue Therapist's Guide to Understanding Skin Destruction", Hospitals & Healthcare Intl., Sep./Oct. 1983, 2 pages.

"The Effectiveness of Air Flotation Beds", Care Science and Practice, Nov. 1984, 2 pages.

Exton-Smith et al., "Use of the Air Wave System to Prevent Pressure Sores in Hospital", The Lancet. Jun. 5, 1982, pp. 1288–1290.

OTHER PUBLICATIONS

Le et al., "An In-Depth Look at Pressure Sores Using Monolithic Silicon Pressure Sensors", Plastic and Reconstructive Surgery, Dec. 1984, pp. 745-754.
Guyton, M. D., "The Body Fluids and Kidneys", Textbook of Medical Physiology, 7th Edition, W. B. Saunders Co., p. 354, 1986.
Stewart, "Why 32?", Pressure Ulcer Forum, vol. 2, No. 2, Spring 1987, Gaymar Industries, Inc., pp. 1-2.
Scales, "Air Support Systems for the Prevention of Bed Sores", pp. 259-267.
Agris et al., "Pressure Ulcers & Prevention and Treatment", Clinical Symposia, CIBA, vol. 31, No. 5, 1979, pp. 2-9.
Husain, "An Experimental Study of Some Pressure Effects on Tissues with Reference to the Bed-Sore Problem", J. Path. Bact., vol. 66, 1953, pp. 347-350.
Kosiak, "Etiology and Pathology of Ischemic Ulcers", Archives of Physical Medicine Rehabilitation, Feb. 1959, pp. 62-69.
Kosiak, "The Etiology of Decubitus Ulcers", Archives of Physical Medicine Rehabilitation, Jan. 1961, pp. 19-28.
Mediscus, Advertisement for MONARCH Low Air--Loss Bed.
Kinetic Concepts, Inc., Advertisement for KinAir.
Kinetic Concepts, Inc., Advertisement for The Kinetic Treatment Table.
Nelson Patent Handling Device, (NPHD), Advertisement.
Bye-Bye Decubiti, Advertisement for Pneumatic Cushions and Mattresses.
Support Systems International, Clinitron Air Fluidized Therapy; Flexicair Low Airloss Therapy, Advertisements.
63 Page report of search done in the Official Gazette of related patents under Class 5—Beds.
Daly et al., "The Effect of Pressure Loading on the Blood Flow Rate of Human Skin" pp. 69-76, "Bedcare Biomechanics", Aug. 1975.
Danzer et al., "Determination of the Capillary Blood Pressure in Man with the Micro-Capillary Tonometer", pp. 164, 165, American Journal of Physiology, vol. 52 No. 1.
Landis, "Micro-Injection Studies of Capillary Blood Pressure in Human Skin", Publication & Date Unknown.

PATIENT CARE SYSTEM

CROSS-REFERENCES TO RELATED APPLICATIONS

This is a continuation-in-part of U.S. patent application Ser. No. 07/641,697 filed on Jan. 16, 1991, now U.S. Pat. No. 5,138,229, which application is a continuation of U.S. patent application No. 07/511,842 filed on Apr. 20, 1990, issued as U.S. Pat. No. 5,023,967, which application is a continuation of U.S patent application Ser. No. 07/172,264 filed Mar. 23, 1988, now abandoned.

FIELD OF THE INVENTION

This invention relates generally to beds, and more particularly, to a bed and associated features facilitating care of a patient supported on the bed.

CONTENTS

The Background of the Invention, Summary of the Invention, and Detailed Description of the Preferred Embodiments sections have the following section headings.

1. Pneumatic System
2. Footboard Gate
3. Stand-Up Board
4. Headboard
5. Weight-Sensing System
6. Bed-Control Unit
7. Bed-transport Guide Wheels
8. Guard Rail Elevation System
9. Swing Arm Extension Brace

BACKGROUND OF THE INVENTION

Hospital bed designs have recently been undergoing a transformation. Early beds were very basic devices providing limited patient support and care features. More recently, bed designs have been taking advantage of technological developments to provide improvements in bed articulation, mattress inflation, patient access, convenience and control. The following patents illustrate some of the designs that are currently known.

1. Pneumatic System

Valves are an integral part of a mattress inflation system. Recently, valves have been designed in which a metal alloy that changes shape in response to a change in temperature is used as the valve actuator. In U.S. Pat. No. 3,540,479 issued to Thompson for a "Heat Motor and Valve", a valve using a heat-expanding rod to open a biased-closed valve seat is disclosed. Willson et al., in U.S. Pat. No. 3,613,732 entitled "Temperature-Responsive Valve Operators", discloses various valve configurations utilizing temperature-responsive operators made with a shape-memory alloy such as a nickel and titanium alloy. The disclosed configurations include single and double poppet designs, as well as coaxial, single poppet designs.

U.S. Pat. No. 4,130,265 issued to Sakakibara et al. for "Electrically Operated Switching Valve" discloses the use of a warped plate controlled by a heat-activated element for selectively valving opposing ports relative to an intermediate port. Suzuki, in U.S. Pat. No. 4,736,587 entitled "Shape-Memory Electromechanical Drive" discloses the use of two shape-memory springs to move a slide member to couple alternate outer ports with a central port.

A valve member that alternately opens and closes by heat-generating electrical current acting on a spring-biased linear alloy element is disclosed in U.S. Pat. No. 4,973,024 issued to Homma for "Valve Driven By Shape Memory Alloy". Hori, in Japanese Pat. No. JP61-17789 entitled "Valve Device", discloses a valve-opening device activated by a shape-memory alloy spring. The valve is held closed by a coaxial bias spring.

These valve assemblies provide for effective valving, but there remains a need for a valve assembly that is able to inversely vary the flow of air or other fluid through respective inlet and outlet ports, and to independently control the flow of air through input and output ports, and that is self-contained for convenient installation and removal from a fluid-chamber housing.

Inflatable mattress cushions or cells are often connected to a support surface of a base platform or frame. This connection may be provided by a connector having an inner channel or passageway, that attaches the cell to a port extending through the support surface. Further, it is known to connect two cells together with a passageway formed in the connection to allow air to flow between the connected cells. An example of such an arrangement is disclosed by Pertchik in U.S. Pat. No. 4,255,824 for "Cushion for Decubitus Ulcers". Pertchik discloses a seat cushion formed of a plurality of elongate cells that are connected at contact points to provide inflation of all the cells from a single inlet.

Hunt et al., in U.S. Pat. No. 4,525,885 entitled "Support Appliance for Mounting on a Standard Hospital Bed", disclose male and female parts of a connector assembly for connecting mattress cells to a mattress base inlet or outlet. Another form of connector for a mattress cell is shown in FIG. 6 of U.S. Pat. No. 4,949,413 issued to Goodwin for "Low Air Loss Bed".

Hunt et al., in U.S. Pat. No. 4,935,968 entitled "Patient Support Appliances" also discloses a connector of an air tube to a housing (FIG. 4). This is a quick release connection to allow rapid deflation for cardiac arrest procedures. In U.S. Pat. No. 4,949,414 entitled "Modular Low Air Loss Patient Support System and Methods for Automatic Patient Turning and Pressure Point Relief", Thomas et al. also disclose in FIGS. 5 and 6 a connector for connecting a mattress cell to the platform.

These connectors are constructed to be usable in a specific application, but do not permit use in various connections. For instance, there remains the need for fluid-transmitting connectors that are usable for coupling a cell to a support platform and for coupling cells together, with the integrity of the base cell remaining when a satellite cell is disconnected. Further, there is a need for a connector that can accommodate a reducer for connecting a tube to a cell.

When used on an articulating bed, the fluid supply and exhaust systems used for inflating and deflating mattress cells must either be formed integrally as part of the bed platform, or must be provided by external hoses or ducts. These arrangements result in bending and wear of connecting hoses, and exposure of external tubes to wear and contact by other moving parts.

The present invention makes use of expandable passageways, similar to bellows, for coupling manifolds supported on adjoining, articulating panels. Bellows-like support cells are known to be used in hospital beds. For instance, Hunt et al., in U.S. Pat. No. 4,099,276 entitled "Support Appliances Having Articulated Sections" shows the use of inflatable bellows to raise and lower the head end of a bed platform. Similar structures are also shown in patent '885 issued to Hunt et al., identified previously. A bellows-type mattress cell is disclosed by Sato in U.S. Pat. No. 4,542,547 entitled "Pneumatic Mat with Sensing Means".

There thus remains the need for a flexible passageway structure that can connect air passageways of adjoining bed panels, that conforms with the panel structure, is reliable, and expands and contracts in response to movement of the adjoining panels.

There also is a need for a simple efficient structure for conveying pressurized and exhaust fluids to mattress cells, and along articulated panels. As was mentioned, flexible tubes are usually used to connect mattress cells to an air supply and exhaust port. For example, Hunt et al., in patent '885, and Goodwin, in patent '413, disclose the use of a flexible tube serving each mattress section. Goodwin shows them as being external to the bed platform while Hunt et al. show them to be within the platform. Also, Evans, in U.S. Pat. No. 4,864,671 entitled "Controllably Inflatable Cushion", discloses individual cushions inflated in groups or zones with supply lines and exhaust lines serving each zone being controlled by a three way valve.

U.S. Pat. No. 4,945,590 issued to Ogura for "Valve for Fluid Mat and Apparatus for Controlling an Attitude Assumed by Fluid Mat", discloses air mattress supply ducts that are positioned between relative positive and negative pressure air chambers. Separate solenoid valves connect each air supply duct with each of the air chambers.

Harkleroad et al. discloses, in U.S. Pat. No. 4,993,920, entitled "Air Mattress Pumping and Venting System", a pressure control system in which sensors control a venting valve and a pump for maintaining the mattress pressure between predetermined high and low values. The use of a valve having a rotatable disk for alternately connecting air supply and discharge pipes to two mattress sections is shown in U.S. Pat. No. 5,035,016 issued to Mori et al. for an "Air-Mat Apparatus".

With the development of elaborate inflatable mattresses and articulating support platforms, it became difficult to take immediate action when a patient needed CPR or other procedures to treat a life-threatening condition. Various means have been developed to make the bed become a hard, flat surface to facilitate, rather than impair these procedures.

For instance, in British Patent No. GB 2 141 333 entitled "Low Air Loss Support Appliance", Hunt et al. disclose in FIG. 2 and on page 2, lines 67–74, a quick release manifold that allows deflation from all ports.

In patent '968, Hunt et al. disclose an air distribution chamber for supplying air to mattress cells. An exhaust plate on the chamber is manually moved to open an exhaust hole for rapidly deflating the mattress. An air pump must be separately turned off, but a switch activated by the handle to the exhaust plate transmits a signal to open the exhaust valves used on the head & foot articulating bellows. FIG. 12 of patent '414 issued to Thomas et al. discloses the use of a CPR switch connected to a circuit board.

Various forms of cushions and mattresses have been designed in order to provide improved support for a patient. Viesturs et al., in U.S. Pat. No. 4,534,078 entitled "Body Supporting Mattress", disclose an elongate inner cell supported on a pad having a peripheral inflated tube. Generally U-shaped cells that alternate and are offset for use in turning a patient are disclosed in U.S. Pat. No. 5,003,654 issued to Vrzalik for a "Method and Apparatus for Alternating Pressure of a Low Air Loss Patient Support System". In U.S. Pat. No. 4,768,249 entitled "Patient Supoort Structure", Goodwin discloses a more conventional low air loss mattress formed of upright cells extending across the width of the bed.

Such mattresses as shown by Goodwin and Vrzalik are prone to bend or lean into an adjoining cell location when the adjoining cell is deflated. This tends to reduce the effectiveness of controlling the support pressure and location, which is necessary in the avoidance and treatment of bed sores, and also in the articulation of the bed.

It is also known to provide mattresses that have multiple layers. Grant, in U.S. Pat. No. 3,674,019 entitled "Dual Layer Cellular Inflatable Pad", describes a pad formed of offset layers of interdigitated inflatable sections. Welch, in U.S. Pat. No. 4,193,149 entitled "Beds and Mattresses", discloses a similar mattress, except the layer cells are aligned and separated by a preformed foam. Such mattresses assure resilient support for a patient, but provide limited control of support by adjacent cells.

Various cushions are also known for restraining a person. An elaborate example is disclosed by Boyce in U.S. Pat. No. 3,218,103 entitled "Pneumatic Restraint System". This patent discloses a chair having inflatable bands shiftable in position for selectively restraining a person. A restraining device that is releasably attached to a support platform for placement across the body of an infant is disclosed in U.S. Pat. No. 4,205,669 issued to Hamann for "Diaper-Changing Aid".

There thus remains a need for a means for restraining persons on a bed. In particular, it is desirable to have lateral cushions that conform to the sides of a patient, and selectively inflatable cushions that are positionable over a patient for keeping the patient in the bed.

2. Footboard Gate

In most any patient care environment in which the patient is bedridden, it is desirable, and often necessary to provide support for equipment, documents, and other materials. Where it is sufficient to use a shelf or horizontal platform for this, a movable tray on a stand separate from the bed is often utilized. In order to limit the amount of accessories around the bed or to provide a convenient table in the vicinity of the bed, various schemes have been developed.

Slivoski, in U.S. Pat. No. 3,327,328 entitled "Mattress Extension", discloses a bed having a foot-end kick board that swings upward to form a platform. In U.S. Pat. No. 3,344,445 entitled "Side Panel Construction for Stretcher-Beds", Crawford discloses a side guard panel that converts into a platform.

A board extending across an intermediate portion of a bed is disclosed by Donald in U.S. Pat. No. 535,945 entitled "Detachable Foot Rest and Table for Beds". The board is positionable as a table, and may be pivoted down to act as footboard for a person sitting in bed or extended beyond the foot of the bed for storage. A somewhat similar concept is disclosed in U.S. Pat. No. 4,724,555 issued to Poehner et al. for a "Hospital Bed Footboard". This footboard pulls out and pivots up to form a horizontal table. An alternative embodiment simply swings up to a horizontal, over-floor position and can slide partially over the foot of the bed.

3. Stand-Up Board

The extended articulation capabilities of some beds includes the ability to raise the head of the bed, and correspondingly lower the foot of the bed until the bed is sufficiently inclined to allow the patient to exit the bed from a standing position. In order to accommodate this, it is necessary for the bed to have a footboard that is strong enough to hold the weight of the patient, and yet small enough that it will allow the mattress to be lowered near the floor.

A bed developed by England and described in U.S. Pat. No. 3,997,926 entitled "Bed with Automatic Tilting Occupant Support", is positionable in a stand-up position. A foot rest is shiftable between an inoperative position spaced from the end of the bed to an operative position adjacent to the end of the bed when the bed is inclined. The foot rest is disposed at an obtuse angled relative to the platform.

This footboard has limited capabilities, and is always a part of the bed platform. Considering the infrequency that beds are used to raise a patient to a standing position, it is desirable to have a footboard that is adjustable, can serve different functions, and can be removed if desired.

4. Headboard

When CPR or other emergency procedures are performed on a patient the attending personnel desire to be as close as possible to the patient. Surgical tables, for instance, are built without any form of side barriers. Beds, however, are normally used to support a patient when such procedures are not being performed, and therefore have restraining elements, such as side rails, headboards and footboards. It is conventional to provide a side rail that collapses below the level of the mattress to facilitate care by a nurse, doctor or other attendant. The number of attendants that can reasonably access a patient is limited to the number that can conveniently stand along the sides of a bed. There is thus a need for providing increased access to a patient supported in a bed.

Also, for some forms of equipment, tables or trays are not adequate. For instance, intravenous (IV) equipment typically must be suspended above a patient to allow gravity to convey a fluid from a container to an intravenous needle. Also, traction devices must have an anchor connected to the bed frame. These requirements have led to other support configurations.

In an article entitled "Problems of Patient Support: The Air Fluidised Bed as a Solution", pp. 269–275, Hargest discloses in FIGS. 1 and 2 conventional traction and equipment-supporting apparatus. Peck et al., in U.S. Pat. No. 3,063,066 entitled "Sidegate for Beds", discloses an extension rod mounted to a corner post cap for supporting equipment.

The use of telescoping posts or members in beds are well established. U.S. Pat. No. 3,081,463 issued to Williams et al. for "Motor Operated Hospital Bed" discloses telescoping corner posts supporting end panels. A cable system provides motorized activation. Similarly, U.S. Pat. No. 3,220,020 issued to Nelson for an "Adjustable Height Bed", discloses a bed with leg posts having a spring-biased telescoping outer sleeve that raises and lowers with the bed platform. Hillenbrand et al., in U.S. Pat. No. 3,237,212 entitled "Retractable Bed", also discloses a bed with leg posts having spring-biased telescoping outer sleeves that raise and lower the bed platform.

U.S. Pat. No. 3,742,527 was issued to Johnston et al. for a "Hospital Bed" having hydraulically driven telescoping corner legs and a guard rail with manually telescoping support legs. In U.S. Pat. No. 4,686,727 entitled "Convenience Bar Assembly for Hospital Bed", Wilkinson discloses a vertical bar and cross member for supporting various controls and patient equipment.

The equipment supports thus known in the art are either disposed on the bed in usable position, where they get in the way of the patient and nurses when not used, or they must be removed and stored, and thus may not be readily available when needed.

5. Weight-Sensing System

One of the advantages of the newer technologies has been the ability to monitor the patient while in the bed. An example of this is a system in which the weight of the patient is monitored while on the bed. The weight of the bed itself is compensated for in order to derive the patient's weight.

One such system is used in a bed made by Kinetic Concepts, Inc. of San Antonio, Tex. That bed has a display for showing the patient weight and change in weight.

The conventional structure providing this capability is the use of a stress gauge at each of four corners of the bed. Examples of this structure are disclosed in U.S. Pat. No. 4,669,136 issued to Waters et al. for "Combination Hospital Bed and Surgical Table" (col. 5, lines 13–25, col. 7, lines 59–60); and U.S. Pat. No. 4,926,951 issued to Carruth et al. for "Weigh Bed". This latter patent discloses a weight system in which a load cell at each of four corners is supported on a base frame using a ball to transmit the vertical weight without creating any lateral torque. Horizontal position is maintained by three tie rods connecting the weigh frame to the base frame to prevent twisting of the weigh frame for certain patient or bed orientations.

One problem with such systems is that warp inevitable exists in either or both the bed frame or the base frame. This warping results in inconsistencies in the stress on the stress gauges, and therefor produces inherent inaccuracies or complexities that must be compensated for in some other way.

Not only is it useful to measure the weight of a patient without requiring the patient to leave the bed, it is also desirable to monitor the movement of a patient on the bed. Fleck et al. in U.S. Pat. No. 4,539,560 entitled "Bed Departure Detection System", discloses the use of tape switch detectors in a mattress to detect a person's departure from a bed. Restlessness of a person in the bed can be detected through the use of two or three tape switches.

Peck et al. devised a system for sensing the departure of a patient from the bed of the invention by a decrease in pressure in a lower bladder, as is disclosed in U.S. Pat. No. 4,803,744 entitled "Inflatable Bed".

6. Bed Control Unit

As the complexity of beds and patient care systems increase, the complexity of control of the patient support system also increases. The control of some features, such as bed configuration, are made available to the patient, and control of other features, such as mattress pressure, air flow and temperature, are made available only to the attending personnel. Various control designs have been developed to accommodate these two control needs.

An air suspension bed identified by the proprietary name TheraPulse TM of Kinetic Concepts,Inc. of San Antonio, Tex., includes a hand-held bed controller provided with a hook for hanging the controller on a side rail. The bed also has controls extending from the face of the footboard for use by attendants. Pauna discloses a control panel mounted on a guard rail in U.S. Pat. No. 4,821,348 entitled "Convertible Bed and Bathroom Combination".

In U.S. Pat. No. 3,839,753 entitled "Hospital Bed", Benoit et al. disclose a nurse control panel located in the footboard and covered by a panel cover. These controls are in addition to patient controls. Drew et al. disclose various control units built into guard rails in U.S. Pat. No. 4,1183,015 entitled "Side Guard for Bed Including Means for Controlling Remote Electrical Devices". This patent also mentions that removal, interchange, and replacement of the various controls is possible since the various controls are modular components. The controls may be easily replaced if service is required, or moved from one side to the other depending on the physical affliction of the patient. In patent '654, Vrzalik also discloses a control unit attached to the bottom of the footboard and control switches mounted in the footboard.

Except for the pendant control unit of Kinetics Concepts, such control units are mounted in fixed positions. The pendant control unit requires two hands to use, and is limited to controls made available to the patient. There thus remains the need for a controller that provides both attendant as well as patient controls that is variable in position and even capable of being hand held or removable in order to clear the patient area of the bed.

7. Bed Transport Guide Wheels

One of the concerns with the newer, more elaborate beds is the strength and agility attendants need to maneuver them to different locations within a hospital. Typically, beds are provided with a wheel at each corner, with each wheel being free to turn about a vertical axis. This wheel arrangement is convenient for adjusting the orientation of a bed within a room, but makes turning corners and traveling along a straight line, such as when moving down a hallway, difficult.

Paramedic gurneys exist that have a fifth, center wheel that is fixed in alignment with the length of the gurney and is slightly below the plane of the four corner wheels. This assures that the fifth wheel is always in contact with the floor. However, the resulting rocking effect when weight is shifted from one end to the other is particularly undesirable in a permanent bed.

There is thus a need for a wheel system for hospital beds that allows maneuverability and yet assists in the movement of the bed significant distances.

8. Guard Rail Elevation System

As has been mentioned, beds typically have guard rails that can be fixed in a position above the mattress level, in order to keep patients from inadvertently exiting the bed. During times of attendance, it is desirable to remove the guard rail from its position. This is typically accommodated by making the guard rail removable or, more commonly, adjustable so that it can be pivoted or otherwise lowered below the level of the mattress.

One way that guard rails are lowered is by the use of telescoping support members, such as is described in U.S. Pat. No. 4,439,880 issued to Koncelik et al. for "Geriatric Bed Construction with Sideguards".

Cable and pulley systems are also used in various movable bed mechanisms in order to facilitate movement of a portion of the bed. For instance, Williams et al. disclose a cable-activated telescoping end panel in patent '463. Hunt et al., in patent '276, disclose the use of a cable and spring to operate a valve controlled by rotation of a pulley around which the cable is wound.

As is described in U.S. Pat. No. 4,747,171 entitled "Hospital Bed Rail Assembly", Einsele et al. developed a rail that pivots sideways to a lower position. It includes a spring, a cable and a cam link to resist gravity when lowered and raised.

There remains the need for a heavy duty side guard that raises and lowers in place, and is easy to operate with one hand.

9. Swing Arm Extension Brace

Hydraulic operation provides a readily controlled way to move articulating bed members. For example, Morrison developed a hydraulic ram for moving a pin resting on the edges of travel slots, as is shown in U.S. Pat. No. 3,462,772 entitled "Center-Pivoting Bed". This structure is confined to movement in the slots. Where a hydraulic arm is free to pivot it can experience a large bending moment when extended horizontally. It is therefore desirable to take advantage of the controllability of hydraulic arm movement while minimizing the size of the arm necessary to support a leveraged weight that can exist on the arm.

SUMMARY OF THE INVENTION

The various features of the present invention satisfy these heretofore unrealized needs.

1. Pneumatic System

For example, in one aspect of the invention, a valve for controlling fluid flow comprises a first valve assembly having a first valve seat and a first valve member movable relative to the first valve seat. A second valve assembly has a second valve seat and a second valve member movable relative to the second valve seat. The first and second valve assemblies are structured for varying the fluid flow through each valve seat in proportion to the relative position of the respective valve member to the valve seat. An actuator is coupled to the first and second valve assemblies for moving the first valve member in a first direction relative to the first valve seat while concurrently moving the second valve member in a second direction relative to the second valve seat. The movement in the first and second directions produces increasing restriction to fluid flow in one of the valve seats and decreasing restriction to fluid flow in the other of the valve seats. Precise control of the fluid flow through the two valve seats is thereby achieved.

The present invention also provides various valve assemblies and air distribution paths for effectively and controllably inflating cells of an air mattress. For instance, in one air distribution system made according to the invention for a bed having an inflatable mattress formed of individual inflatable cells, a housing defines a first chamber in communication with a source of pressurized fluid and a second chamber in communication with an inflatable cell. A first fluid-flow port provides fluid communication between the first and second chambers, and a second fluid-flow port spaced from and in opposing relationship with the first fluid-flow port exhausts fluid from the first chamber. A first valve member is movable relative to the first fluid port for controlling fluid flow between the first and second chambers. A second valve member is fixed relative to the first valve member and movable relative to the second fluid port for controlling fluid flow out of the second chamber. An actuator is coupled to the first and second valve assemblies for moving the first and second valve members between the first and second fluid ports.

The present invention also provides a method of controlling the pressure in an inflatable cell of a mattress. This method includes the steps of providing communication between a positive pressure source and the inflatable cell through an inlet fluid-flow port, and providing communication between a negative pressure destination and the inflatable cell through an outlet fluid-flow port. The amount of fluid passing through the second fluid flow port is then varied.

In yet another aspect of the invention, a valve assembly is provided for controlling the pressure of a fluid in a control chamber. The assembly comprises a source of fluid of at least a first pressure, and a destination of fluid at a second pressure less than the first pressure. A housing has a first valve seat defining a first fluid flow port providing communication between the fluid source and the control chamber. A second valve seat is spaced from the first valve seat and defines a second fluid flow port providing communication between the control chamber and the fluid destination. A first valve member is movable relative to the first valve seat for varying the fluid flow from the fluid source through the first fluid port to the control chamber. A second valve member is movable relative to the second valve seat for varying the fluid flow from the control chamber through the second fluid port to the fluid destination. A first actuator is responsive to a first control signal and is coupled to the first valve member for moving the first valve member relative to the first valve seat. A second actuator is responsive to a second control signal and is coupled to the second valve member for moving the second valve member relative to the second valve seat. The first and second actuators are independently controllable for controlling, in combination, the fluid pressure in the control chamber.

In yet another feature of the present invention, a valve assembly is provided comprising a housing having a first wall and a replaceable valve cartridge. The valve cartridge includes a first fluid-flow element defining a fluid-flow path, a valve seat in fluid communication with the first fluid-flow path, and a valve member movable along a valve axis relative to and sealingly engageable with the valve seat for restricting fluid flow through the valve seat. One of the valve seat and valve member is fixed relative to the first fluid-flow element, and the valve member is manually engageable for securing and removing the valve cartridge relative to the first wall. The valve cartridge also includes apparatus for controlling movement of the valve member relative to the valve seat. A means is provided for attaching, preferably manually, the first fluid-flow element to the first wall by applying force on the first fluid-flow element along the valve axis.

Another valve assembly made according to the invention also includes a housing having a first wall and a replaceable valve cartridge. The cartridge includes a first fluid-flow element defining a fluid-flow path, a valve seat in fluid communication with the first fluid-flow path, and a valve member movable along a valve axis relative to and sealingly engageable with the valve seat for restricting fluid flow through the valve seat. One of the valve seat and valve member is fixed relative to the first fluid-flow element, and an extension member is fixed relative to the other of the valve seat and valve member and manually engageable for securing and removing the valve cartridge relative to the first wall. The first fluid-flow element and the extension member are structured to transfer force between the extension member and the first fluid-flow element when force is applied to the extension member relative to the first fluid-flow element along the valve axis. The cartridge further includes a mechanism for controlling movement of the valve member relative to the valve seat. A means is also provided for attaching the first fluid-flow element to the first wall by applying force on the extension member along the valve axis relative to the first fluid-flow element.

Another valve assembly according to the invention includes a housing having a first wall, and a second wall having a fluid-flow port spaced from the first wall. A base member is positionable through the fluid-flow port. A means is provided for attaching the base member to the first wall. A valve member is mounted and movable relative to the base member and the second wall for engaging selectively and sealingly the fluid-flow port. A means is also provided that is controllable for moving the valve member relative to the fluid-flow port.

In a different aspect of the invention, a modular connector system is provided for forming a sealed passageway between two air chambers. It includes a receptacle having an inner cavity with first and second open ends, and a lip extending inwardly around the first open end. The lip has an opening. A disk is positioned in the inner cavity of the receptacle adjacent to the first open end and sealingly positionable against the lip for closing the first open end when positioned against the lip. An insert has a main portion with an inner cavity defining an insert passageway with first and second open ends, and a shoulder extending outwardly from adjacent to the first open end. The main portion is sized to be received in the second open end of the receptacle with the second open end of the insert spaced from the lip. The space between the lip and the insert second end define a chamber in which the disk is captured. The disk is movable between a first position against the lip and a second position spaced from the lip.

The disk sealingly engages the lip when the disk is in the first position. The modular system thus forms a check valve preventing fluid flow through the insert when the disk is in the first position, and allowing fluid to flow through the insert when the disk is in the second position.

The present invention also provides apparatus for inflating cells of a mattress. It includes a first inflatable cell having a wall and a first inlet mounted in the first cell wall for receiving pressurized fluid. An outlet coupling member is mounted to the first cell wall spaced from the first inlet for transmitting pressurized fluid input through the first inlet. A second inflatable cell has an inlet for receiving pressurized fluid for inflating the second cell. A means is provided that is selectively connectable to the outlet coupling member for joining the second cell inlet to the outlet coupling member.

Pressurized fluid received in the first inlet is thereby received in the second cell.

In another apparatus for inflating cells of a mattress made according to the invention, a source of pressurized fluid is provided. A panel having at least two openings supports a plurality of inflatable cells. Fluid communication is provided between the source and openings. A first inflatable cell has walls supported on the panel over the openings. A first inlet coupling member is mounted to the first cell wall adjacent to a first of the openings. The first inlet coupling member is selectively securable to the one opening for providing fluid communication between the panel opening and the interior of the first cell wall. A second inlet coupling member is mounted to the first cell wall adjacent to the second opening. The second inlet coupling member is selectively securable to the second opening for providing fluid communication between the panel opening and the interior of the first cell wall.

An outlet coupling member is mounted to the first cell wall spaced from the first and second inlet coupling member. A conduit is disposed within the first cell walls for providing fluid communication between the second inlet coupling member and the outlet coupling member. The first cell is not inflated by pressurized fluid received in the second inlet coupling member. A second inflatable cell has an inlet for receiving pressurized fluid. A third inlet coupling member is in fluid communication with the second cell inlet and selectively connectable to the outlet coupling member for joining the second cell inlet to the outlet coupling member. Pressurized fluid received in the second inlet coupling member is thereby conducted into the second cell.

As another feature of the present invention, an air distribution apparatus comprises a first housing defining a first fluid-flow path. This first housing also has a first fluid-flow port. A second housing is supported for pivoting about a pivot axis relative to the first housing. This second housing defines a second fluid-flow path and has a second fluid-flow port generally facing the first fluid-flow port. A flexible duct joins the first and second openings for communicating the first fluid-flow path with the second fluid-flow path. A guide is supported relative to at least one of the first and second housings and is attached to the duct for maintaining the duct generally in alignment between the first and second openings during relative pivoting of the first and second housings.

An air distribution system according to the invention is for use in a bed having an inflatable mattress with first and second sections. The sections are relatively pivotable about a pivot axis disposed generally between the sections and are formed of individual inflatable cells. The air distribution system includes a first housing defining a first fluid-flow path and having a first fluid-flow port and a second fluid-flow port spaced from the first fluid-flow port. Both the first and second fluid-flow ports are in communication with the first fluid-flow path. The first housing has an upper surface adjacent to the first mattress section.

A second housing associated with the second mattress section defines a second fluid-flow path and has a third fluid-flow port in communication with the second fluid-flow path. The third fluid-flow port generally faces the second fluid-flow port. The second housing has an upper surface adjacent to the second mattress section. A duct joins the second and third fluid-fluid-flow ports for communicating the first fluid-flow path with the second fluid-flow path. A first coupling couples the first fluid-flow path to a cell in the first mattress section, and a second coupling couples the second fluid-flow path to a cell in the second mattress section.

In yet another air distribution system of the invention for use in a bed having an inflatable mattress formed of individual inflatable cells, a housing defines a first fluid-flow path and has a first fluid-flow port in communication with the first fluid-flow path. The housing has an upper wall adjacent to the inflatable cells. The first fluid flow path is adjacent to the upper surface. The housing further defines a second fluid-flow path and has an intermediate wall positioned between the first and second fluid-flow paths. The housing also has a second fluid-flow port in communication with the second fluid-flow path. A coupling couples selectively the first and second fluid-flow paths to a cell.

A patient support system made according to the present invention comprises a platform having a generally planar upward facing support surface and an inflatable mattress. The mattress comprises first and second separately inflatable cells having contiguous faces extending, when inflated, obliquely relative to the support surface, such that the contiguous face of the first cell extends over the contiguous face of the second cell. Securing means secure the first and second cells to the platform, whereby the first cell is partially supported on the second cell when a person is supported on the mattress. Individual cell support thereby results, regardless of the extent of inflation of adjacent cells.

A shape-adjustable cushion is also provided by the invention. It includes a flexible envelope defining the shape of the cushion and having first and second opposing sides. A means is provided for urging the first and second sides away from each other, such as by inflation. A means is also provided for drawing a portion of the first side toward the second side to an adjusted position. Finally, a means is provided for securing the portion of the first side relative to the second side in the adjusted position. Such a cushion is thereby adjustable to accommodate different body parts of a patient.

The present invention also provides a relief mechanism for deflating an air mattress. A housing defines a fluid plenum in communication with the air mattress and has an outlet port. A valve member is mounted pivotably relative to the housing for pivoting about a pivot axis between a normal position in which the valve member sealingly closes the outlet port, and a release position in which the valve member is spaced from the outlet port. This allows fluid in the plenum to flow through the outlet port. A first securing means secures the valve member in the normal position. A second securing means secures the valve member in the release position. A simple, yet effective means is thereby provided for rapidly deflating the air mattress.

2. Footboard Gate

According to the invention, preferably embodied in a footboard, a collapsible table assembly for a hospital bed includes a frame extending in a generally vertical plane mounted to an end of a bed and having horizontally spaced, generally vertically extending channels. A table is positionable adjacent to the channels and has a guide element extending into each channel. The guide elements are slidable relative to the channels for moving the table between a storage position in which the guide elements are positioned in lower regions of the channels, and a raised position in which the guide elements are positioned at upper regions of the channels.

The table is pivotably coupled to the guide elements for pivoting the table about a pivot axis extending through the channels when the table is in the raised position. In the raised position, the table pivots between an upright position in which the table is generally vertically disposed and a lowered position in which the table is generally horizontally disposed. A stop limits the pivoting of the table relative to the channels. A convenient, built-in storable table is thereby always available for servicing the needs of a patient.

In yet another aspect of the invention, a gate is provided for a hospital bed, which gate comprises a platform having opposite ends for supporting a patient above a floor, and a board mounted adjacent to one end of the platform. Apparatus is provided for pivoting the board about a generally vertical axis, whereby the board is movable between a first position in which the board is adjacent to the one end of the bed and a second position in which the board is pivoted away from the one end of the bed. Access to the end of the bed is thereby provided. Further, when a storable table or set of controls is attached to it, the position of such items is variable.

In a more specific aspect of the invention, a hospital bed comprises a base frame supported on a floor, and a platform for supporting a patient and having a foot end and opposite sides, each side meeting the foot end at a corresponding corner. The platform is supported on the base frame by apparatus for tilting the platform toward an upright position in which the platform has a generally vertical orientation with the foot end adjacent to the base frame. A first board is mounted to the base frame and extends adjacent to the foot end of the platform. The board pivots about a generally vertical axis positioned adjacent to a first one of the corners. The board is thereby movable between a first position in which the board is adjacent to the foot end of the bed and a second position in which the board is pivoted away from the foot end of the bed. When the board is in the second position and the platform is tilted toward the upright position, the board is positioned for use as a support by a patient in the bed.

3. Stand-Up Board

Another feature of the present invention is usable in a hospital bed having an elongate platform supported above a floor, which platform has a foot end and opposite sides. An inflatable mattress is supported on the platform and has a predetermined thickness, an upper surface, and a foot end on the platform foot end. The invention provides a stand-up board assembly having a stand-up board extending between the sides of the platform, and means for mounting the stand-up board on the foot end of the platform adjacent to the mattress. The mounting means is preferably adjustable for varying the angle of the stand-up board relative to the platform.

The invention also provides a stand-up board assembly comprising a stand-up board extending between the sides of the platform, and means for mounting the stand-up board on the foot end of the platform adjacent to the mattress. Further, means are provided for moving the stand-up board from a support position in which the stand-up board extends above the mattress for contact by the feet of a person when the platform is tilted up with the foot end down, and a storage position in which the stand-up board is positioned below the upper surface of the mattress. The stand-up board is thereby readily available for use, but storable below the level of the mattress.

4. Headboard

The present invention also provides a hospital bed with a platform supported relative to the floor, which platform has opposite ends and opposite sides extending between the ends and an upper surface on which a patient is supported above the floor. A base end board is mounted adjacent to and extending generally along the length of one end of the platform. The base end board has a side portion adjacent to each side of the platform, and an intermediate portion between the side portions. The side portions extend above the upper surface of the platform and the intermediate portion is below the level of the side portions. A panel is positionable above the intermediate portion to extend upwardly adjacent to the side portions of the end board. An apparatus supports the panel on the end board. The panel is manually removable from the end board for providing access to the platform, and thereby, to a patient supported by the platform, over the intermediate portion of the end board.

Another hospital bed made according to the invention comprises a platform that has opposite ends and is supportable above a floor for supporting a patient. A board is mounted adjacent to one end of the bed and extends above the level of the platform along the one end of the bed. The board has ends at spaced locations along the one end of the platform and has a predetermined thickness adjacent to at least one end of the board. The one end of the board has an upper surface and an opening in the upper surface. Also, an extendable support bar is mounted in the one end of the board and has an upper end. The bar is extendable between a recessed position in which the upper end is disposed adjacent to the board opening, and a raised position in which the upper end is supported substantially above the board opening, with the bar extending through the board opening. Such an extendable bar is usable for supporting patient equipment and accessories.

More specifically, the present invention also provides a patient equipment support apparatus comprising a base supportable on a floor, and a frame supported on and extending upwardly above the base. An extendable support bar is mounted to the frame and has an upper end. The bar is extendable between a recessed position in which the bar means is disposed adjacent to the frame, and a raised position in which the upper end is supported substantially above the bar. Apparatus for supporting equipment is mounted to the bar. This apparatus is collapsible for storage with the bar in the recessed position. It is extendable outwardly from the bar when the bar is raised sufficiently to position the support apparatus above the frame.

5. Weight-Sensing System

The present invention also provides a scale having a base frame, a weigh frame overlying the base frame, and means disposed at three substantially horizontal, spaced-apart positions for supporting the weigh frame on the base frame. A load cell mounted on each of the supporting means senses the weight supported by the respective supporting means. The three support points define a plane of support that is relatively insensitive to variations in manufacture of the base and weigh frames.

Extending this concept, the present invention also provides an apparatus for sensing the position of an object. It includes a base frame, a support frame overlying the base frame and having a surface for supporting an object, and means disposed at at least two spaced-apart positions for supporting the support frame on the base frame. A means, such as a load cell, for sensing the weight supported by each supporting means of an object is supported on the support frame surface. Also a processor responsive to the weight supported by each of the supporting means determines the position of the object on the support frame surface.

6. Bed Control Unit

A control unit made according to the invention is mountable on a bar, such as a guard rail, for controlling functions associated with patient care. The unit includes a first housing having a front face. Controls are mounted in the front face of the housing. A web has first and second oppositely disposed margins. The web is attached to the housing along the first margin and relative to the housing along the second margin. There is a sufficient distance between the first and second margins to wrap around the bar with the second margin attached relative to the housing.

Another aspect of a control unit made according to the invention and mountable on a bar for controlling functions associated with patient care comprises a first housing having a front face and a rear face. Controls are mounted in the front face of the housing. A second housing is attached to the second margin of the web and has a front face and a rear face. The first and second housings are attached to a bar with the rear face of the first housing facing the rear face of the second housing. Such a control unit provides conveniently accessibly back-to-back patient and attendant controls.

7. Bed Transport Guide Wheels

Another aspect of the invention is a guide wheel assembly usable in a hospital bed having a frame for supporting a patient above a floor and a plurality of support wheels supporting the frame on the floor. The assembly includes at least one guide wheel, and preferably two, means for mounting the guide wheel for rotation relative to the frame so that the wheel contacts a floor on which the frame is supported, and means coupling the guide wheel to the mounting means for resiliently urging the wheel sufficiently toward the floor for maintaining the wheel in contact with the floor while the other wheels contact the floor. Thus, the benefits of a guide wheel are realized while maintaining support on all the wheels.

In a different guide wheel assembly, means are provided for retracting the guide wheel from a guide position in contact with a floor to a retracted position above the floor. The guide wheel is, or the guide wheels are thereby usable selectively.

8. Guard Rail Elevation System

As yet another aspect of the present invention, a guard rail assembly is provided for a hospital bed having a platform for supporting a patient. It includes a base member mountable relative to the platform, and a guard rail for providing a barrier to a patient exiting the bed. Means are provided for mounting the guard rail to the base member for vertically changing the elevation of the guard rail between a barrier position above the level of the platform, and a storage position below the level of the platform. Energy storage means couples the guard rail and the base member for storing energy when the guard rail is lowered from the barrier position toward the storage position, and releasing the energy by applying an upward force on the guard rail when the guard rail is raised toward the barrier position.

A collapsing guard rail assembly also according to the invention, means for mounting the guard rail to the base member, which mounting means includes a sleeve member fixedly attached to the base member and having a vertically disposed first passageway. A hollow first shaft is slidingly received in the first passageway of the sleeve member, and a second shaft is fixedly attached to the guard rail and slidingly received in the first shaft. The first shaft moves relative to the sleeve member and relative to the second shaft when the guard rail is moved relative to the base member. An extended distance of travel is thereby provided for the guard rail, allowing it to be moved below the upper surface of a bed platform.

9. Swing-Arm Extension Brace

In an articulated hospital bed according to yet another feature of the invention, a support apparatus includes first and second hydraulic rams. Each ram has opposite ends attached to the frame and platform, with the respective ends of the first and second rams attached to the frame at spaced apart locations. The rams are operable for lowering the platform toward a position adjacent to the frame. A means provides for transferring weight from the platform directly to the frame when the platform is in a lowered position. In this way, the rams are relieved of a substantial amount of weight, so that they can be built of smaller structural members, and the rams can be extended further than would otherwise be possible.

These and other features and advantages of the present invention will be apparent from the following detailed description of the preferred embodiments of the invention, described for purposes of illustration but not limitation, and as illustrated in the accompanying drawings.

BRIEF DESCRIPTION OF THE DRAWINGS

FIG. 22 is an isometric view of a restraining cushion system made according to the invention.

DETAILED DESCRIPTION OF THE PREFERRED EMBODIMENTS

General Overview

Figure 1:
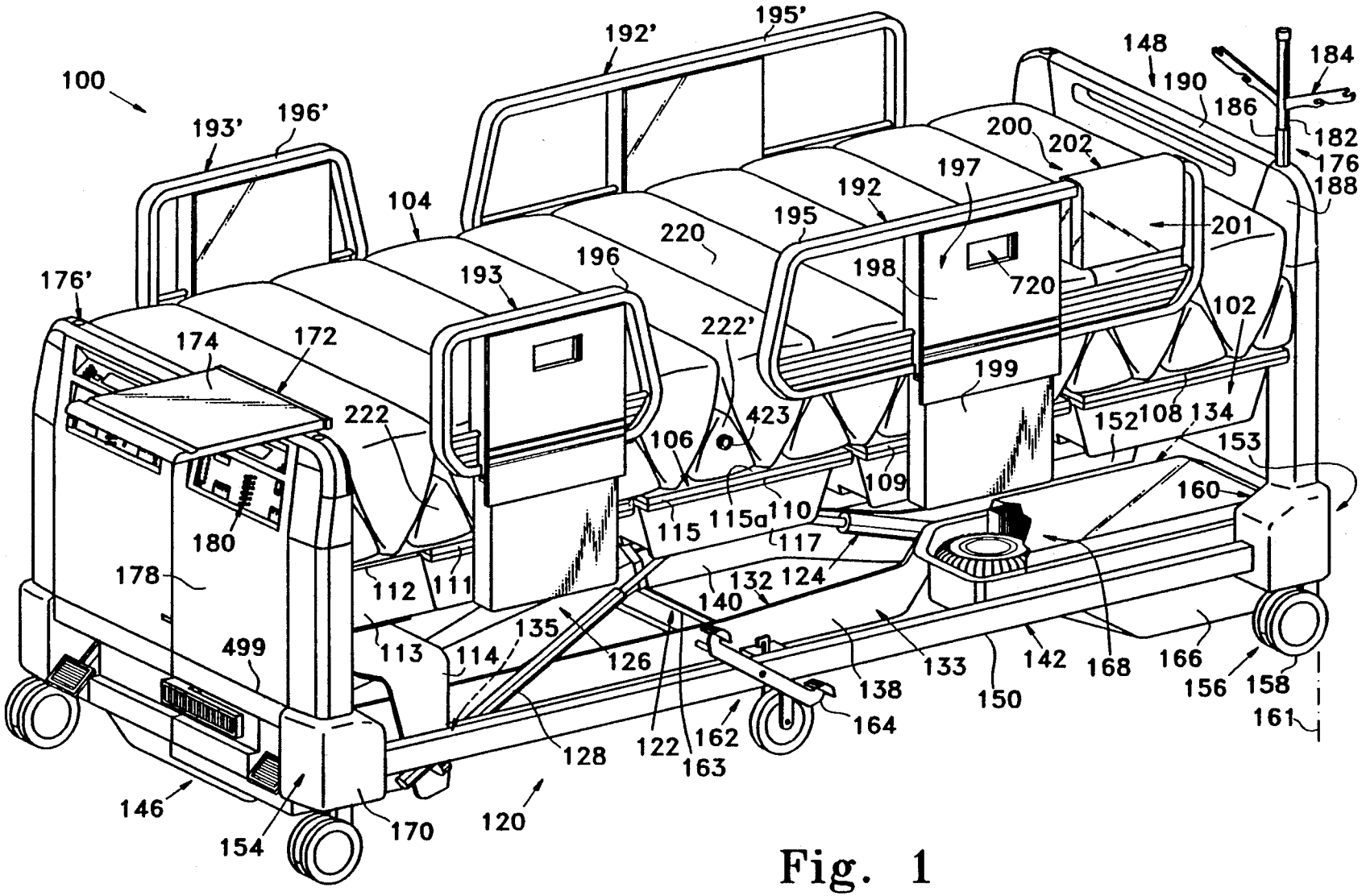
FIG. 1 is an isometric view of a hospital bed made according to the various features of the present invention.

Referring initially to FIG. 1, a bed 100 made according to the invention is shown. Bed 100 includes a pneumatic system 102 for controllably inflating a mattress 104 supported on a platform 106 formed of mutually articulating links or panels 108, 109, 110 and 111. Panel 108 is at what is referred to as the head of the bed, and panel 111 is at the foot of the bed. Panel 111 also includes an extension portion 112 that includes an equipment housing 113. Each panel has a top plate 115 with a top, supporting surface 115*a*, and a subtending tray 117.

Platform 106 is supported above a base assembly 120 by a supporting apparatus 122 that includes opposing hydraulic supports 124 and 126 mounted at spaced locations on the base assembly and at a common universal mounting hidden from view. This structure is like the structure described in U.S. Pat. No. 5,023,967 issued to Ferrand for "Patient Support System". Support 124 is referred to as a drive cylinder and support 126 is referred to as a swing arm. Additionally, there are opposing roll cylinders at the foot end of the bed, such as cylinder 128.

Figure 71:
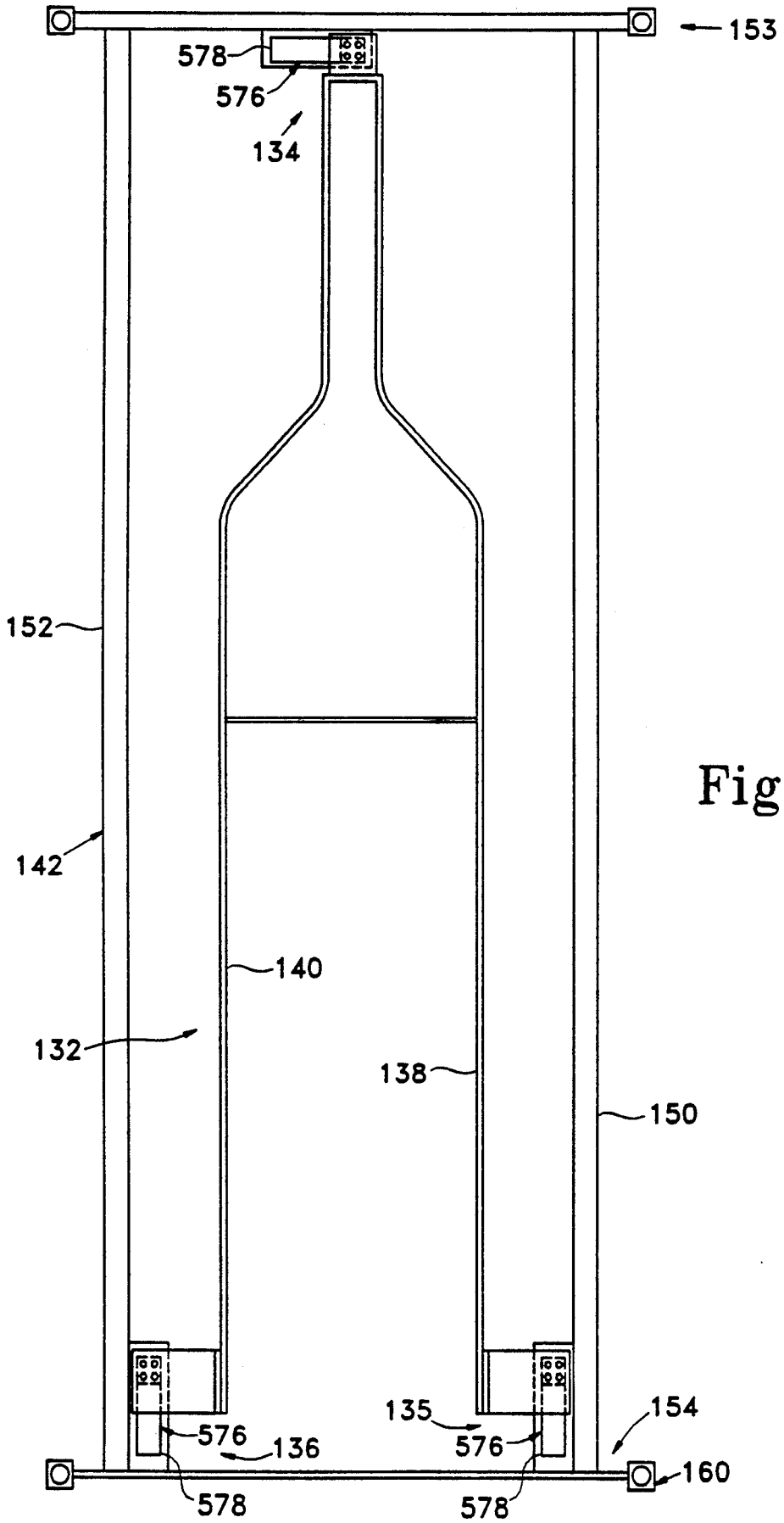
FIG. 71 is a plan view of the base frame supporting the three-point weigh frame.

The base of the hydraulic supports are mounted to a weigh frame 132 forming part of a position-sensing weigh system 133. The weigh frame has a wishbone shape and extends from a central support 134 at the head of the bed to two lateral supports 135 and 136, shown specifically in FIG. 71, at the foot of the bed, by structural members 138 and 140. The platform and support system are supported on the weigh frame at the foot of the bed by a yoke member 144.

Base frame 142 includes a footboard assembly 146, a headboard assembly 148, and connecting side rails 150 and 152. At each corner of the bed frame, such as corner 153 or 154 shown in FIG. 1, the junction between the end (foot or head) board and associated side rail, is a castor assembly 156 having a castor 158 and a mounting apparatus 160 that allows free pivoting of the castor about a vertical axis 161, and is lockable to capture the castors in a position in alignment with the longitudinal length of the bed for use during transport.

Figure 87:
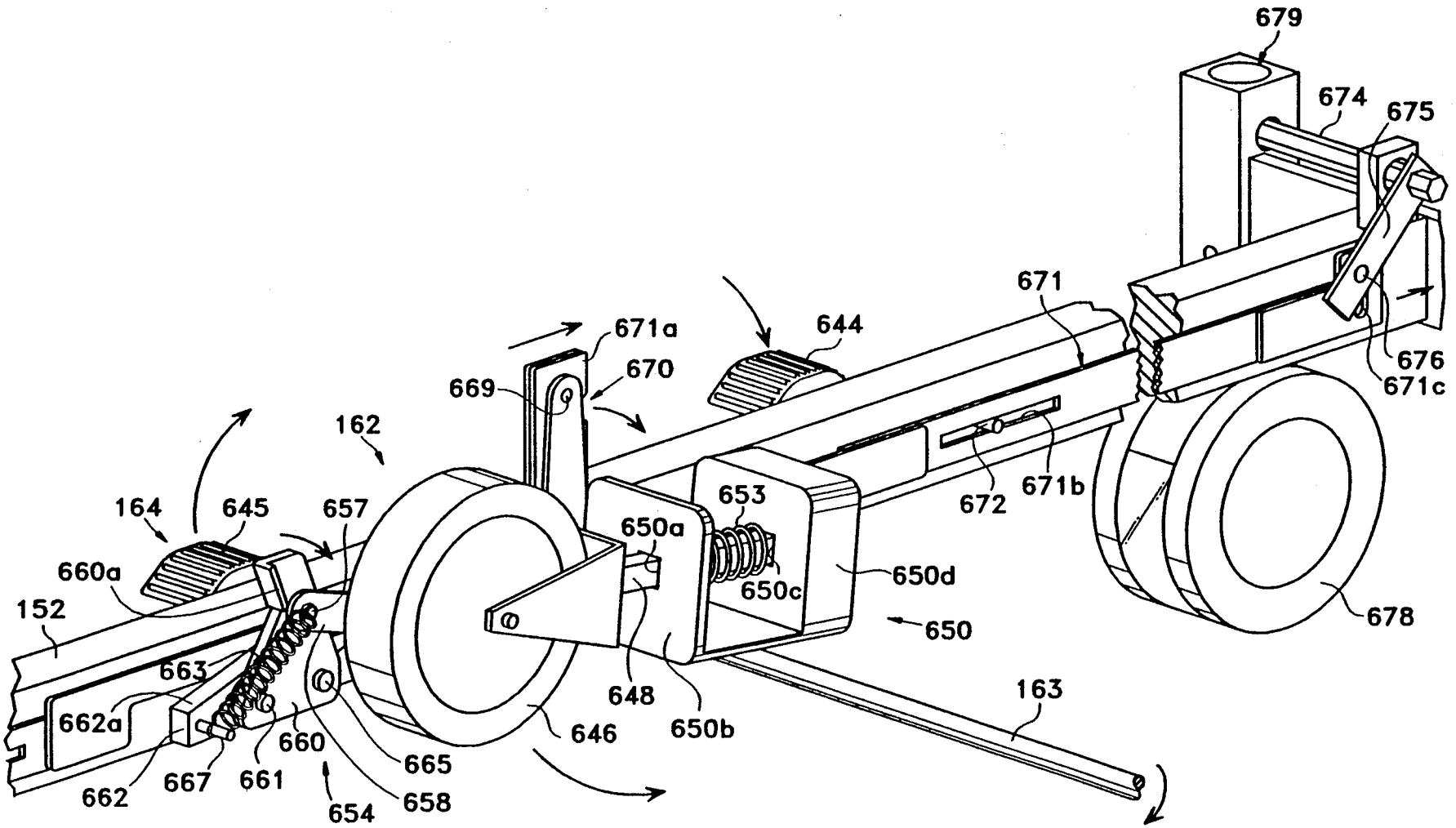
FIGS. 87, 88 and 89 are partial isometric views showing the structure of a guide wheel assembly and castor actuator according to the invention in different positions.
Figure 88:
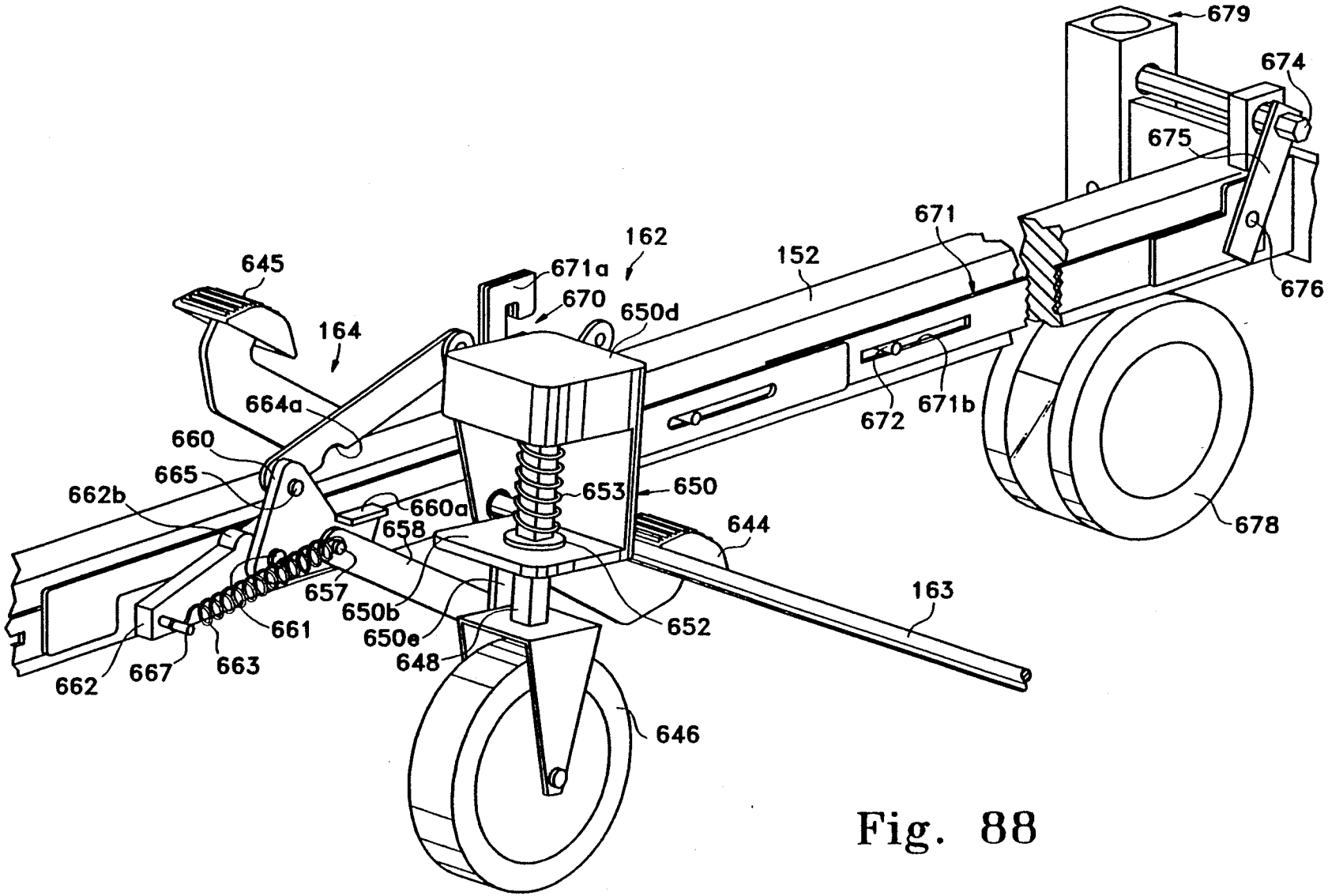

Disposed at the middle of each side rail is a guide wheel assembly 162 connected by an actuator rod 163 to a foot pedal lever 164, particularly shown in FIG. 87.

A basket 166 supported at each front corner of the base frame carries supporting operating and control equipment, shown generally at 168.

Footboard assembly 146 includes a footboard frame 170, left and right footboard table assemblies, such as assembly 172 having a storable table 174, an extendable equipment support assembly 176, and a footboard panel 178 having a built-in control unit 180 for controlling various bed and patient related functions.

Headboard assembly 148 similarly has an extendable equipment support assembly 176 with an extendable upper bar 182 having equipment support apparatus 184 and received in an intermediate bar 186 adjustable in position relative to the headboard panel 188. An emergency procedure access or intermediate panel 190 is removable from the headboard.

Bed 100 also has patient guard rail assemblies, such as assemblies 192 and 193, positioned along the platform sides. Assembly 192 includes an extended guard rail 195 and assembly 193 includes a smaller guard rail 196, as shown. Guard rail 196 is shorter than guard rail 195 primarily to allow relative articulation of panels 109–111 into sitting or folded positions. Each guard rail assembly includes an elevator mechanism 197 hidden by telescoping housings 198 and 199.

The manipulation and control of the bed, and other patient care systems, are provided by a portable "saddle-bag" controller 200 that wraps around a guard rail, such as guard rail 195, as shown. This controller provides an outer, attendant-operated control panel 201, and an inner, patient-operated control panel 202.

1. Pneumatic System

Referring now to FIGS. 2, 3, 4, 5, 6, 7 and 8, pneumatic or air distribution system 102 is shown in further detail. System 102 includes a source of pressurized as a blower 204 that forces air through a channel 206 heated by a heater 208. Blower 204 is also referred to as inflating means or a pressurized fluid source. The heated air is directed serially through respective trays 117 of each of panels 108–111, as shown. Each panel includes, generally a basin or outer tray 210, and an inner tray assembly 212 that includes a lower tray section 214, an intermediate tray portion 216, and an upper tray section 218. Each tray assembly, also referred to generally as a housing, defines manifolds used for distributing air to and from individual cells, such as upper cells 220 and base cells 222 of mattress 104.

Figure 2:
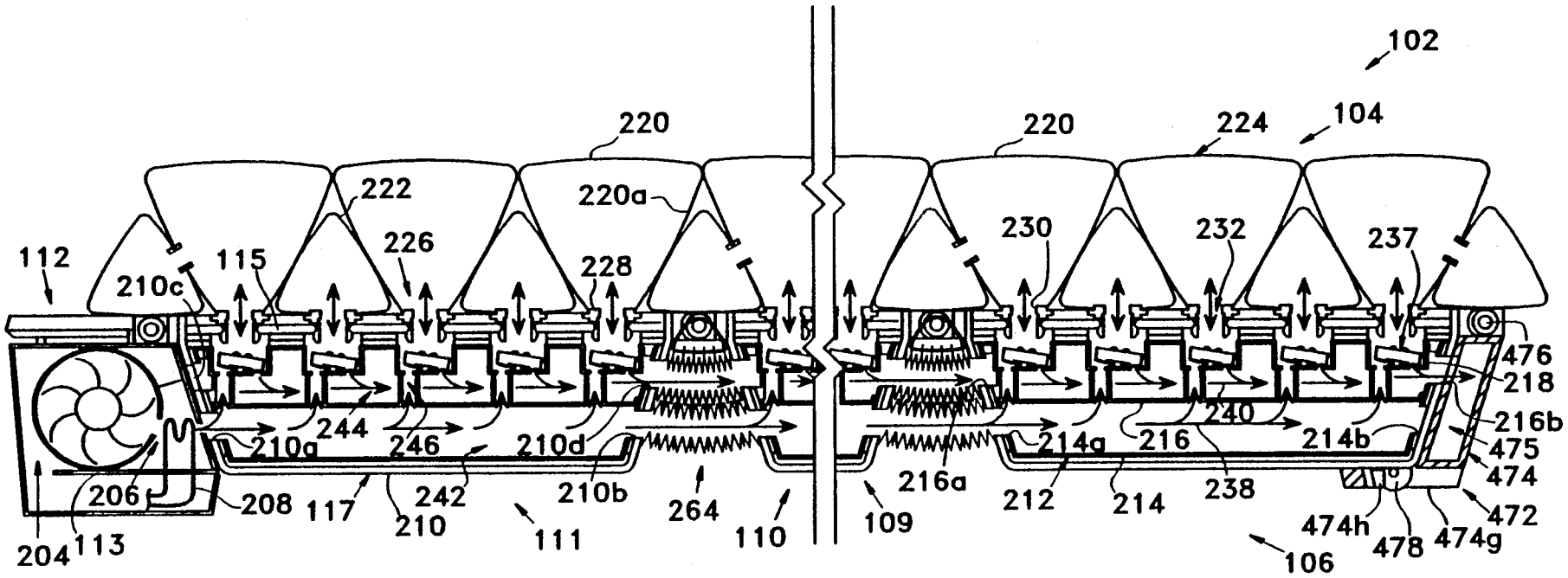
FIG. 2 is a side cross section showing the pneumatic system of the bed of FIG. 1.

As can be seen in FIGS. 1 and 2, mattress 104 has alternating cells 220 and 222. As viewed in FIG. 2, both types of cells are generally triangle shaped, with a base of a cell 222 supported on the associated platform, and a point of a cell 220 supported on the platform. Since cells 220 are larger than cells 222, they extend above the base cells. The upper or patient support surface 224 of the bed is thus formed by the upper, exposed surfaces of cells 220. The larger cells thus have faces or sides, such as side 220*a*, that extend at an oblique angle to the platform and over the tops of the lower cells, and the adjacent side walls of adjacent cells touch.

During articulation of the bed, different combinations of upper and base cells are deflated to allow pivoting of the associated panels. When a base cell is deflated, the upper cell is then allowed to pivot over. This is generally avoided. However, when an upper cell is deflated, the adjacent upper cells do not move to fill in the gap, because the intervening base cell acts as a wedge to keep it from moving. Thus, so long as the base cells are inflated, the upper cells are independently pressure-controllable, without altering the cell position. Since the face of the base cell is supported on the platform, it also does not bend. Thus, a very stable cushion system is provided with this combination cell structure.

Figure 25:
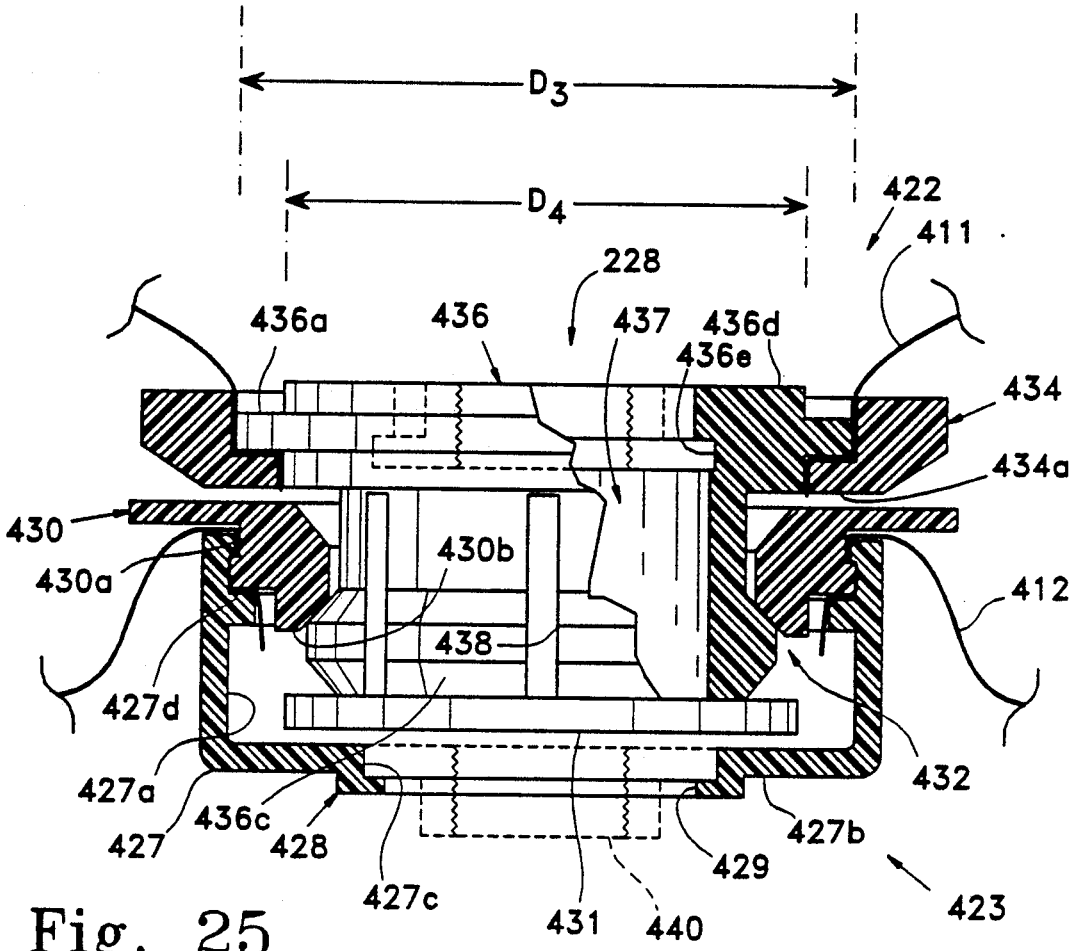
FIGS. 25 and 26 illustrate connector assemblies made according to the invention for use in the cushions of the previous figures.
Figure 26:
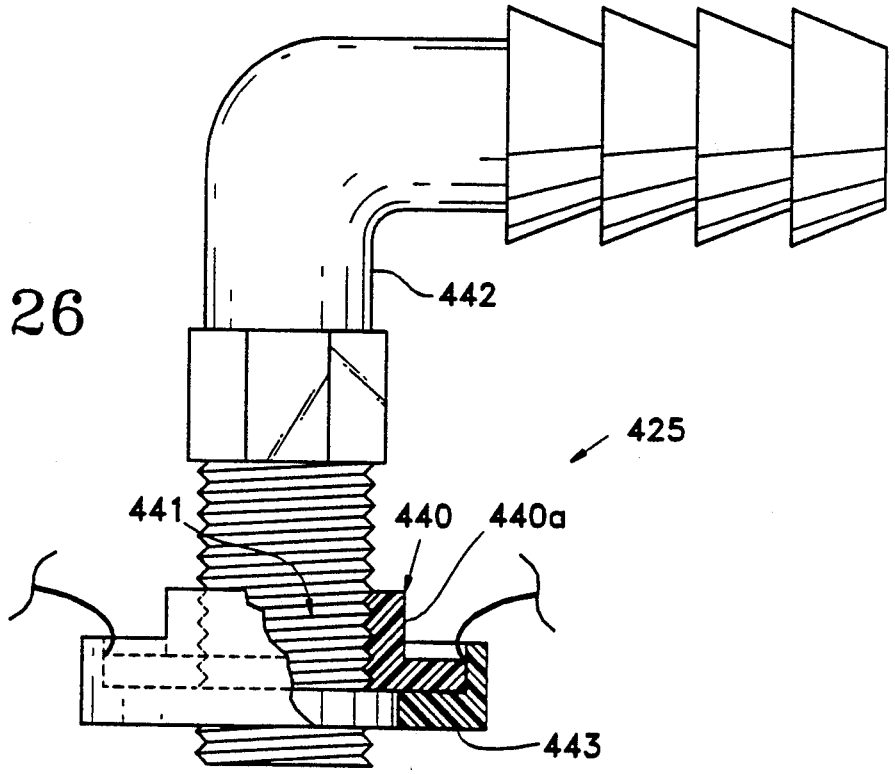

The cells have fluid-flow ports, such as port 226 formed by the combination of cell fabric or envelope, such as a breathable or waterproof fabric as are well known, and an insert connector 228, to be described further with reference to FIGS. 25 and 26. The insert connector sealingly snaps into a coupling port 230 extending through the upper plate of the associated platform. Below port 230 is a control chamber 232 that has substantially the same pressure as the associated cell.

The control chamber is defined by the platform plate and tray assembly 212. It has an inlet fluid-flow port 234 and an outlet or exhaust fluid-flow port 236. Mounted relative to the inlet and outlet ports is a valve assembly 237, for selectively controlling the air pressure in the associated mattress cell. One or a plurality of control chambers may be associated with each cell.

The panels are all made with the same base components of top plate, outer tray, inner tray assembly and associated sealing materials. As has been mentioned, the top plate has an array of coupling ports for connection with associated mattress cells, there being a control chamber and valve assembly for each coupling port.

Each panel provides a pair of air or fluid-flow travel paths 238 and 240 along the length of the bed, with path 238 providing higher pressurized air and path 240 providing reduced pressure (exhaust) air. Path 238 is provided by a pressure chamber 242 formed by lower and intermediate tray sections 214 and 216. Path 240 is provided by an exhaust chamber 244 formed by intermediate and upper tray sections 216 and 218.

Each travel path in a panel has a corresponding inlet and outlet. In the case of higher pressurized air path 238, the outer tray has an inlet 210*a* and an outlet 210*b*, and lower tray section 216 has corresponding aligned inlet 214*a* and outlet 214*b*. In the case of path 240, outer tray 210 has an inlet 210*c* and an outlet 210*d* and intermediate tray section 216 has a corresponding aligned inlet 216*a* and outlet 216*b*.

Note that for foot end panel 111 the path 240 outlet is sealed, and for head end panel 108, the path 238 outlet is also sealed, during normal operation. Also, a cylindrical supply cavity 246, also referred to as means coupling the path to the cells, or channel means, couples pressure chamber 242 to each control chamber 232 via inlet port 234.

Although not shown, sensor receptors and processor controllers are also preferably mounted in or on the trays, with associated pressure and temperature sensors mounted in the corresponding control chambers. The trays are preferably formed with troughs for holding such devices.

Figure 3:
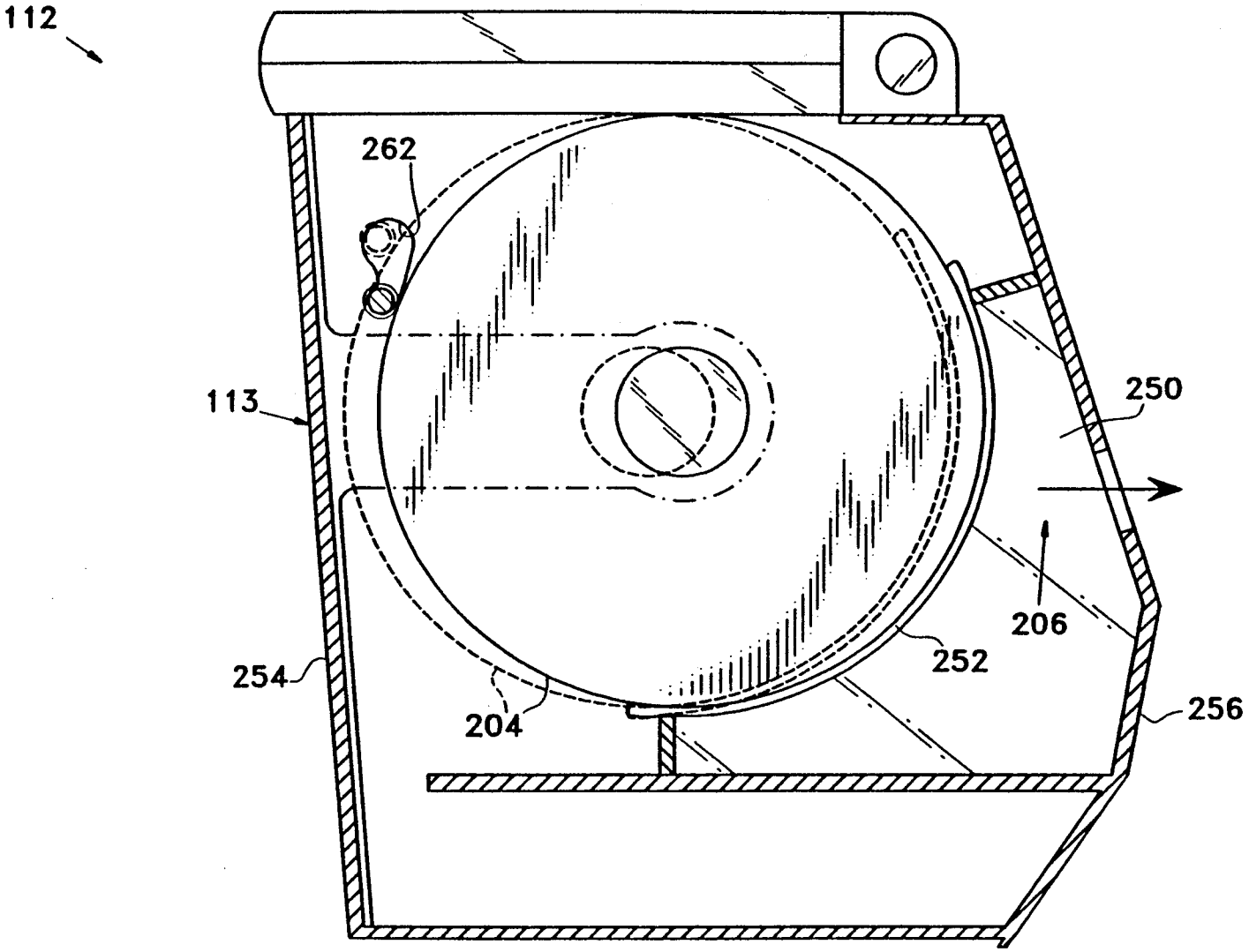
FIG. 3 is an enlarged view of the left end of FIG. 2 showing the blower mounting.

An enlarged cross-section, as viewed along an axis 248 of rotation of air blower 204, is shown in FIG. 3. The blower housing is generally cylindrically shaped. It seats, during operation in a pair of parallel mounting panels, such as panel 250, having curved edges conforming to the blower housing, and with associated plates, not shown, forming channel 206. The plate and mounting panel edges are lined with a suitable resilient liner 252 for forming an air seal.

Equipment housing 113 includes a removable cover 254 mounted on a fixed wall 256. Removal of cover 254 provides access to the blower. The blower is held in position by a rod 258 having a resilient sleeve 260. The rod is held in place against the blower housing by lodgement in an aperture 262 in each of the mounting panels. Aperture 262 has an offset kidney shape to allow positioning the rod in the apertures for holding the motor, as shown by solid lines during operation. The position of the rod in phantom lines illustrates the position when the rod is positioned by sliding it through the enlarged end of the apertures while the blower is held in position near the mounting panel edges. This mounting structure provides for rapid access for removal or installation of the blower.

Figure 4:
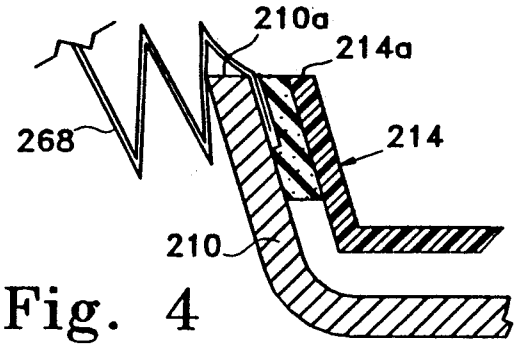
FIG. 4 is an enlarged fragmentary cross-section of a portion of FIG. 2.

The pneumatic system 102 also includes a bellows assembly 264 for providing fluid communication between associated fluid-flow ports in the adjacent panels, as shown. Each bellows assembly, also referred to generally as duct means, includes an upper connecting bellows 266, a lower connecting bellows 268, and a guide assembly 270. The bellows are each formed of a resilient material with alternating enlarged sections, such as sections 266*a* and 268*a*, and reduced sections 266*b* and 268*b*. These alternating sections result in folds in the bellows, as is common of bellows structures, allows the bellows to expand and contract. Also, by nesting the folds of one bellows in the creases of the other, they can be made with a relatively larger passageway for airflow. The ends of the bellows are mounted sealingly to the respective inlet and outlet ports of the outer tray 210, as shown in FIG. 4 to form sealed passageways for the air flow as has been described.

Figure 5:
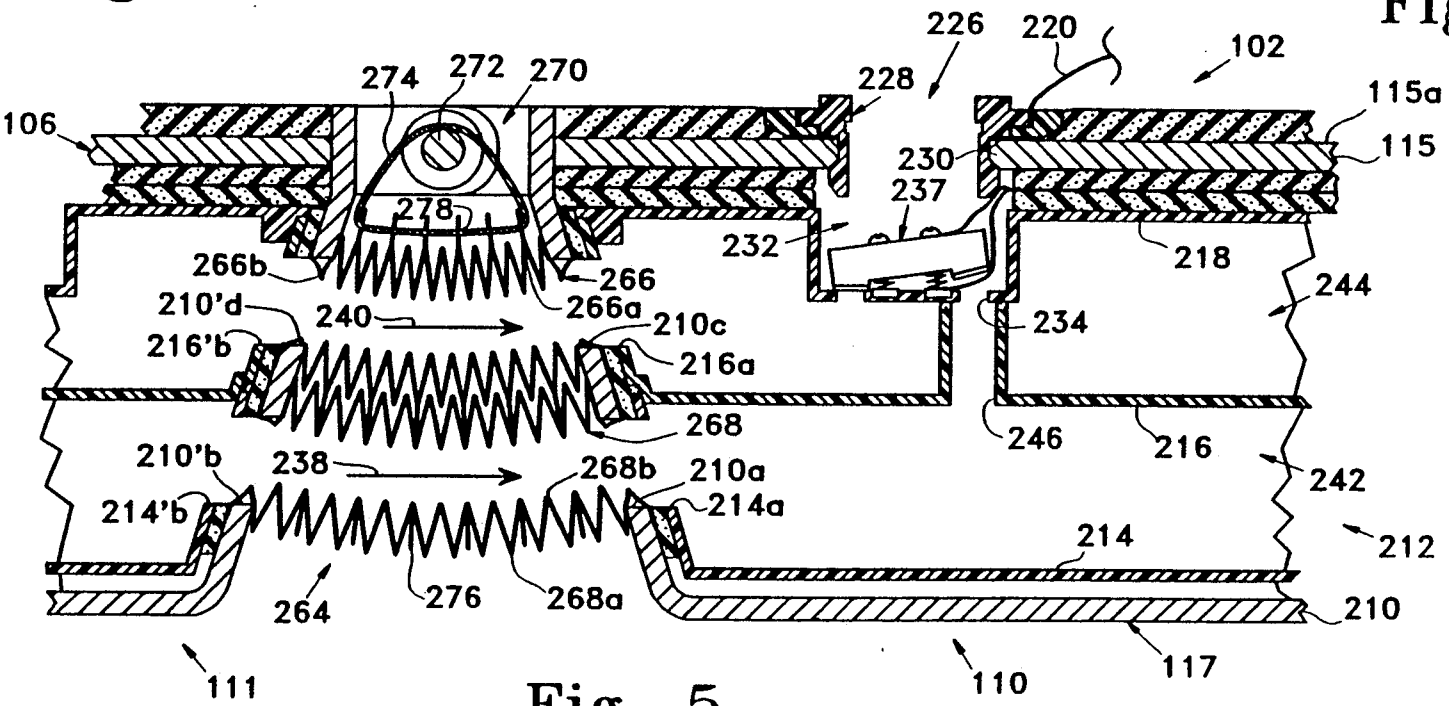
FIG. 5 is an enlarged view of a portion of FIG. 2.
Figure 7:
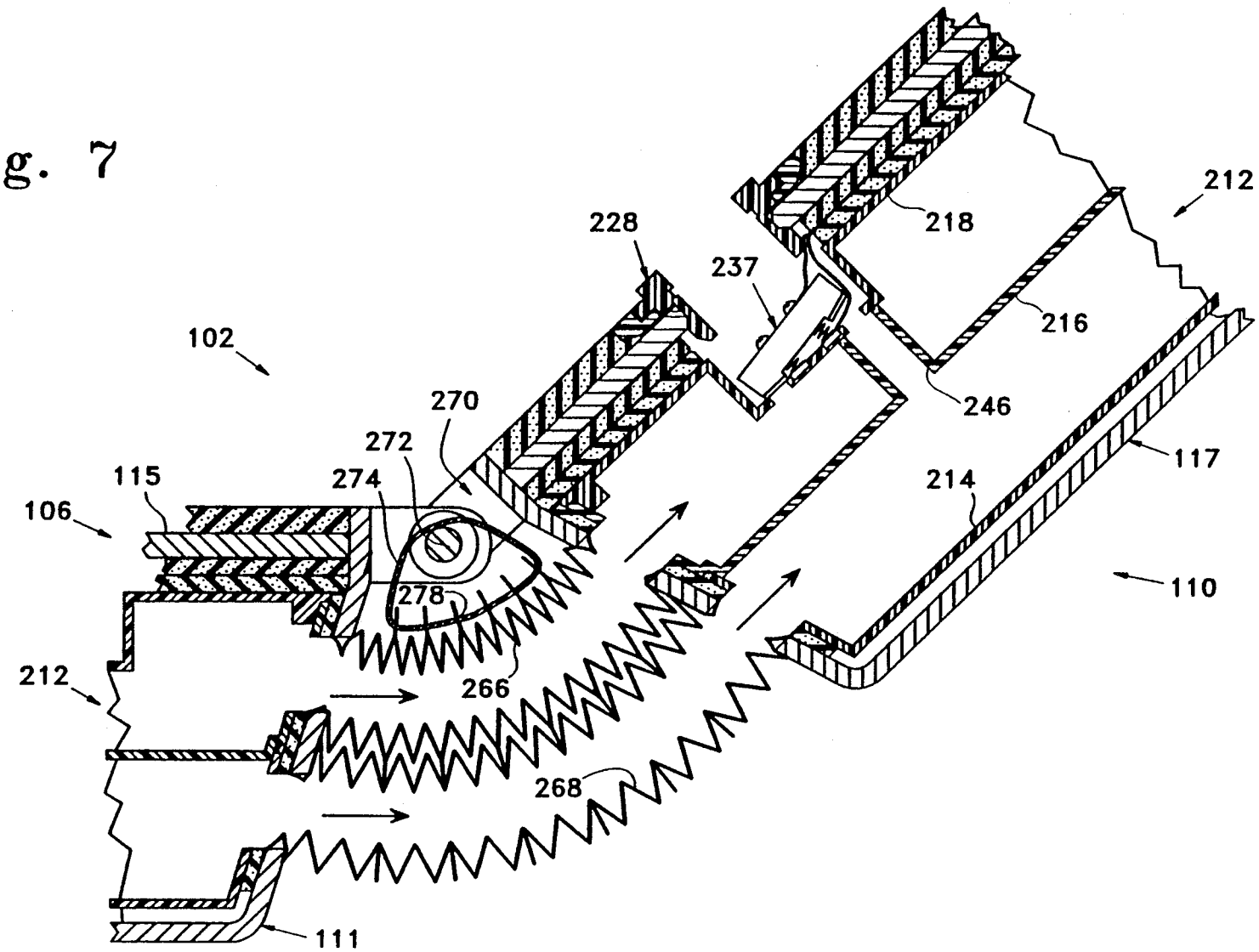
FIG. 7 is a view similar to FIG. 5 showing two bed sections articulated.

FIG. 5 shows the position of the bellows when the associated top plates coextend in a plane, i.e., the platform support surface is flat. Even in this configuration, the bellows are each longer than they are thick. FIG. 7 shows the relative positions of the bellows when the associated platform panels are relatively pivoted about a pivot axis defined by a common pivot rod 272. The bellows, in this example, extend along a substantial arc. Correspondingly, when the panels are relatively pivoted the other direction, the bellows must accommodate very close spacing between the adjacent, connected outer tray ports.

Figure 6:
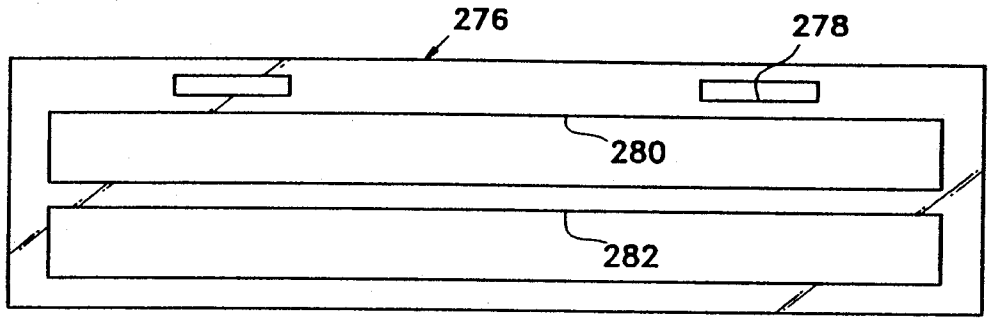
FIG. 6 is a plan view of a spacer used in the bellows assembly of FIG. 5.

Because of their resilience, these bellows tend to droop. Guide assembly 270 provides support to the bellows as they are expanded and contracted during articulation of the associated platform panels. It includes a pair of flexible collars, such as collar 274, spaced apart on pivot rod 272. A plurality—in this case six—of planar spacers 276 support the bellows. As is shown in FIG. 6, each of these spacers or membranes has an opening 278 through which the collar passes, an opening 280 through which the upper bellows passes, and another opening 282 through which the lower bellows passes. Bellows openings 280 and 282 are sized and positioned to conform with the reduced sections 266*a* and 268*a* of the respective bellows when the bellows are intermeshed. The spacers are preferably positioned at alternate reduced sections and are preferably made of a reasonably rigid material, such as plastic. The guide assemblies thus hold the respective bellows in alignment with the corresponding fluid-flow ports of the outer tray to maintain uninterrupted air flow while allowing substantially unlimited flexure of the bellows as they are expanded and contracted by the articulating of the associated platform panels.

Figure 8:
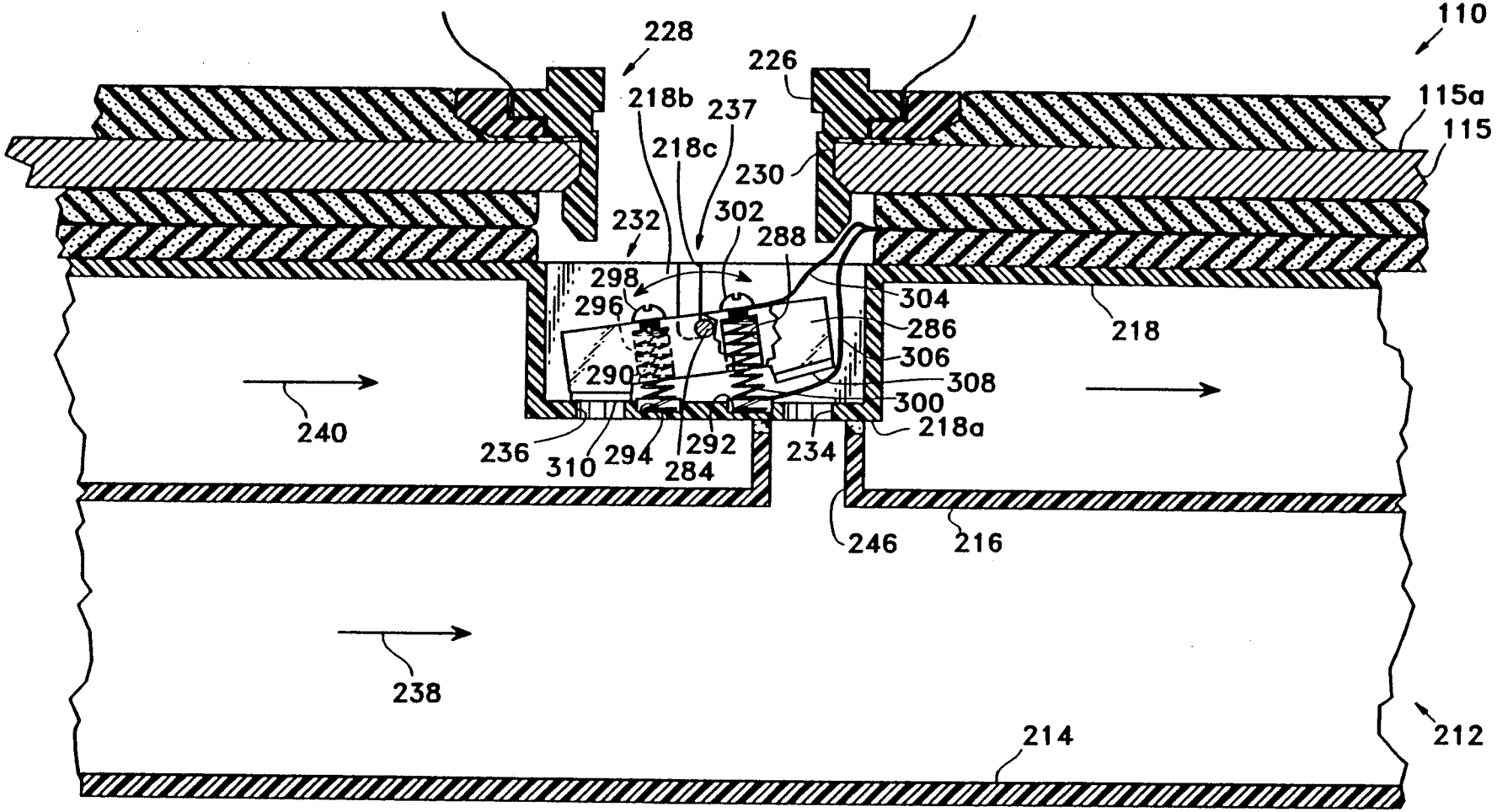
FIG. 8 is a further enlarged view of a portion of FIG. 2 showing a rocker-arm valve in a bed section.

FIG. 8 shows an enlarged illustration of a valve assembly 237 and associated housing provided by tray assembly 212. Upper tray section 218 includes a box 218*a* open at the top adjacent to connector 228 to form control chamber 232. The bottom of the box has inlet and outlet ports 234 and 236. Two opposing sides of the box, including side 218*b*, have "L" shaped grooves 218*c* for receipt of a pivot rod 284. A valve frame 286 pivots on the rod and has two vertical cavities 288 and 290, open from the bottom, as shown in the figure. A corresponding pair of recesses 292 and 294 exist in the floor of the box between ports 234 and 236. These recesses are aligned with respective cavities 288 and 290.

A plain, compression spring 296 is positioned in cavity 290, the upper end of which is held in position by a screw 298, and the lower end of which is seated in recess 292. A temperature-responsive spring 300, preferably made with a shape-memory alloy such as a nickel and titanium alloy, is positioned in cavity 288 with a lower end seated in recess 292. The upper end is attached to a metal screw 302, that is also connected to an electrical conductor 304. Another electrical conductor 306 is connected to the foot of spring 300.

On the lower surface of the ends of valve frame 286 are respective valve members 308 and 310 positioned at a slight angle relative to each other so that they will lie flush on the rims or valve seats forming valve ports 234 and 236, sealing them. Because both valve members are on a single pivoting frame, only one port is closable at a time. As one port is opened, the other closes. This results in three general operative positions for the valve assembly: closed inlet port, closed outlet port, and both ports open.

Figure 9:
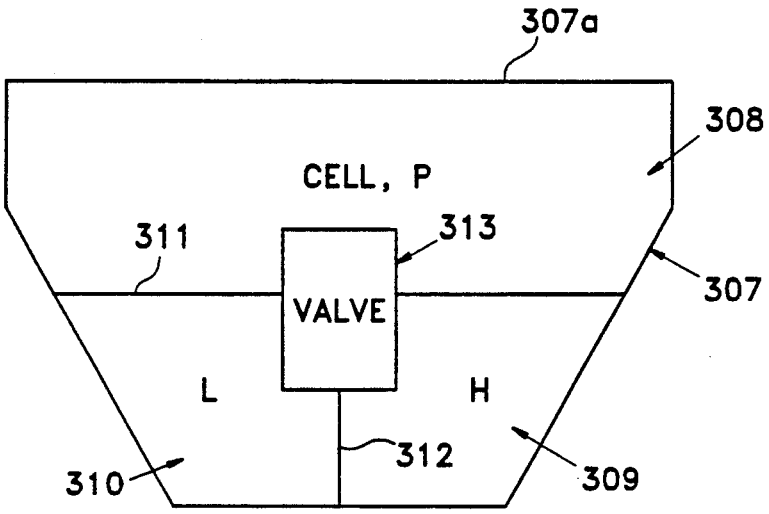
FIG. 9 is a general diagram showing a lateral cross-section through a bed section having an alternative air chamber structure.

FIG. 9 shows conceptually an alternative manifold structure usable in a pneumatic system made according to the present invention. The embodiment shown in FIG. 2 has air flow paths that are vertically spaced, i.e., the exhaust path is above the pressure path. In the embodiment of FIG. 9 these fluid flow paths are horizontally spaced.

More specifically, a housing 307 defines an upper surface 307*a* that corresponds to the platform upper surface having a port, not shown, coupling a mattress cell to a cell controlled-pressure (P) chamber 308 shown below it. Chamber 308 is disposed over a pressurized-fluid supply or high pressure (H) chamber 309 and an exhaust or low pressure (L) chamber 310, as shown. Chambers 309 and 310 are separated from chamber 308 by a wall 311, and chamber 309 is separated from chamber 310 by a wall 312. At the junction between walls 311 and 312 is a valve assembly 313 for controlling fluid passage from the high pressure chamber into the control chamber and from the control chamber into the low pressure chamber. Valve assembly 313 could be any suitable structure, such as valve assembly 237 shown in FIG. 2.

Figure 10:
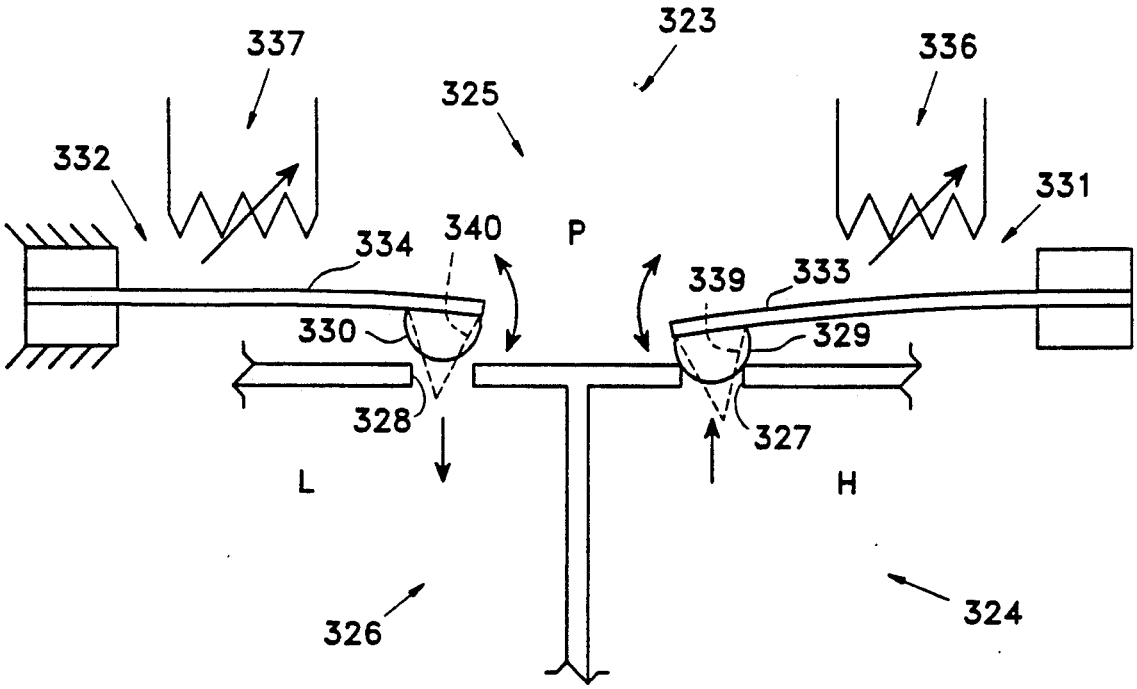
FIG. 10 is a side view of dual poppet valve, usable in the pneumatic system of FIG. 2 for providing independent high and low pressure control.

An alternative valve assembly 323 is shown in FIG. 10. In this embodiment there are high pressure (H), controlled pressure (P), and low pressure (L) chambers shown generally at 324, 325 and 326, respectively. An inlet port 327 provides communication between chambers 324 and 325, and an outlet port 328 provides communication between chambers 325 and 326. These ports are valve seats that are controlled by valve members 329 and 330. Movement of these valve members is controlled by actuators 331 and 332, respectively. These actuators are also preferably of a temperature-responsive material as was described for the actuator of FIG. 8. In the embodiments shown, temperature-responsive, cantilevered arms 333 and 334, respectively, are fixed at one end, and have the corresponding valve members 329 and 330 attached to the distal end. Controlled heat sources 336 and 337 provide the necessary control over the flexure of the cantilevered arm to control opening and shutting of the respective ports.

Valve members 329 and 330 are hemispherical. With this shape, as they approach the respective port, a portion of the member enters the port before it seats on the valve seat, as shown by valve member 329. An alternative form of the valve members is a cone-shape, as is shown in dashed lines by alternative valve members 339 and 340. These valve members extend well into the respective ports, prior to sealing them off. They thus provide significant control for varying the flow through the ports, thereby allowing pressure control through restriction of the port. The air flow restriction at each valve port is proportional to the distance of the valve member from the valve seat. Additionally, they are particularly effective for reducing the noise of air passing through the valve. Conventional flat valve seats, as shown in FIG. 8, simply open and close the associated valve ports.

One advantage of having a double-sealing valve assembly, such as assembly 323, is that changes in the cell pressures, while they are sealed can be used to identify the location of the patient. Each cell that supports a portion of a patient's body has a pressure that is higher than the cell pressure when it does not support a patient's body. If the cells are inflated to respective predetermined pressures before a patient is supported, the distribution of the patient's body on the various cells is readily determined once the patient is on the mattress. Further, changes in the cell pressures while the cells are kept sealed are then due to changes in the patient's position. The relative pressure changes can then be used to determine the patient's new position.

Figure 11:
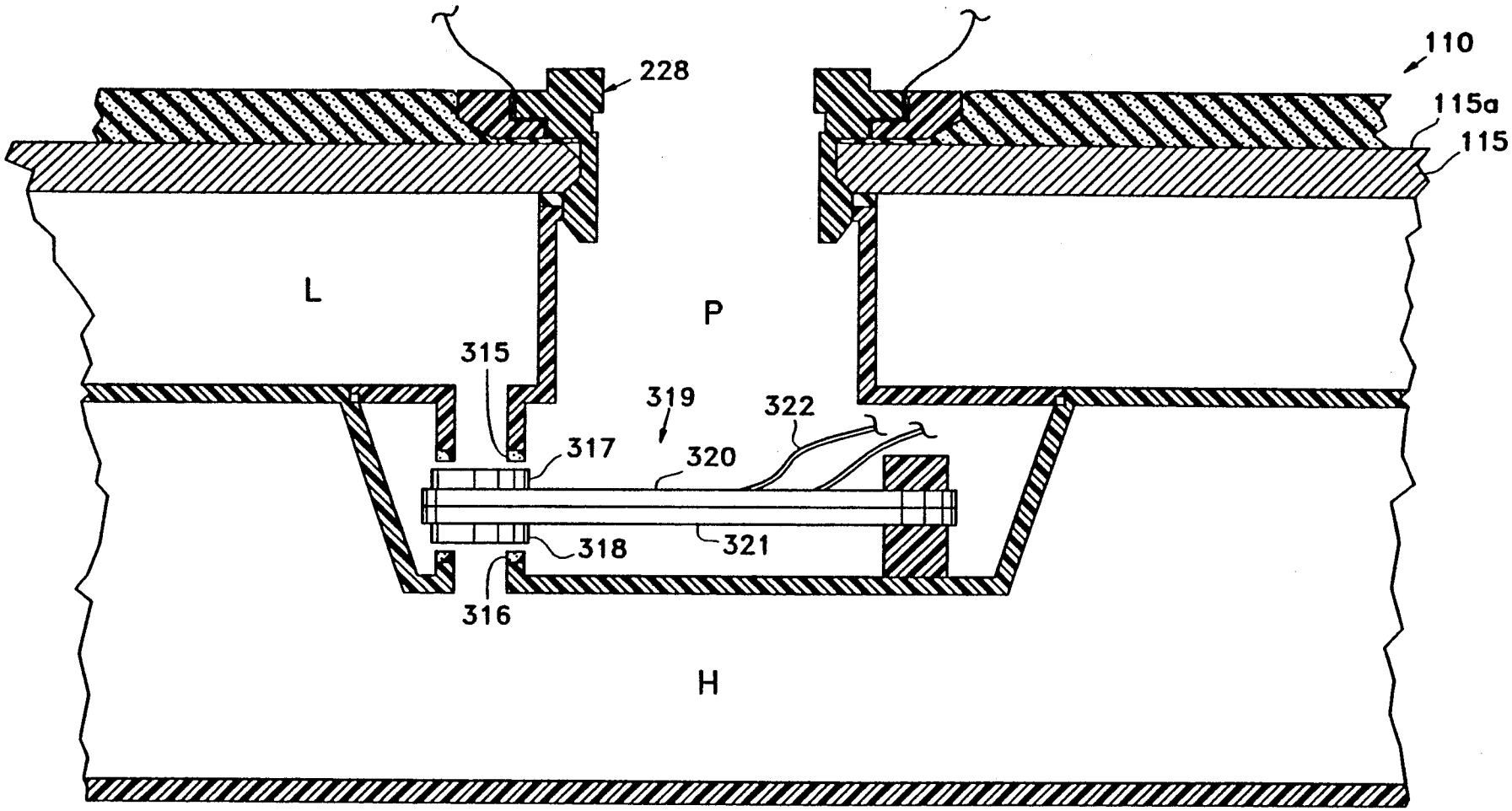
FIG. 11 is a view similar to FIG. 8 showing yet another embodiment of a valve assembly.
Figure 12:
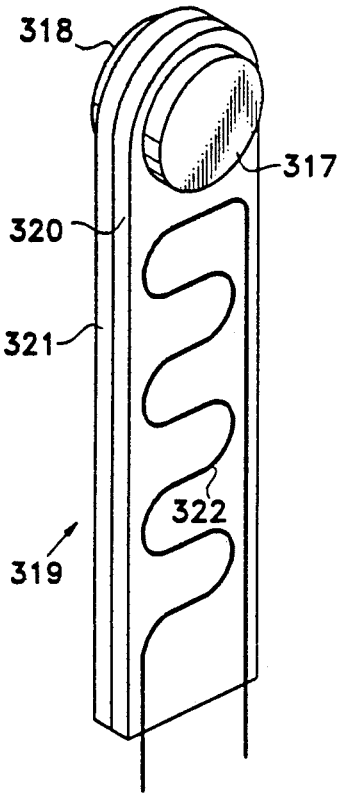
FIG. 12 is an isometric view of a valve member arm in the valve assembly of FIG. 11.
Figure 19:
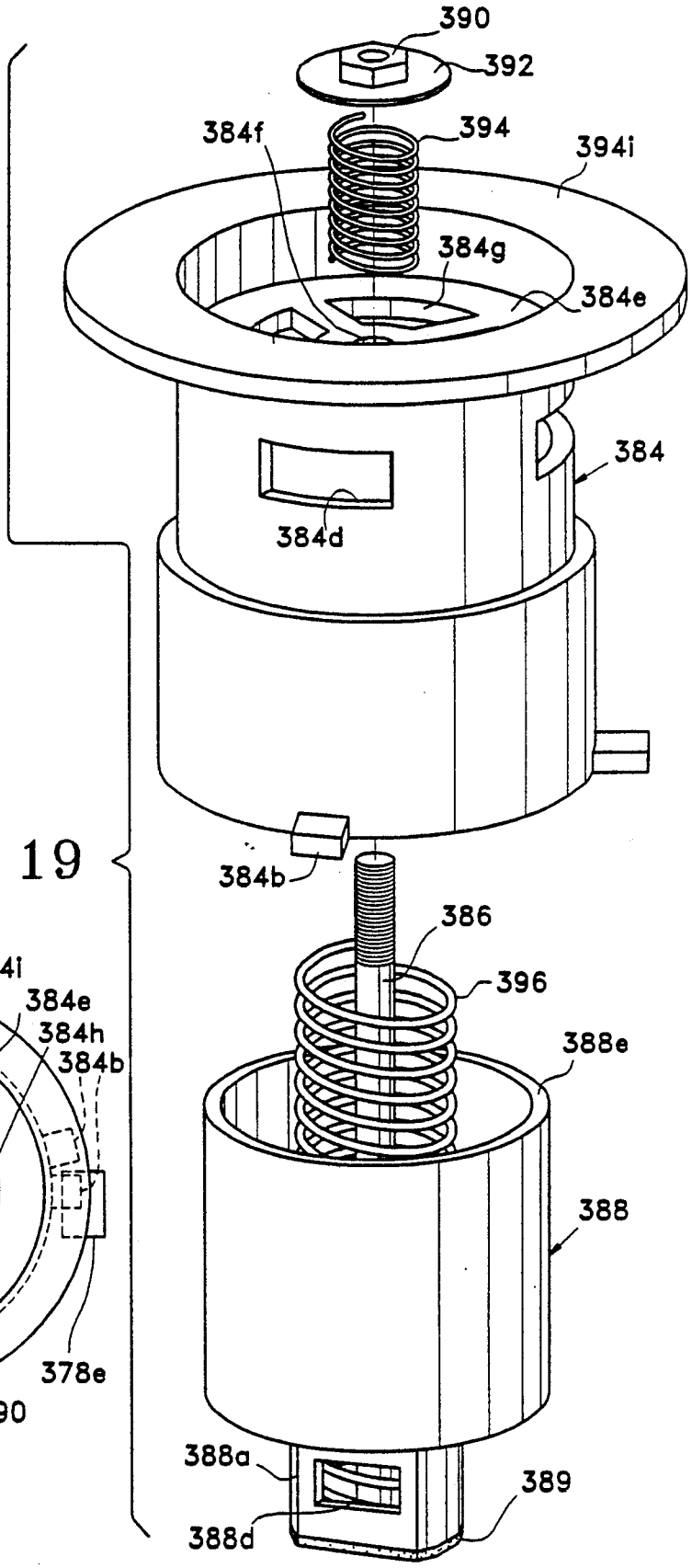
FIG. 19 is an exploded view of the cartridge valve of FIG. 17.
Figure 20:
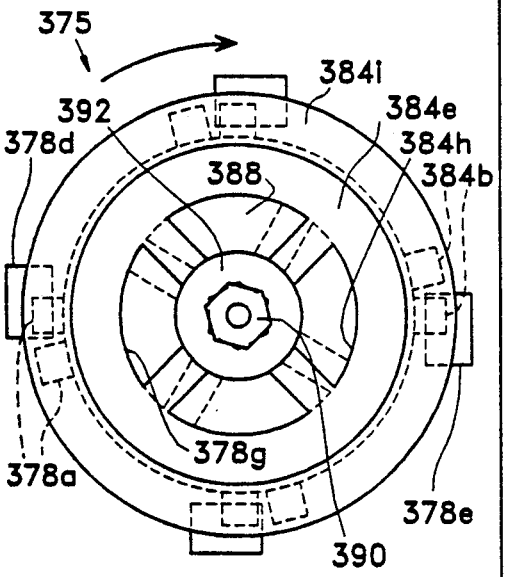
FIG. 20 is a top view of the cartridge valve of FIG. 19.

Yet another valve assembly 314 is shown in FIGS. 11 and 12. A port or valve seat 315 is coupled to a low pressure chamber L. An opposing port or valve seat 316 is coupled to a high pressure chamber H. Corresponding valve members 317 and 318 are attached to a cantilevered bimetallic arm 319 having a heat-responsive layer 320 and a non-heat responsive layer 321. Layer 321 biases the arm to close port 316. Layer 320 is heated by an electrical heating element 322, causing it to bend toward port 315. Arm 319 thus provides a single activator for concurrently opening one port while closing the other. Valve assembly 314 thus provides equivalent function to valve assembly 237 shown in FIG. 8.

FIGS. 13–16 illustrate yet another valve assembly 342 particularly useful in a patient support system as shown in FIG. 2. Assembly 342 includes a dual-acting cartridge valve 344 mounted in a housing 346 having a lower wall 347 and an upper wall 348. Lower wall 347 separates a high pressure chamber 350 from a low pressure chamber 352, and has an inlet port 353 defined in part by a circumferential ridge 354 that extends upward from the plane of the wall. Ridge 354 has an outer diameter $D_1$.

Wall 348 separates low pressure chamber 352 from a controlled-pressure chamber 356. This wall has an airflow port 357 formed by an upwardly extending ridge 358. Ridge 358 has an inner diameter $D_2$ greater than diameter $D_1$.

Cartridge valve 346 includes a base member 360, also referred to as a fluid-flow element or channel means, is generally tubularly shaped about a vertical axis 362, as viewed in the figure. It includes a lower end 360*a* having an inner diameter sized to frictionally receive ridge 354, and thereby provide means for attaching the base member to wall 347, and means for sealing cartridge valve 346 relative to inlet port 353. An inner passageway 364 extending through base member 360 has a reduced size at inwardly extending, and downwardly facing valve seat 360*d*. The exterior of the upward end of the base member is preferably cylindrical about axis 362.

An upper end 360*b* has arms 360*c* that extend across passageway 364 to provide lateral support for the member, and to serve as a base for a spring 366. The spring surrounds a shaft 368 that extends along axis 362 and is attached at its lower end to a tapered valve member 369 that is sealingly seatable on valve seat 360*d*. The lower end of spring 366 contacts the upper surface of valve member 369, as shown.

The upper end of shaft 368 is connected to an extension member 370, also tubular shaped, that fits around the upper end of the base member and is slidable relative to the base member along axis 362. A second spring 372 surrounds the upper end of shaft 368 and extends between extension member 370 and the top sides of arms 360*c*. Although not shown, spring 372 is preferably made of a temperature-responsive alloy for controlling movement of the extension member relative to the base member. Lower spring 366 is fabricated from normal spring material, and tends to keep the inlet open, thereby keeping the associated mattress cell inflated. This opens and closes the valve provided by valve seat 360*d* and valve member 369.

The top surface of ridge 358 is also a valve seat 374. Extension member 370 has a radially extending, circumferential flange 370*a* with a lower surface 370*b* that sealingly seats against valve seat 374. Flange 370*a* is thus also a valve member. The extension member upper end 370*d* has slits 370*e* that allow air flowing up through passageway 364 out into controlled-pressure chamber 356.

Figure 13:
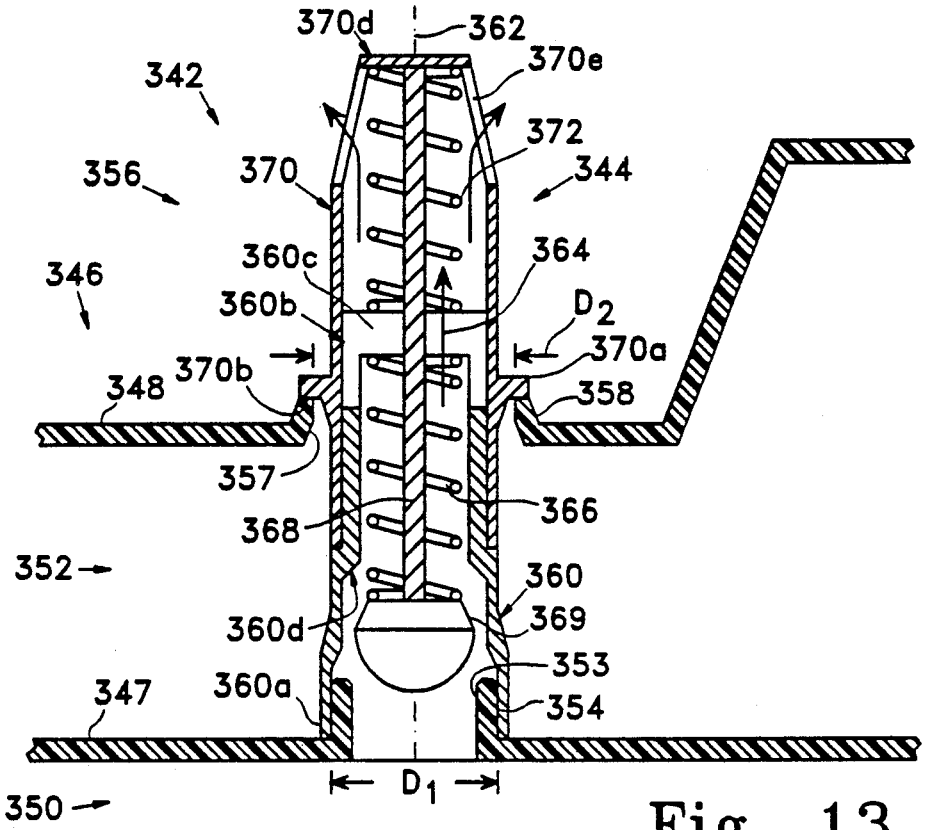
FIG. 13 is a cross-section showing a first cartridge valve, usable in the pneumatic system of FIG. 2, in a first operative position.

It is seen in looking at FIG. 13 that flange 370*a* is seated on valve seat 358, preventing travel of air between chamber 356 and chamber 352; and valve member 369 is spaced from valve seat 360*d*. Also, in this position, the bottom edge 370*c* of the extension member is seated against an outward extending protrusion or shoulder 360*e* of the base member. The shoulder thus serves as a stop or means to limit the sliding of the extension member relative to the base member. As will also be seen, the cartridge valve 344 is manually installed in the position shown by applying pressure on the extension member toward the base member. Shoulder 360*e* directly transfers the applied force from the extension member to the base member, without distorting the springs from their normal operating range.

Figure 14:
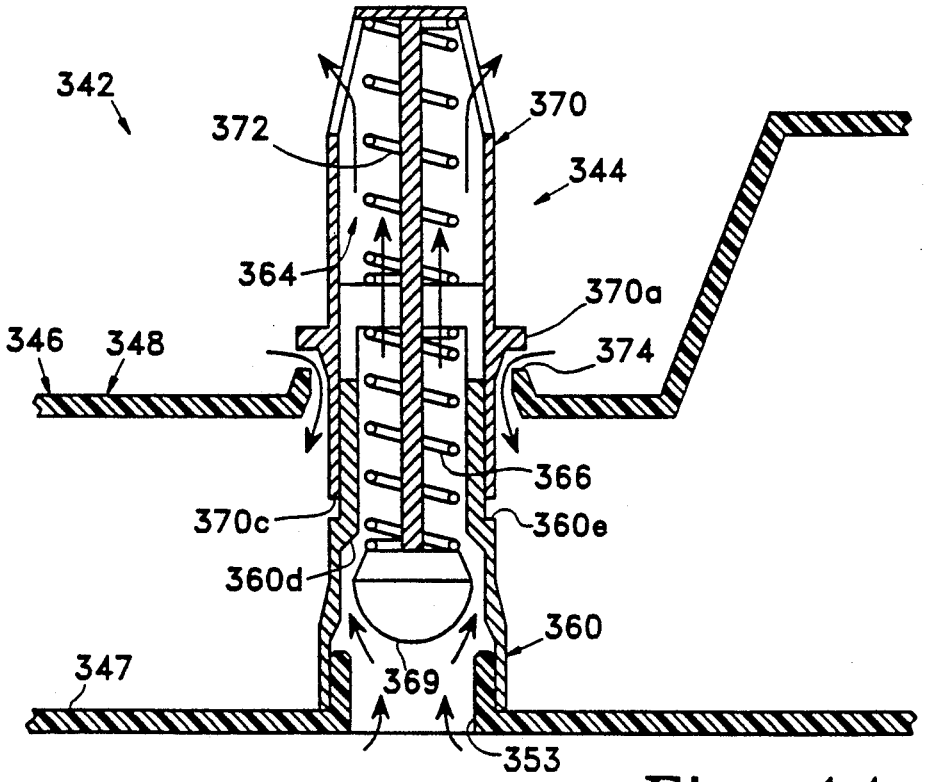
FIG. 14 is a view similar to FIG. 13 showing the first cartridge valve in a second, intermediate position.

In FIG. 14 the cartridge valve is shown with the extension member in an intermediate position in which neither of valve seats 360*d* and 370*b* are closed. Air is thereby allowed to flow from high-pressure chamber 350 through passageway 364, into controlled-pressure chamber 356, and out into low-pressure chamber 352, as shown by the flow arrows.

Figure 15:
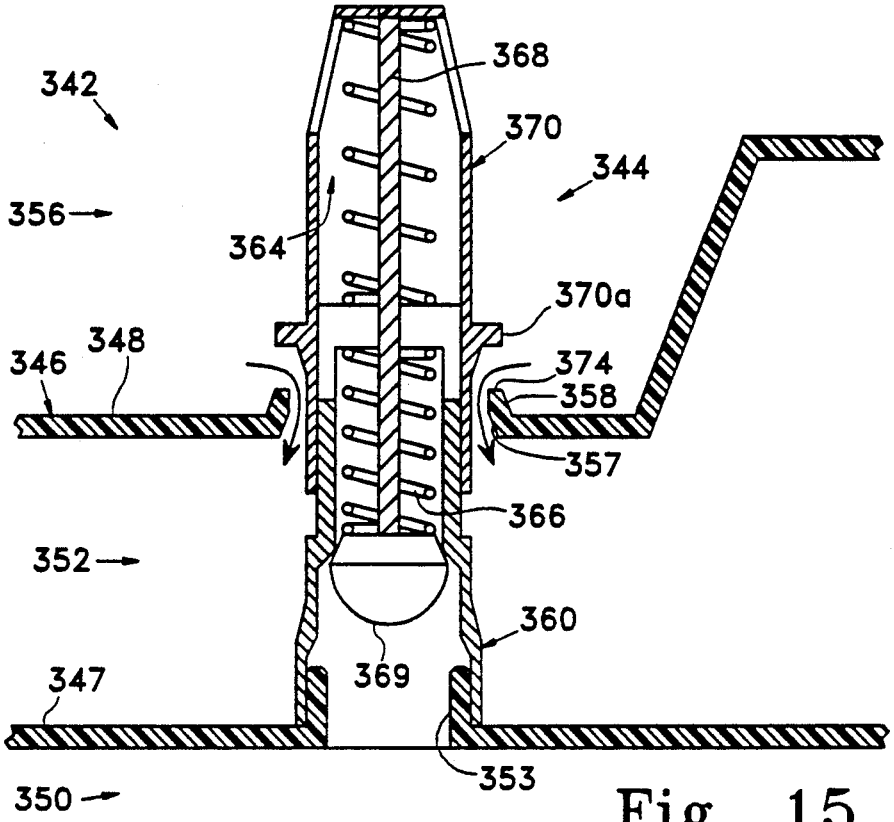
FIG. 15 is a view similar to FIG. 13 showing the first cartridge valve in a third operative position.

FIG. 15 shows cartridge valve 344 in a terminal position in which extension member 370 is in a fully raised position relative to the base member. Travel of the extension member upwardly is stopped by the seating of valve member 369 against valve seat 360*d*. Air flow port 357 is open. The mattress cell associated with valve assembly 342 is thereby deflated, being allowed to have the same internal pressure as the low-pressure chamber.

Cartridge valve 344 thus provides full control of the pressure in chamber 356 by selective or combined communication with the pressure chambers 350 and 352. It is a flow-force-balanced, open-center, dual-poppet, throttle valve. The inlet and outlet ports are controlled simultaneously and are inversely configured. As the input port is opened, the outlet port is closed, and visa versa.

The flow forces on the valve are balanced. An increase in flow through the inlet tends to close the inlet, and therefore open the outlet. At the same time, an increase in the flow through the outlet tends to close the outlet, and therefore open the inlet. Since the same flow passes through both inlet and outlet, changes in flow have little effect on the net forces on the springs. With the forces netting to zero, the drive or control force is minimized.

Figure 16:
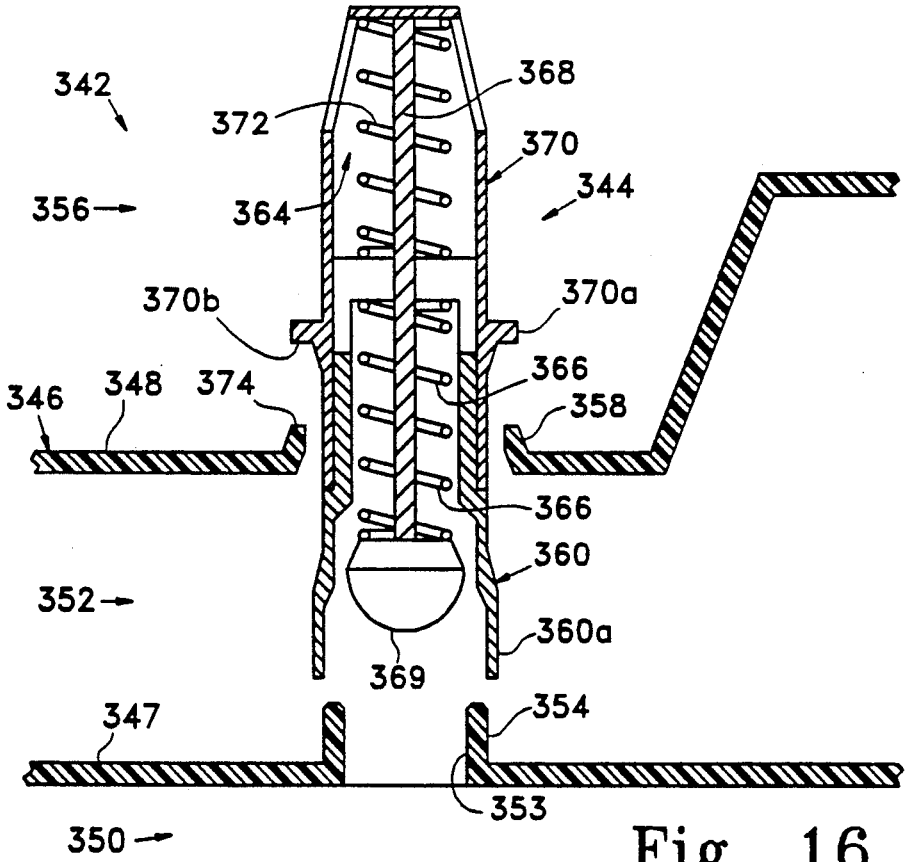
FIG. 16 is a view similar to FIG. 13 showing the first cartridge valve being installed.

As has been mentioned, cartridge valve 244 is manually installable and removable in housing 346. FIG. 16 further illustrates the position of the cartridge valve during installation or removal. The base member is positioned into port 357 until the lower end 360*a* seats on ridge 354, after which pressure is applied until the position shown in FIG. 14 is reached. Upon removal, pressure is applied upwardly on the extension member until the position shown in FIG. 15 is reached. During removal, the force applied to the extension member is mechanically transferred to the base member via shaft 368 and valve member 369.

An alternative cartridge valve assembly 374 is shown in FIGS. 17, 18, 19 and 20. Assembly 374 includes a dual-acting cartridge valve 375 mounted in a housing 376 having an upper wall 377 adjacent to the top surface of a bed section, an intermediate wall 378, and a lower wall, not shown. A low pressure chamber 379 exists between the upper and intermediate walls. A high pressure chamber is below the intermediate wall. An insert connector 228 connects a mattress cell, such as a cell 222 to valve 375 via a pressure-controlled chamber 381. Wall 377 has an opening 377*a* coupling chambers 381 and 379. Wall 378 has a raised section 378*a* with an inward flange 378*b* with an internal opening 378*c* coupling chambers 379 and 380. Four raised tabs, such as tabs 378*d* and 378*e*, are spaced around raised section 378*a*.

Figure 17:
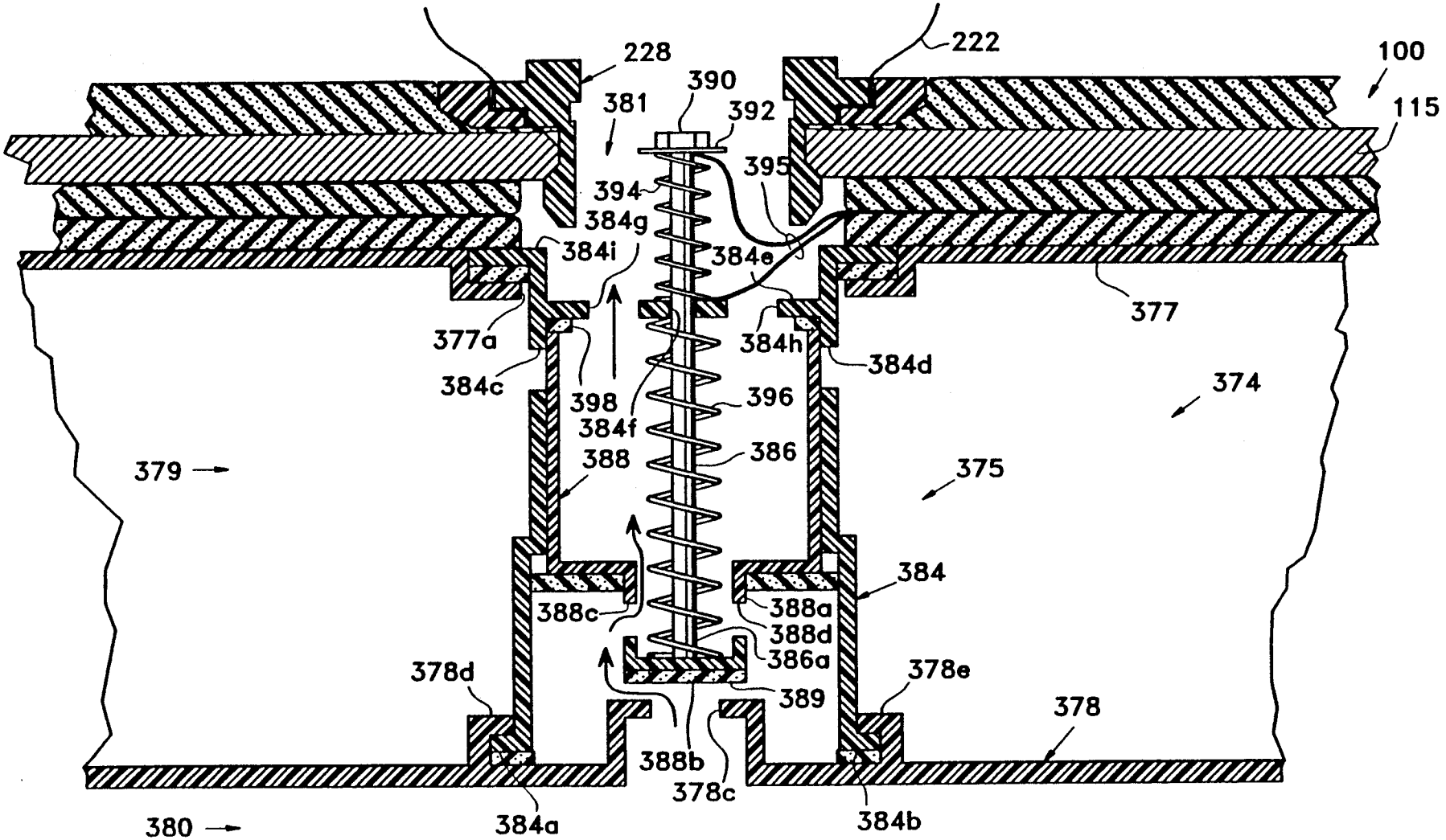
FIGS. 17 and 18 are views similar to FIG. 8 of a second cartridge valve assembly in two operating positions.

Cartridge valve 375 includes an outer sleeve 384 having radially extending feet, such as feet 384*a* and 384*b* at the lower edge, corresponding to tabs 378*d* and 378*e*. Sleeve 384 is routed during installation on wall 378 so that the feet are frictionally secured under the tabs, as is shown in FIG. 17 and illustrated in FIG. 20.

A set of four exhaust ports, such as ports 384*c* and 384*d* are disposed at spaced locations around the upper periphery of the walls of sleeve 384. A recessed top 384*e* has a central bore 384*f* sized for receipt of a shaft 386. Disposed radially outwardly from bore 384*f* are a plurality of vents, such as vents 384g and 384h. A radially-extending, raised mounting flange 384i is sealingly seated on wall 377.

Figure 18:
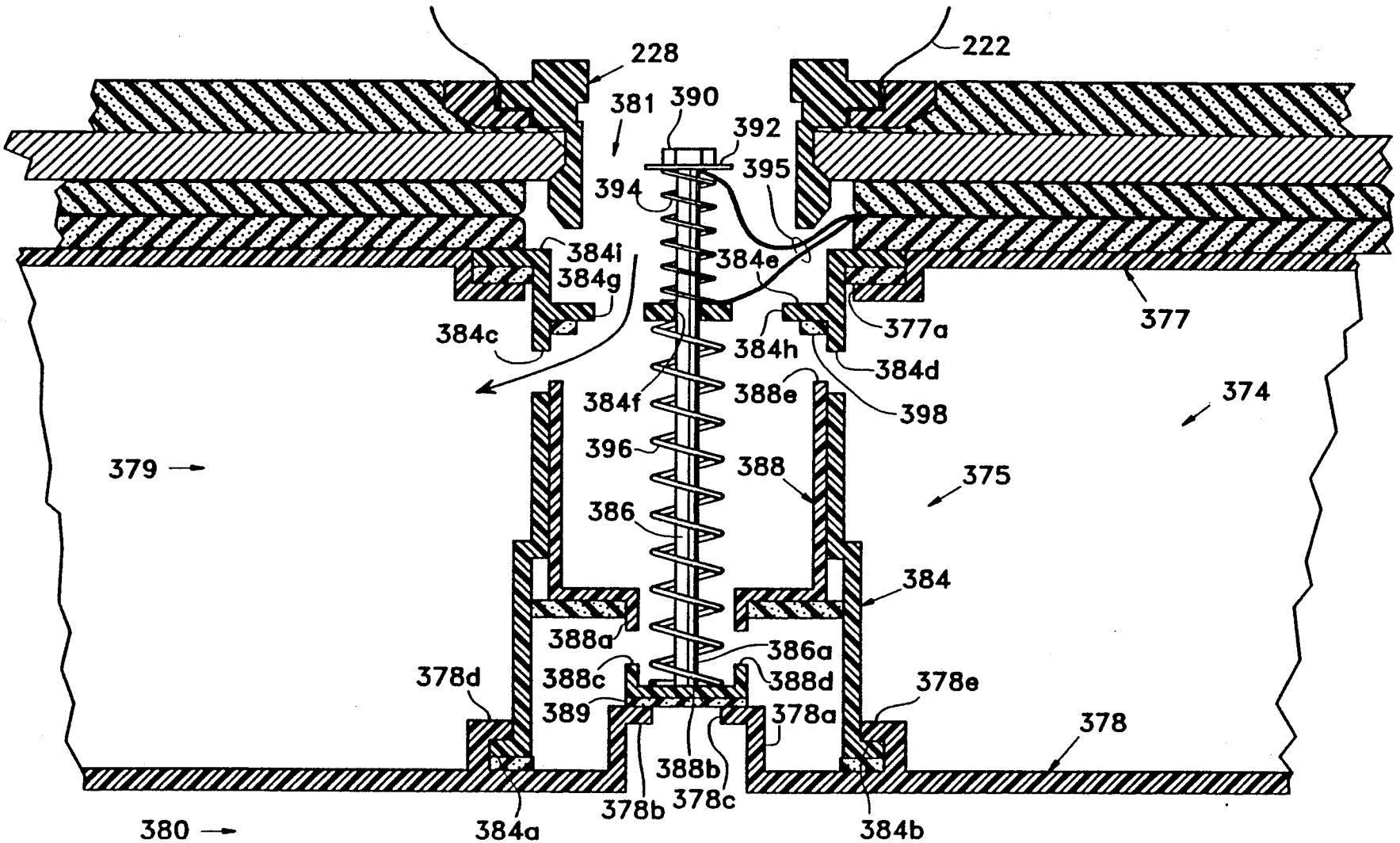

A generally cylindrical insert 388 is sized for sliding inside sleeve 384. Insert 388 is open at the top and has a well portion 388a extending downward from the bottom. Well portion 388a has a closed bottom 388b covered with a resilient pad 389, sized to close opening 378c when seated on flange 378b, as is shown in FIG. 18. There are a plurality of lateral openings, such as openings 388c and 388d, in well portion 388a. The upper edge 388e of insert 388 is low enough to leave exhaust ports 384c and 384d uncovered when pad 389 is seated on flange 378b.

Shaft 386 has a lower end 386a attached to bottom 388b. The shaft extends slidingly through bore 384f to a top end 386b threaded to receive a bolt 390 anchoring a washer 392. A heat-sensitive spring 394 is disposed between washer 392 and sleeve top 384e. Spring 394 is heated by electricity from wires 395. A standard compression spring 396 is disposed between sleeve top 384e and insert bottom 388b. Spring 394 urges insert 388 to the lower or exhaust position shown in FIG. 18 in which the high pressure opening 378c is closed and exhaust ports 384c and 384d are open.

When spring 394 is heated, it expands, raising insert 388 and opening inlet opening 378c. In the fully raised position, as is shown in FIG. 17, top edge 388e extends above exhaust ports 384c and 384d, closing them. This top edge preferable seats against a resilient O-ring 395 positioned inside sleeve 384 against top 384e. In this raised position, the pressure in the pressure chamber is increased, since the exhaust ports are closed and communication is provided with high pressure chamber 380.

Figure 21:
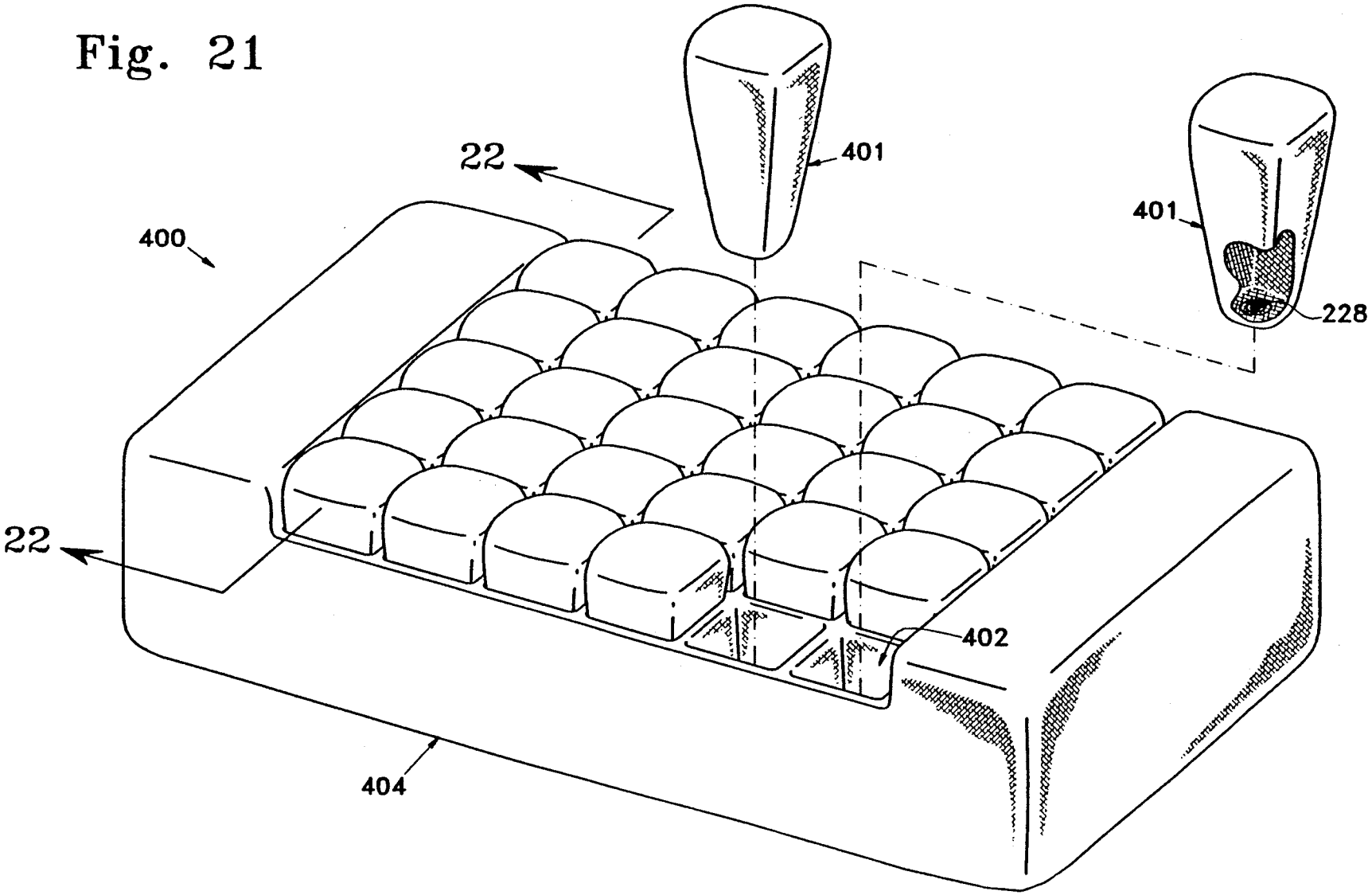
FIG. 21 is an isometric view of a portion of a second embodiment of a mattress made according to the invention.
Figure 22:
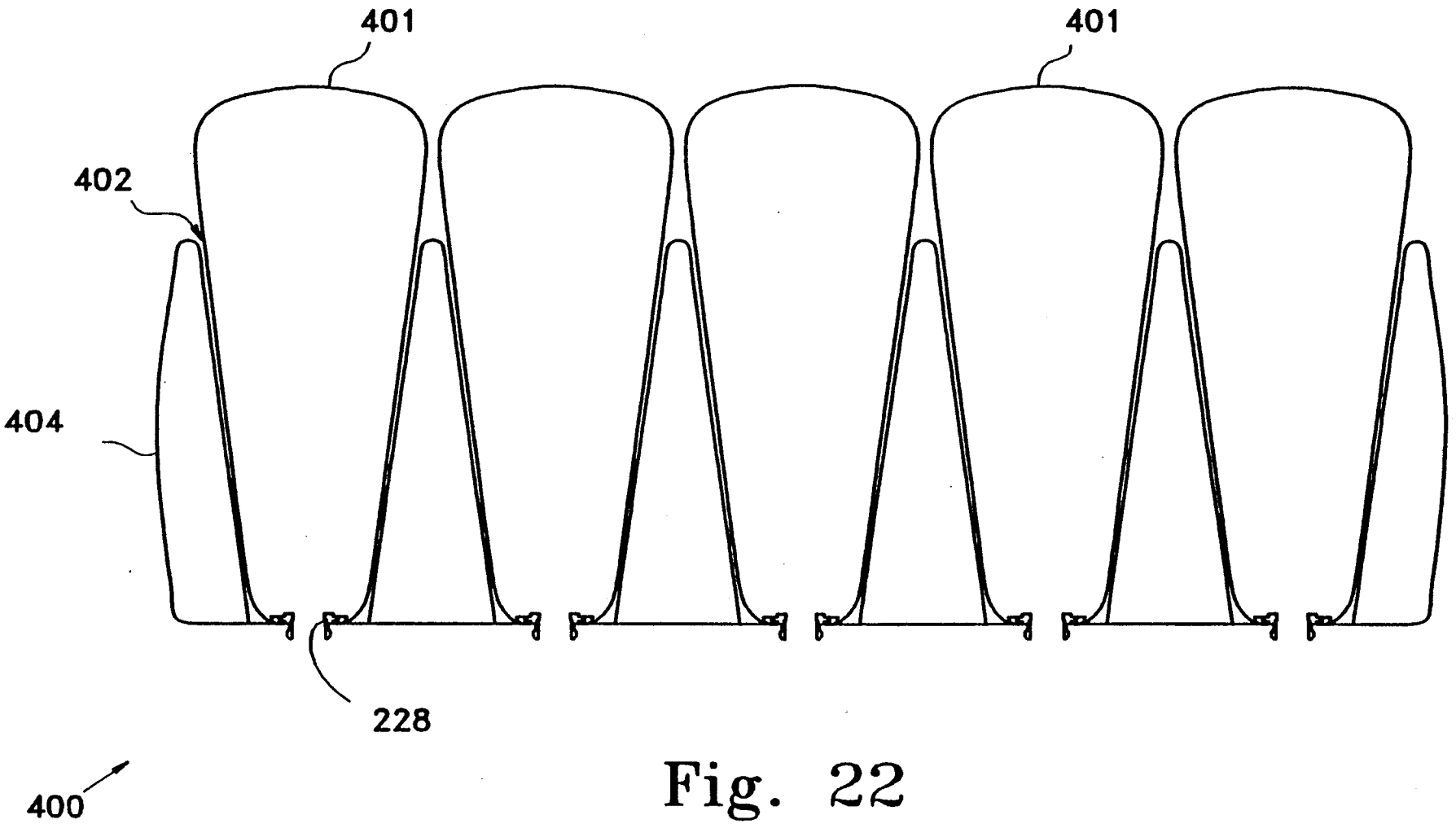
FIG. 22 is a simplified cross-sectional view showing the structure of the mattress of FIG. 21.

An alternative mattress structure is shown in FIGS. 21 and 22. FIG. 21 shows a mattress section 400 as is mounted on a single platform link or panel, such as one of panels 108–111. Such a section may be mounted on each of the four panels to form a bed having a uniform mattress. Clearly, the mattress sections can be varied to achieve a combination of capabilities.

Mattress section 400 includes 30 individual cells 401 that may be individually controllable, as is described in the previously referenced U.S. Pat. No. 5,023,967. Each cell has an insert connector 228, as was described with reference to FIG. 2, for connection to a coupling port of the top plate of a platform panel. The cells have a four-sided, inverted frustum-pyramidal shape, as shown, and are matingly received in correspondingly shaped cups, shown generally at 402.

Cups 402 are formed in a base mattress cell 404 that is maintained at a constant, fully inflated pressure. Alternatively, cell 404 could be formed of a semi-rigid material that has similar pliability and strength as an inflated cell. Thus, when an individual cell 401 is deflated, the surrounding cells are prevented from flexing into the now "empty" cup by the strength of the adjoining cup walls.

Figure 23:
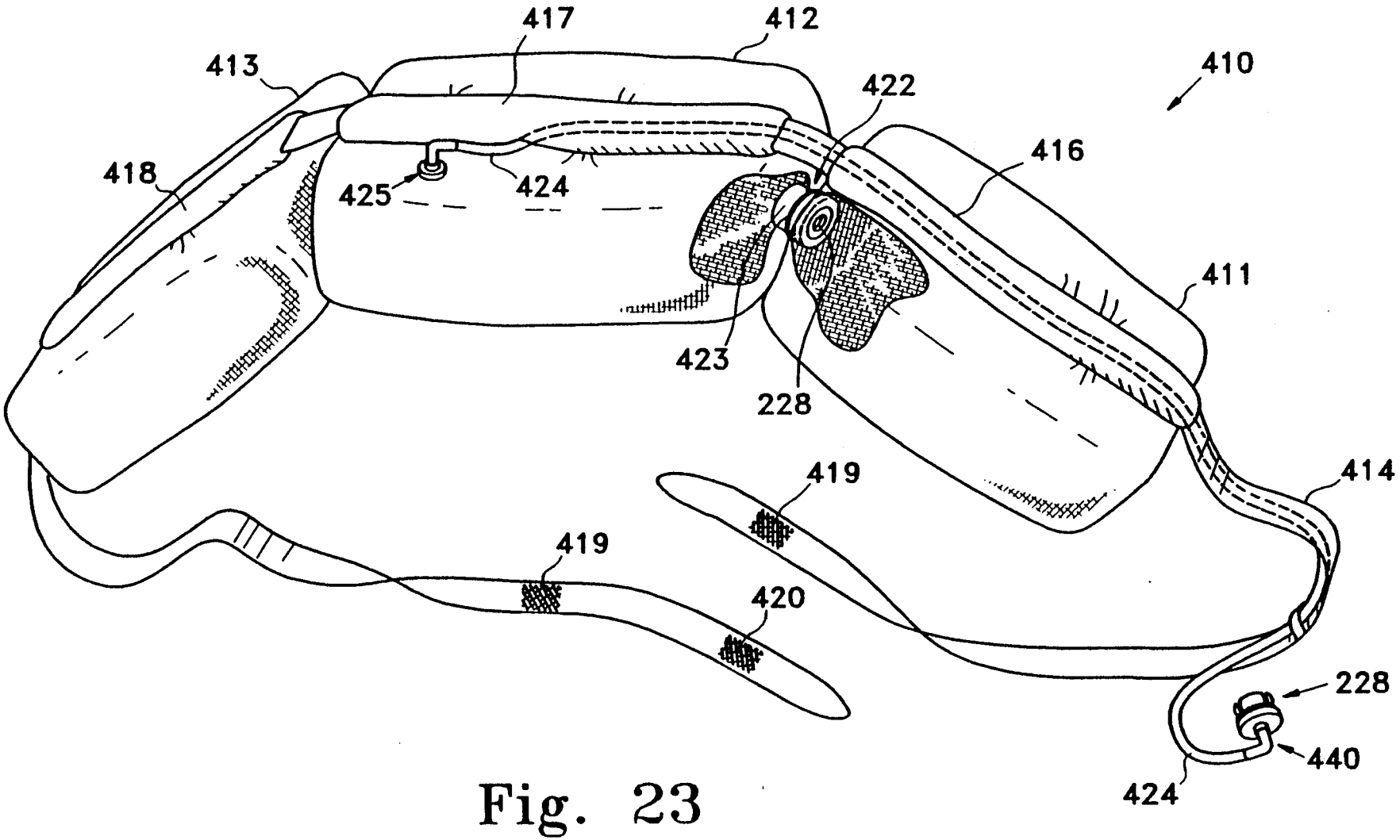
Figure 24:
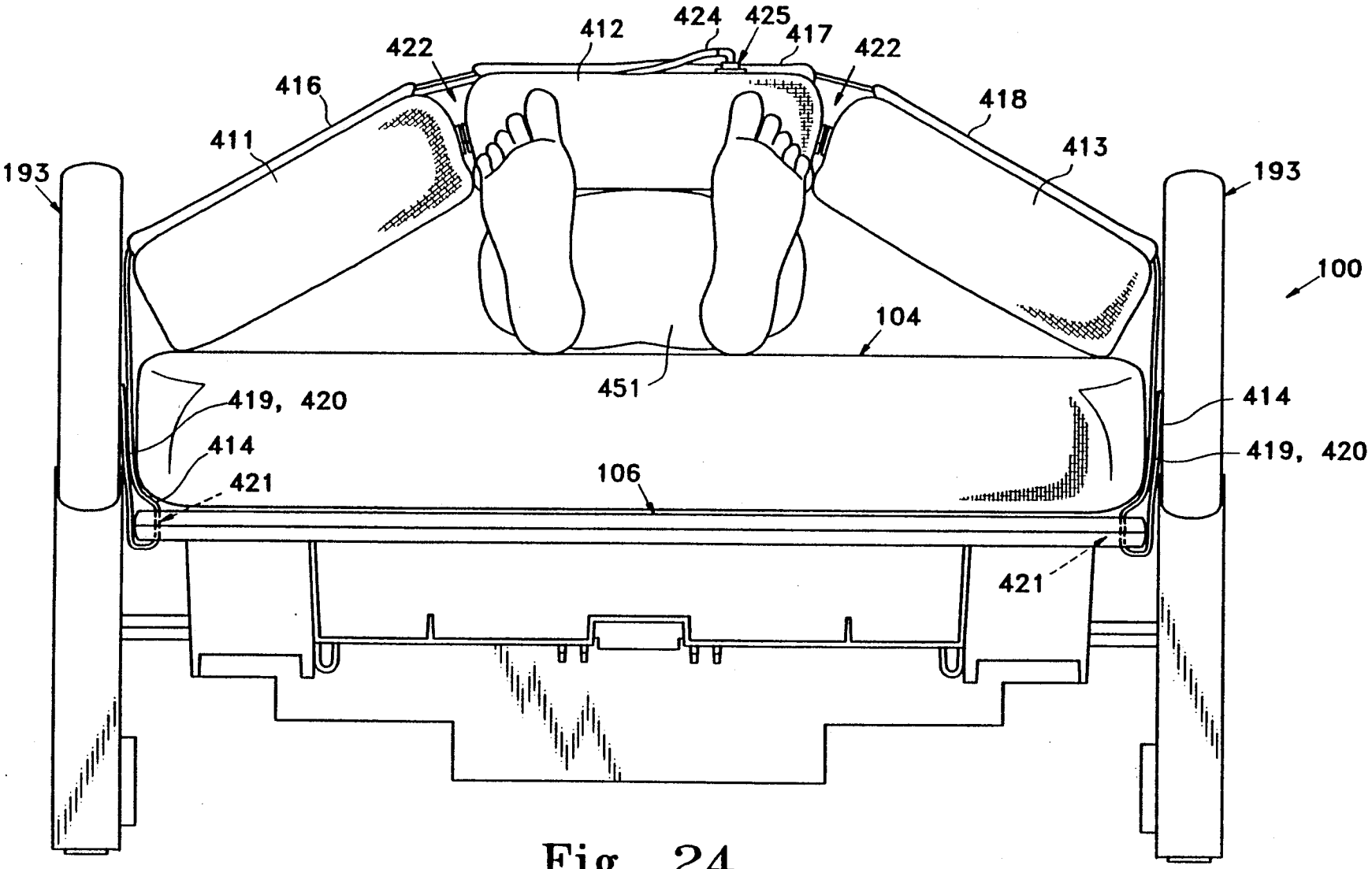
FIG. 24 is an end view of a bed showing the restraining cushion system of FIG. 23 in use.

The present invention also includes a cushion system for restraining the movement of a person on a bed. These cushions are shown in FIGS. 23–29. In particular, FIGS. 23 and 24 illustrate a restraining belt system 410 including three inflatable cushions 411, 412 and 413. These cushions are supported serially by a belt 414 that is held on a common, upper face of the cushions by respective sleeves 416, 417 and 418. Belt 414 is preferably slidable in the respective sleeves relative to the cushions. At each end of belt 414 are hook and loop fabric pieces 419 and 420 for securing the belt through a slot 421 in the platform panel edge, as is shown in FIG. 24. FIG. 24 shows an end view of the restraining belt system 410 fastened to a bed panel 109.

Figure 28:
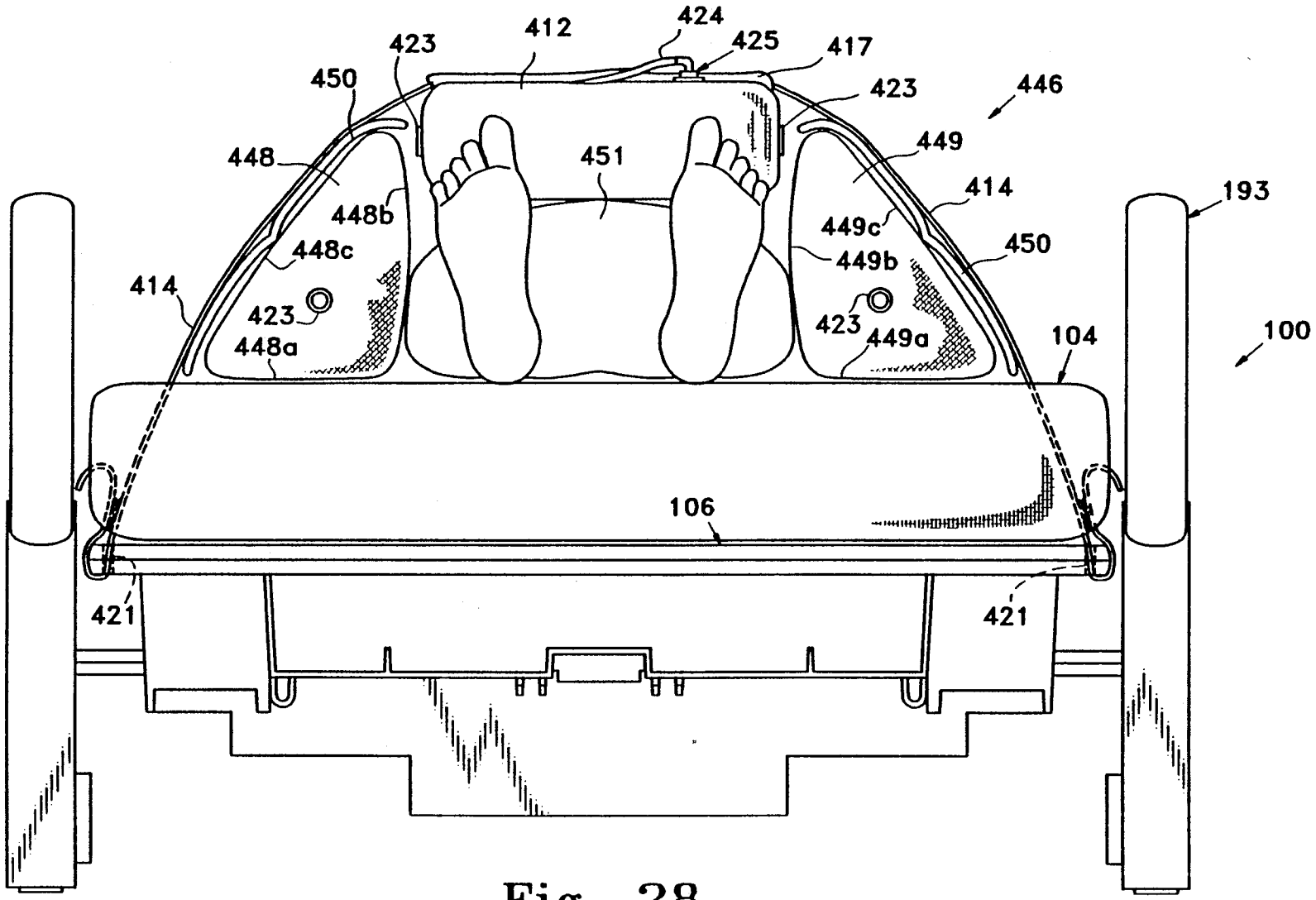
FIG. 28 is an end view of a bed showing the use of an alternative restraining belt system.

Cushions 411 and 413 are each connected to cushion 412 by a connector assembly 422, including an insert coupling member or connector 228 and a connector coupling member or receptacle 423, described in further detail with reference to FIGS. 25 and 26. Cushions 411 and 413 are thereby inflated directly from cushion 412. Receptacle 423 also functions as a check valve, so that when the end cushions 411 and 413 are disconnected, cushion 412 stays inflated, as is shown in FIG. 28.

Cushion 412 is inflated via a tube 424 that extends through sleeves 417 and 418, and along belt 414 to an insert connector 228 with a tube reducer 440 for attachment to the tube. The tube is connected to cushion 412 by a tube connector assembly 425. The tube end insert connector 228 is connected to a connector receptacle 423 mounted in a base mattress cell 222', as is shown in FIG. 1 and in FIG. 27.

FIG. 25 illustrates a connector assembly 422 formed of an insert connector 228 and a connector receptacle 423, such as is used between cushions 411 and 412 or between cushions 412 and 413. Connector receptacle 423 includes an outer member 427 having a general U-shape with walls 427a forming an inner cavity and having an open end 428 and an inward-directed lip or flange 427b defining a reduced opening 429. Around opening 429 is a recess 427c. Just inside walls 427a from open end 428 is a slight groove 427d sized to receive a corresponding ridge 430a of a seal member 430. Positioned inside outer member 427 in a disk chamber or cavity between flange 427b and a shoulder 430b of seal member 430 is a disk 431 that is freely movable therebetween. When pressed against shoulder 430b, such as when the insert connector is removed, a seal is formed, maintaining the pressure in a cell or cushion the connector receptacle is mounted in. When an insert connector 228 is inserted into an opening 432 extending through seal member 430, as is shown in the figure, the disk is held away from shoulder 430b, allowing air to flow around it.

Insert connector 228 includes a ring 434 having an inner diameter $D_3$ and inward-directed flange 434a defining a reduced diameter $D_4$. An insert member 436 defines a passageway 437. At one end is an outward-directed flange 436a having a shoulder 436b. Flange 436a is received by friction fit in the recess formed by flange 434a of ring 434. Extending away from flange 436a are a plurality of fingers 436c having longitudinally extending slits 438. These slits allow the fingers to flex inwardly during insertion and removal from a connector receptacle, and allow for the passage of air around disk 431 when received in a connector receptacle. Adjacent to the end 436d associated with flange 436a is an inner groove 436e. The diameters of groove 436e and recess 427c are the same.

FIG. 26 shows a tube connector assembly 425 for connection to a tube 424, as shown in FIG. 23. Assembly 425 includes disk-like reducer 440 having an outer diameter sized to be received with a friction fit in a recess 427c or a groove 436e, as is shown in phantom lines in FIG. 25, or in a reducer mounting ring 443, as is shown in FIG. 26. An inner opening 441 is defined by walls 440a threaded to receive a tube adaptor 442 that is connectable to a tube, such as tube 424.

Figure 27:
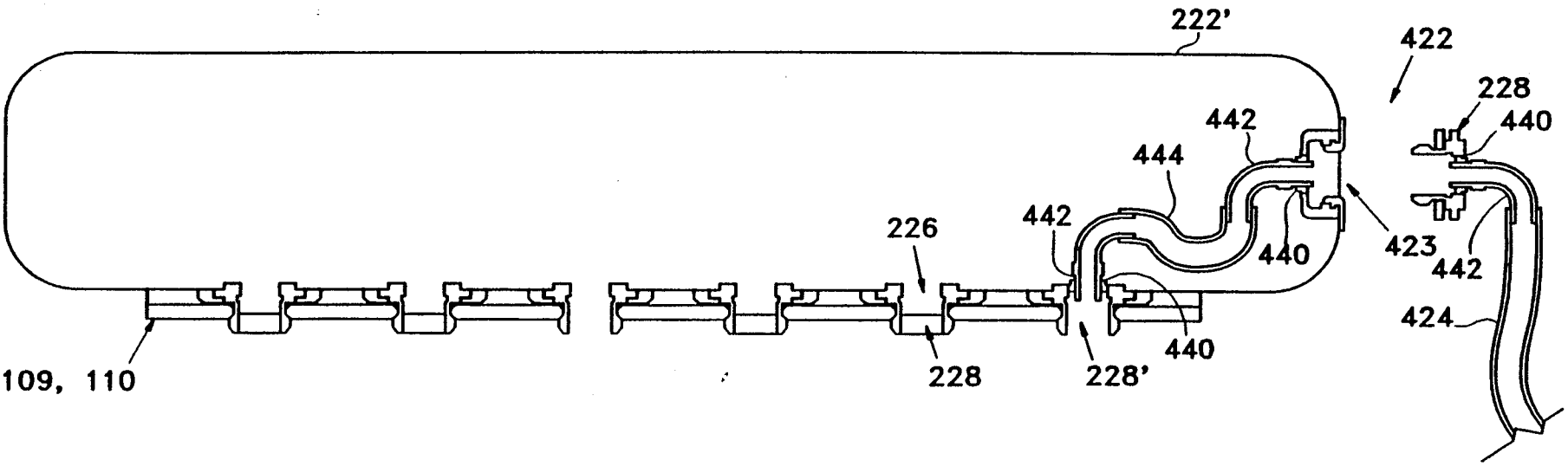
FIG. 27 is a cross-section of a cell modified to provide communication of the air supply with a secondary cell.

FIG. 27 shows a cross section of a cell 222' cut away to show the internal structure. Cell 222' is inflated through an inlet port 226 defined by an insert connector 228 connected to a coupling port of the top plate of a panel, as has been described with reference to FIG. 2. However, cell 222' also has a second insert connector 228' to which is attached a reducer assembly 426. Assembly 426 is connected to a conduit or tube 444, the other end of which is connected to a second reducer assembly 426 mounted on a connector receptacle 423, also referred to as an outlet coupling member, mounted on the end of cell 222', as shown. Tube 444 thus is means for joining insert connector 228' to receptacle 423 in the end of cell 222'. The insert connector shown on the end of tube 424 in FIG. 27 is insertable in receptacle 423 to provide inflation of the restraining cushions shown in FIGS. 23 and 24.

Figure 29:
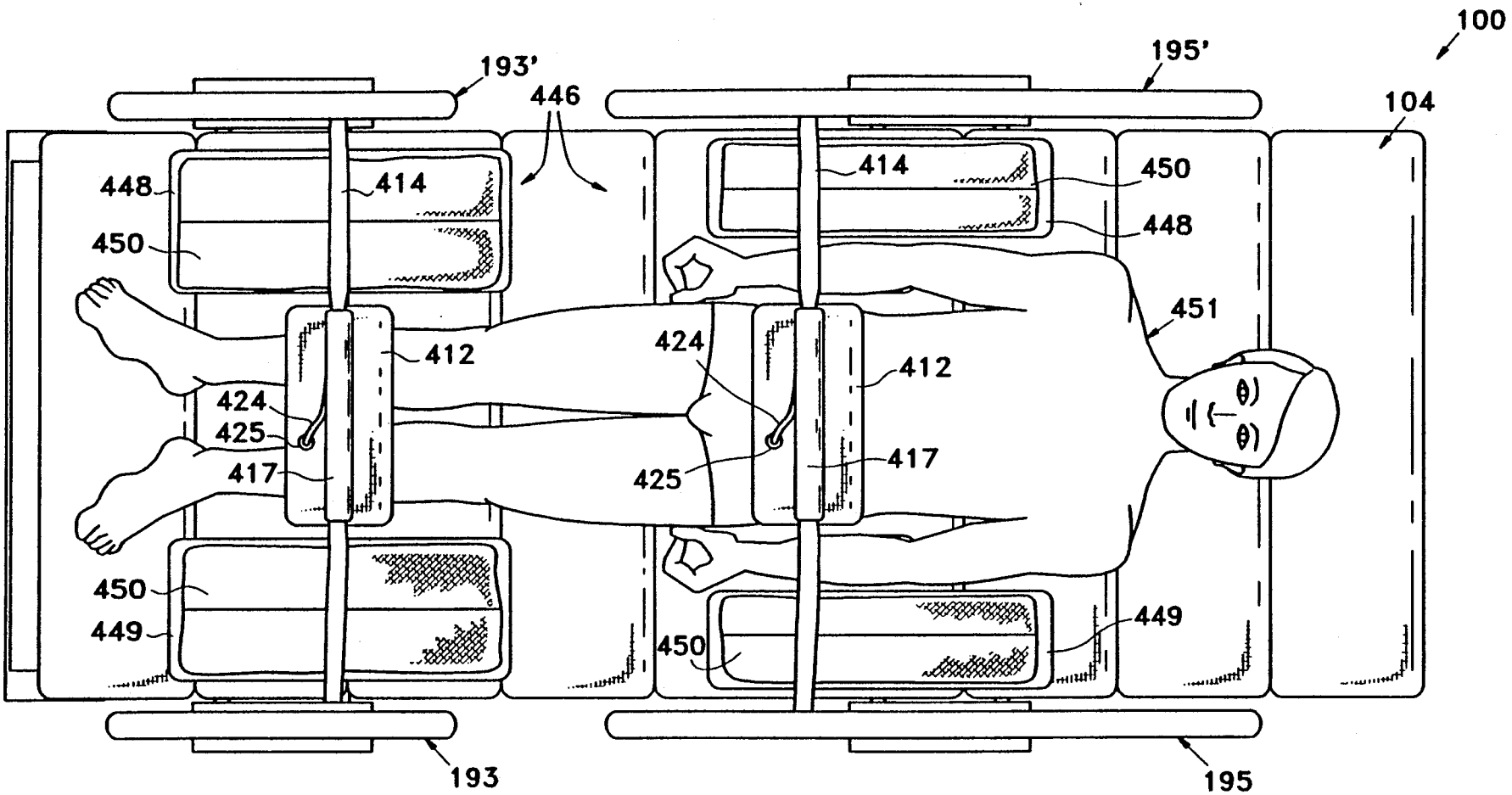
FIG. 29 is a top view of the bed of FIG. 28.

FIGS. 28, and 29 illustrate an alternative restraining system 446 that includes all the parts of belt system 410 except the outer cushions 411 and 413. As a result, for clarity of illustration, those parts that are common to belt system 410 have the same reference numbers. Replacing the outer cushions are extended side cushions 448 and 449. As particularly shown in FIG. 28, these side cushions have a right-triangle cross section, preferably in the ratio 3-4-5. In the preferred embodiment short sides 448*a* and 449*a* have lengths of 6 inches, long sides 448*b* and 449*b* have lengths of 8 inches, and hypotenuses 448*c* and 449*c* have lengths of 10 inches. A protective stretch or web of a fabric tether 450 is generally coextensive with the hypotenuse and is attached along the length of the hypotenuse, as shown.

Each side cushion is inflated via a connector receptacle 423 that functions as a check valve to prevent leaking after inflation. Alternatively, the side cushions can be left connected to an inflating tube all the time.

As shown in FIG. 29, when restraining belt system 446 is used to contain the legs of a patient 451, long sides 448*b* and 449*b* are placed against the top surface of the mattress. However, when the belt system is used to restrain the torso, since the torso is wider on the bed and extends higher above the bed than the legs, the short sides 448*a* and 449*a* are placed on the mattress surface, thereby accommodating the variations in the patient's body structure without using different cushions.

FIGS. 30–35 illustrate the structure and operation of a pneumatic release valve 472 mounted on e head end of panel 108, as shown in FIG. 2. Valve 472 includes a housing 474 with an elongate box section 474*a* that has an inner chamber 475 that couples an exhaust inlet port 474*b* to an exhaust outlet port 474*c*. Housing 474 is pivotally coupled to panel 108 by rings 474*d* and 474*e* mounted on the top surface and supported on a pivot rod 476. From each end of box section 474*a* extends a handle 474*f* providing for manual manipulation of the valve.

Figure 30:
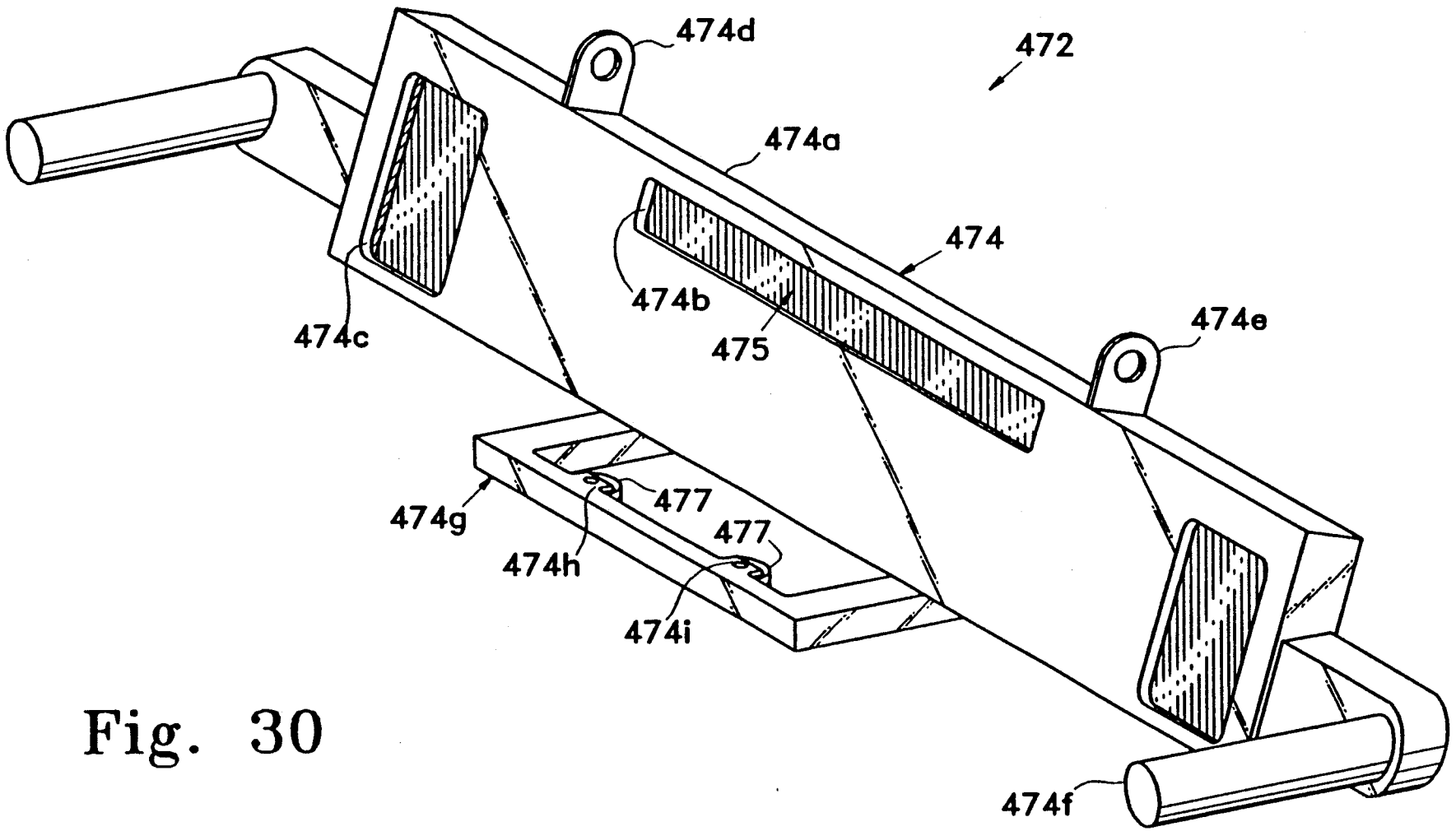
FIG. 30 is an isometric view of a pneumatic release valve made according to the invention.

As particularly shown in FIG. 30, extending under outer tray 210 of panel 108 is a U-shaped frame 474*g* having tapered nipples 474*h* and 474*i*. Mounted on each of these nipples is a roller 477 for engaging a recess 478*a* of a boss 478 extending down from the bottom of tray 210. The recess functions as a detent to hold housing 474 in the operative position. When housing 474 is slid sideways along rod 476, the rollers move out of the recess and past the edges of bosses 478, thereby freeing the valve housing to pivot outwardly away from the face of the tray.

Figure 31:
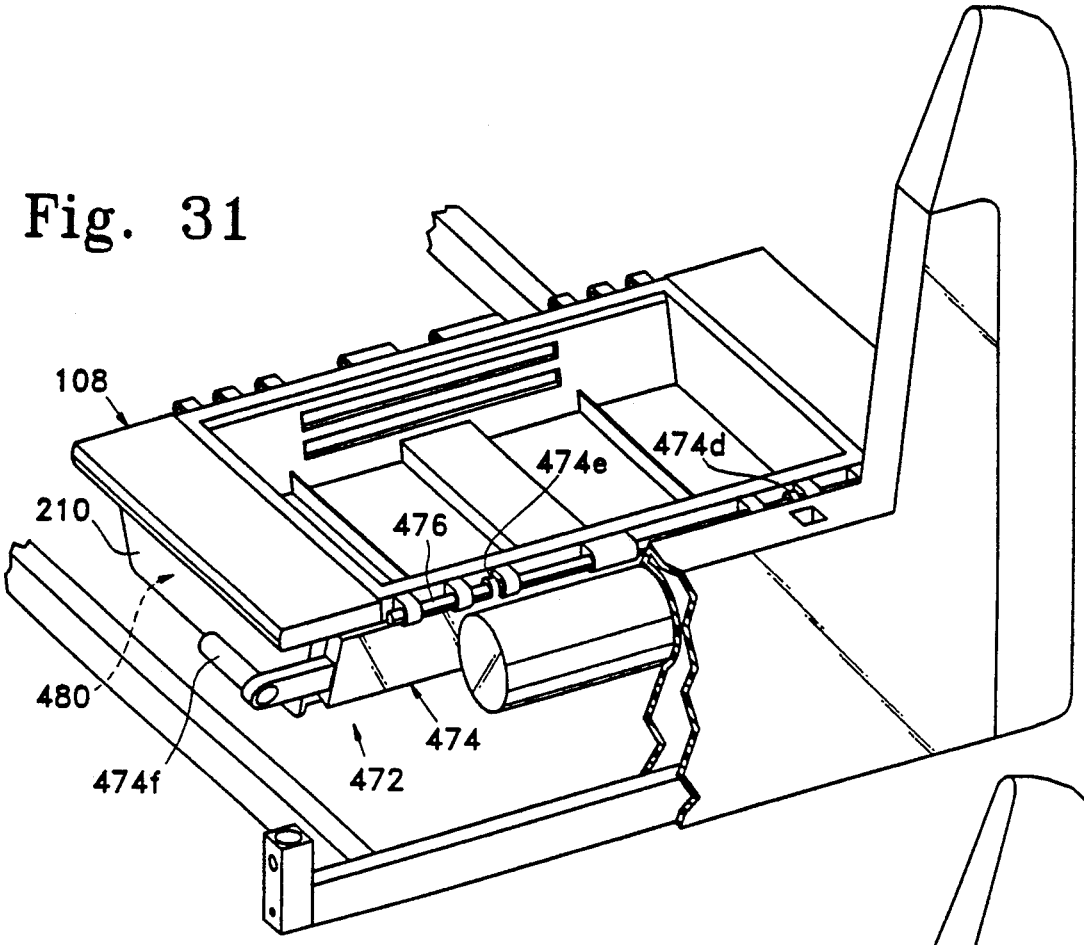
FIGS. 31 and 32 are partial fragmented, cut-away isometric views of a bed end made according to the invention showing two operating positions of the release valve of FIG. 30.
Figure 32:
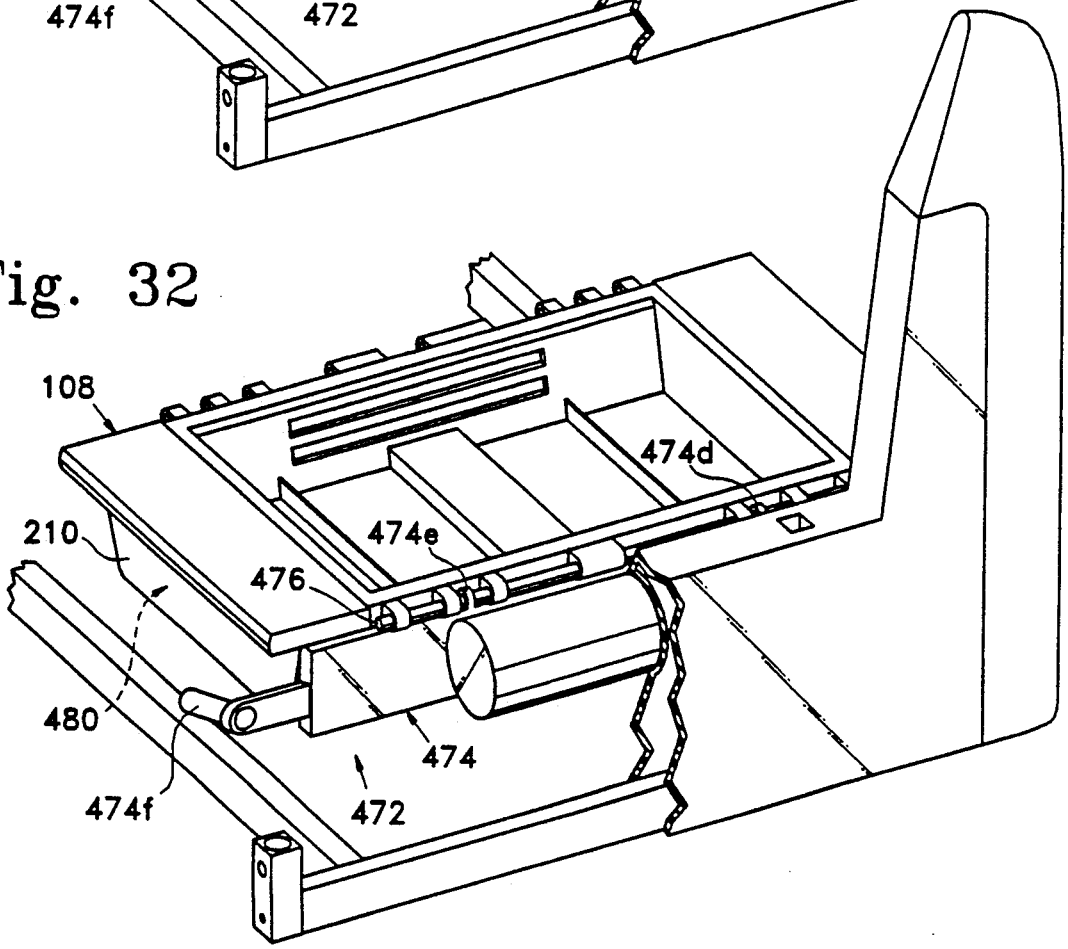
Figure 33:
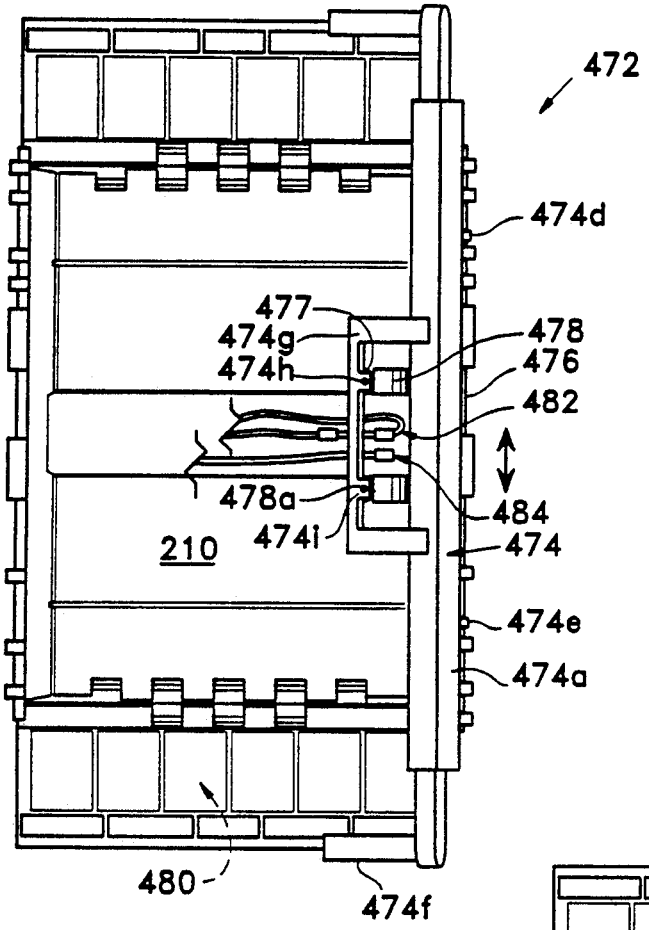
FIGS. 33 and 34 are plan views of a portion of the underside of the bed end of FIGS. 31 and 32 showing further structure of the release valve of FIG. 30.
Figure 34:
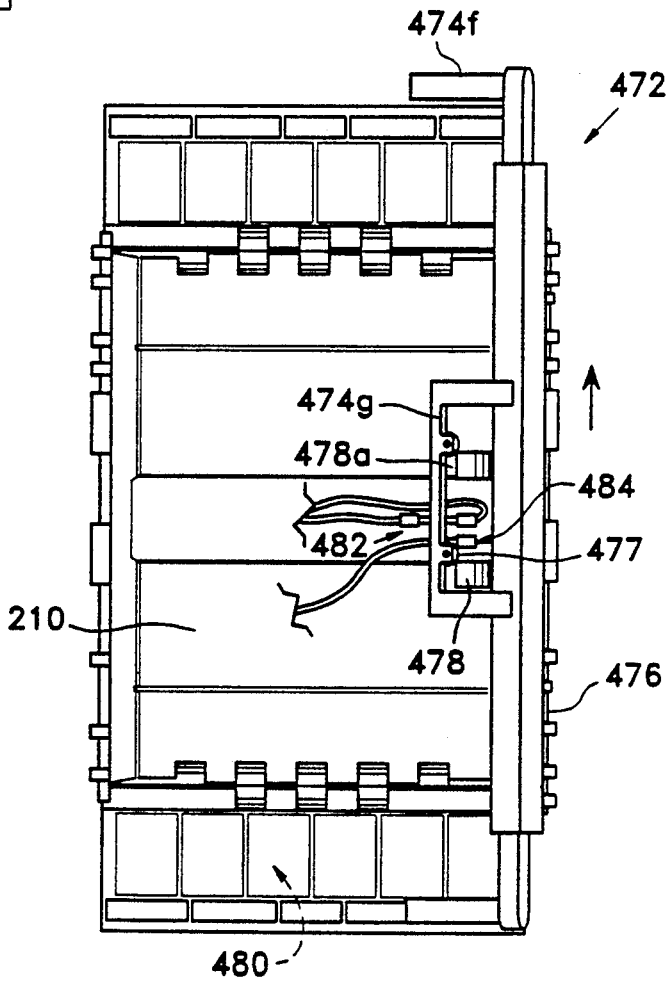
Figure 35:
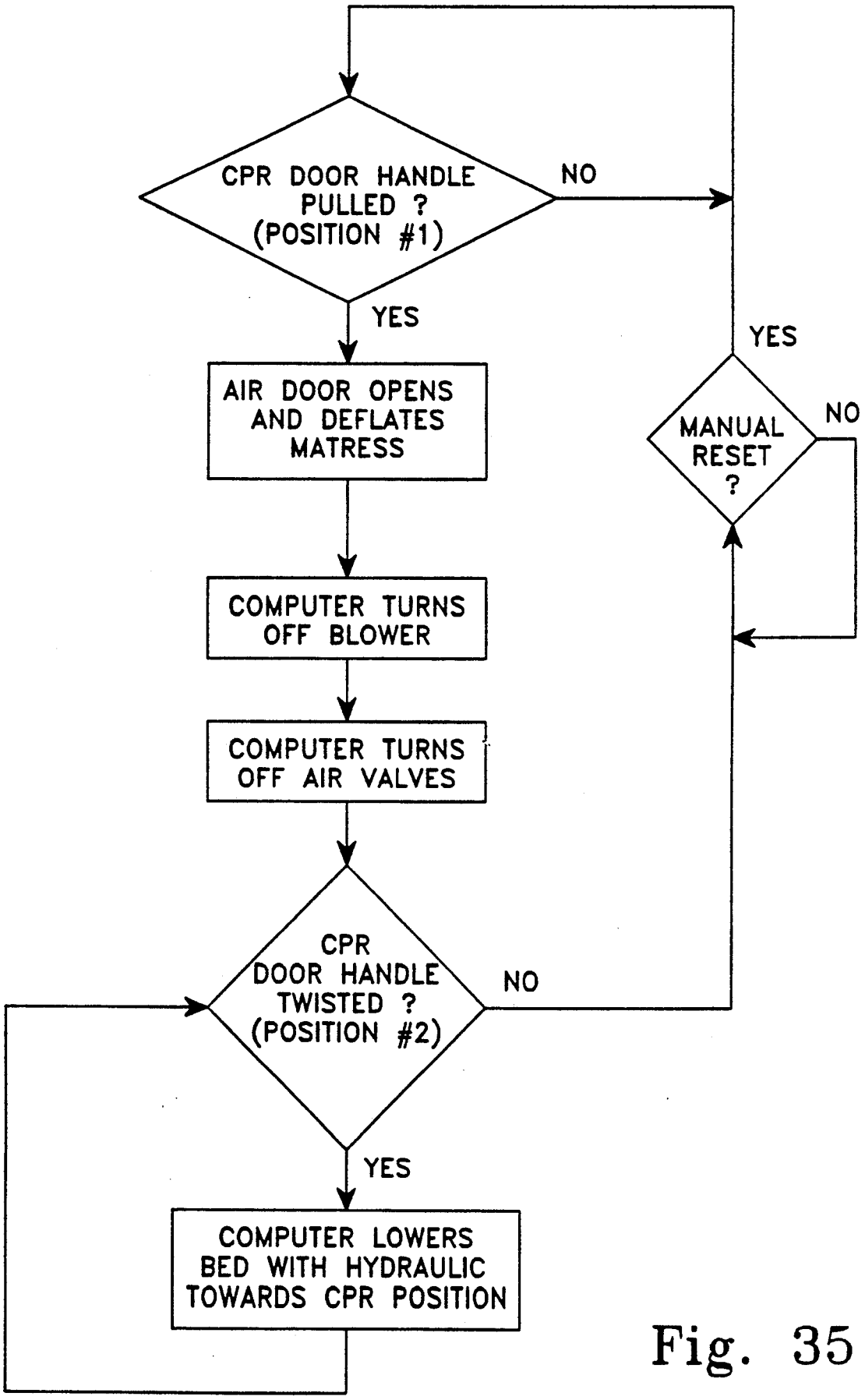
FIG. 35 is a flow chart of the basic operation of the release valve of FIG. 30.

When in the engaged or operative position shown in FIG. 31, the housing seals the high pressure chamber in the bottom of tray 210 and transmits the exhaust air from outlet port 216*b* through inner chamber 475 and through the sides of tray 210 in an open chamber 480 existing between the outer tray and the inner tray assembly, to be disbursed out holes not shown in the opposite side of the outer tray. When in the release position shown in FIG. 32, outlet ports 216*b* and 214*b* are both open to the atmosphere, thereby dumping all air from the blower and mattress cells.

When housing 474 is moved to the side to disengage rollers 477 from the respective boss 478, a switch 482 is activated. As shown in the flow chart of FIG. 35, this switch is connected to the bed processor for turning the blower off and opening all the valves. This completely collapses the mattress, providing a firm surface for the patient on the platform top plate. The handle 474*f* may then be further pulled open against a hydraulic switch 484 that lowers the bed to a flat position so long as pressure is applied to it. When pressure is released, the housing returns to the free-hanging open position and no further hydraulic operation takes place.

2. Footboard Gate

FIGS. 36–51 illustrate a footboard assembly 146 generally described previously with regard to FIG. 1. As mentioned assembly 146 includes a table assembly 172 mounted on each frame 170. A footboard panel 178 is mounted on each frame, and supports a storable table 174.

Figure 36:
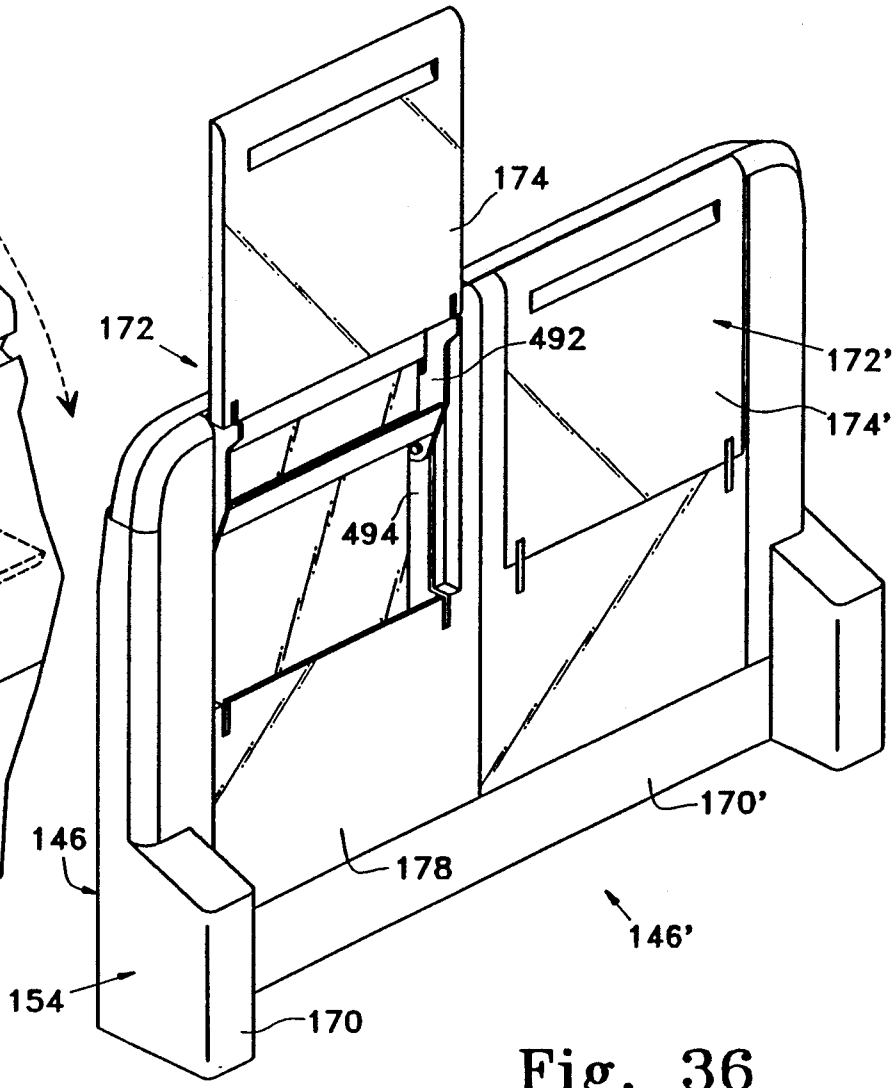
FIG. 36 is an isometric view of a footboard assembly made according to the invention.
Figure 37:
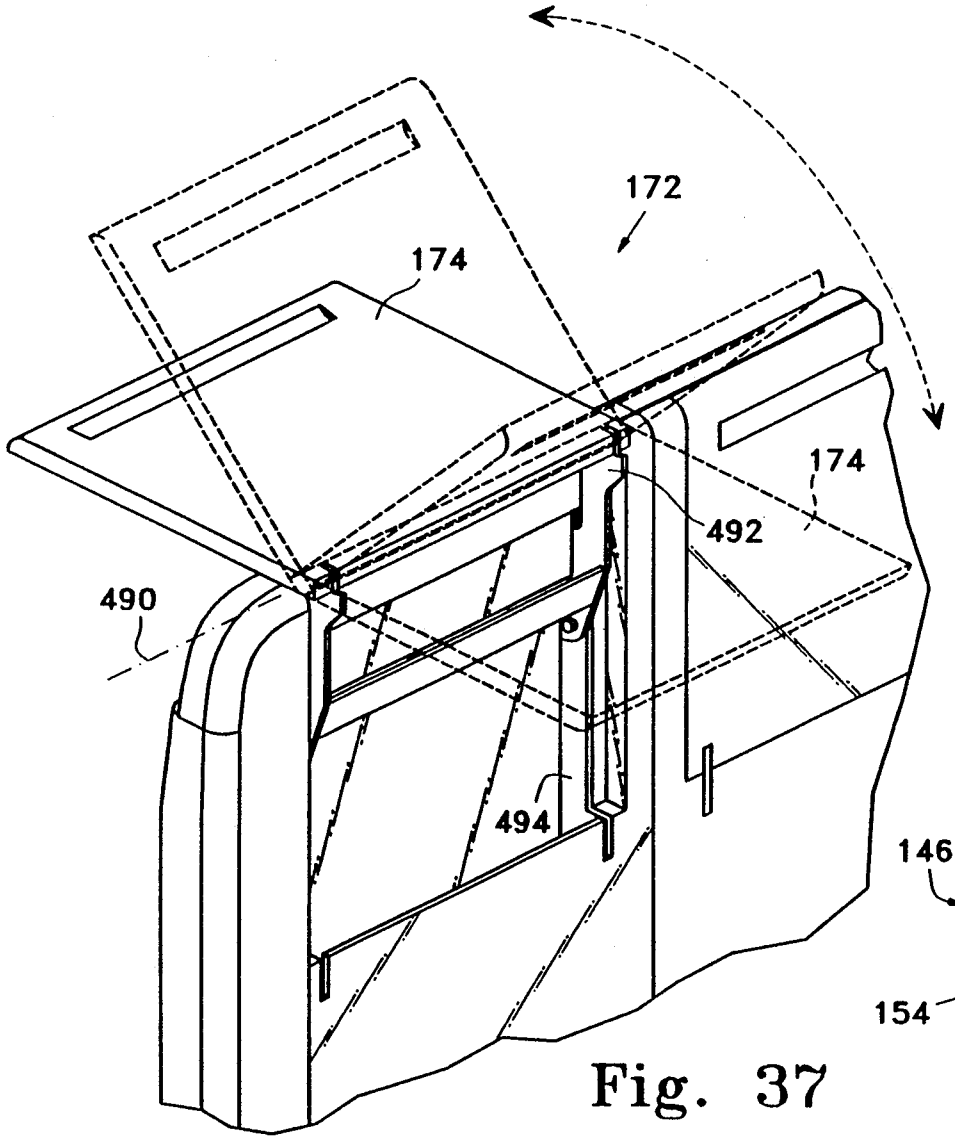
FIG. 37 is a partial view of the footboard assembly of FIG. 36 showing alternative positions of a storable table.

As is shown in FIG. 36, a each table 174 is shiftable from a storage position in which the table is disposed vertically adjacent to the footboard panel, as shown by the table on the right in the figure, to an elevated position as shown by the table on the left.

Once the table is in the elevated position, it is pivotable about a pivot axis 490 between an outboard position shown in solid lines and an inboard position shown in the horizontal dashed lines. As shown in greater detail in FIGS. 40, 41 and 42, table 174 is pivotally mounted by a hinge assembly 489 to a bracket at each edge of the table, such as bracket 492, that is mounted for sliding receipt in a slot 493 in a hollow channel member 494. Channel member 494 is attached to a vertical member, such as member 491 of footboard frame 170. Bracket 492 is attached to a pin 486 that rides in the slot. Bracket 492 is pivotally attached by a connecting pin 487, that also extends through slot 493, to a slide element 488 slidingly received in channel member 494.

Figure 38:
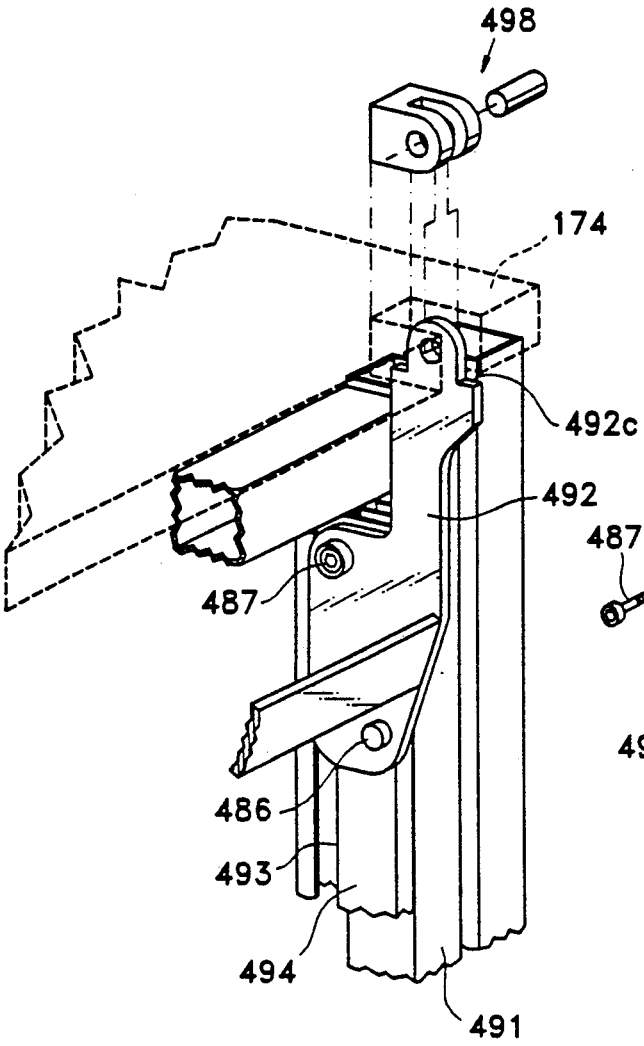
FIG. 38 is an enlarged fragmentary partial view of the mounting assembly for the storable tables of FIGS. 36 and 37.
Figure 39:
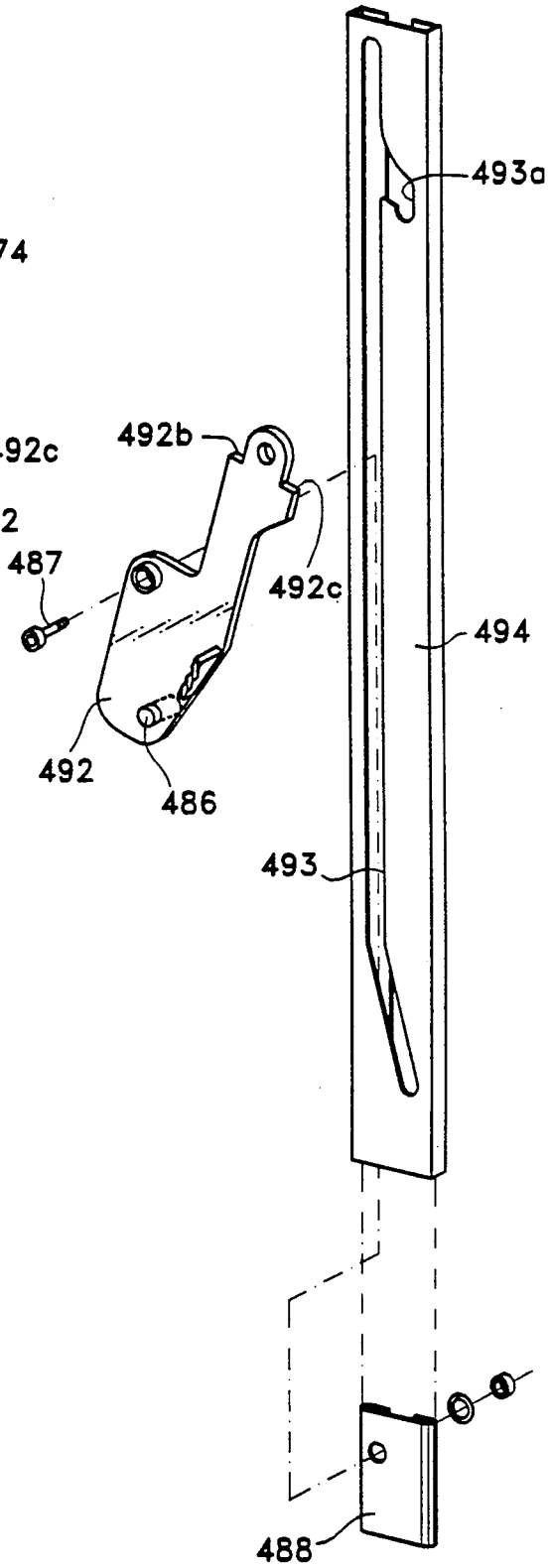
FIG. 39 is an exploded view of a portion of the mounting assembly of FIG. 38.
Figure 42:
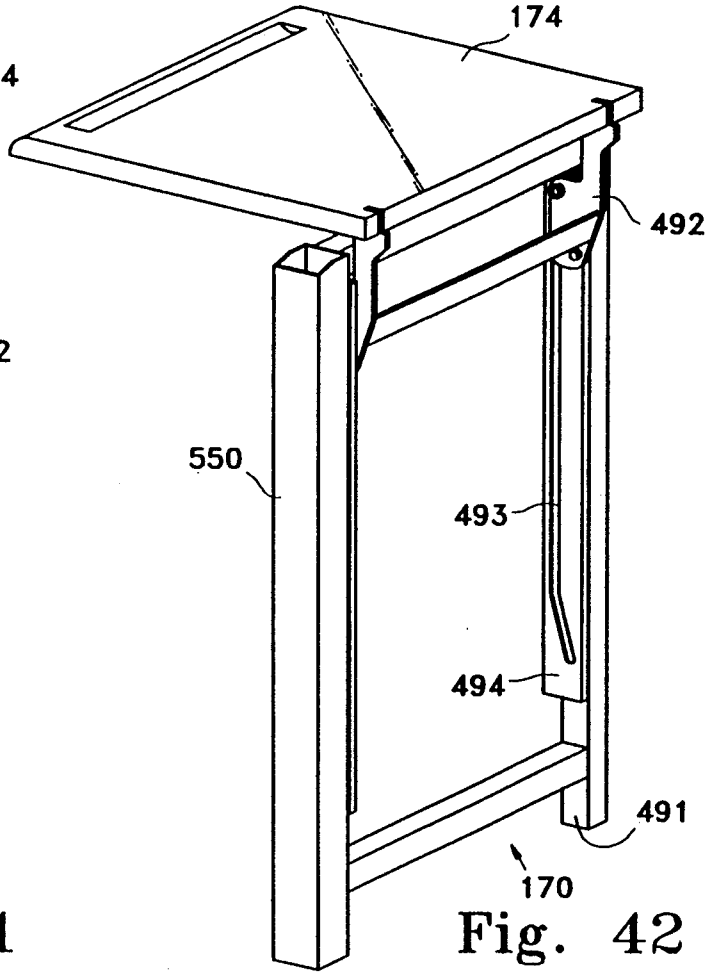
FIGS. 40, 41 and 42 illustrate various operating positions of the storable table of FIG. 36.
Figure 41:
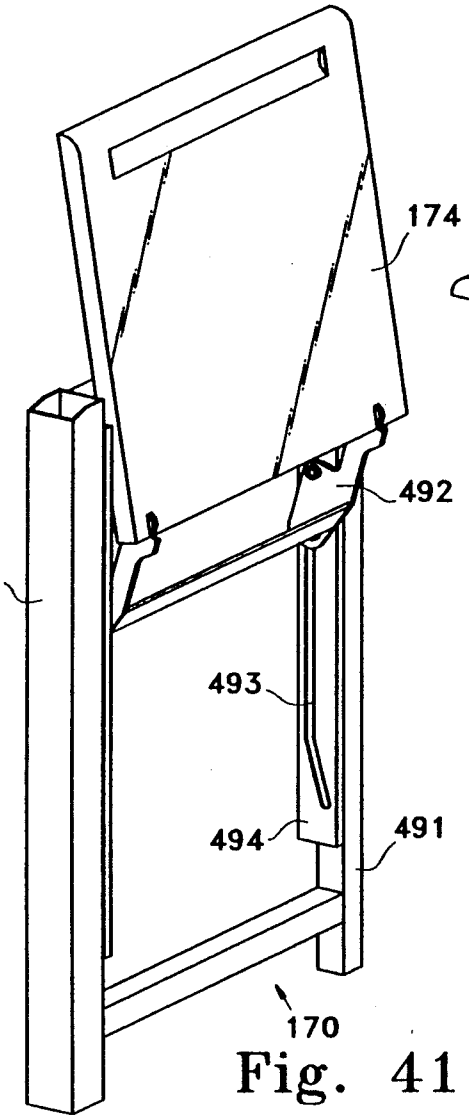
Figure 40:
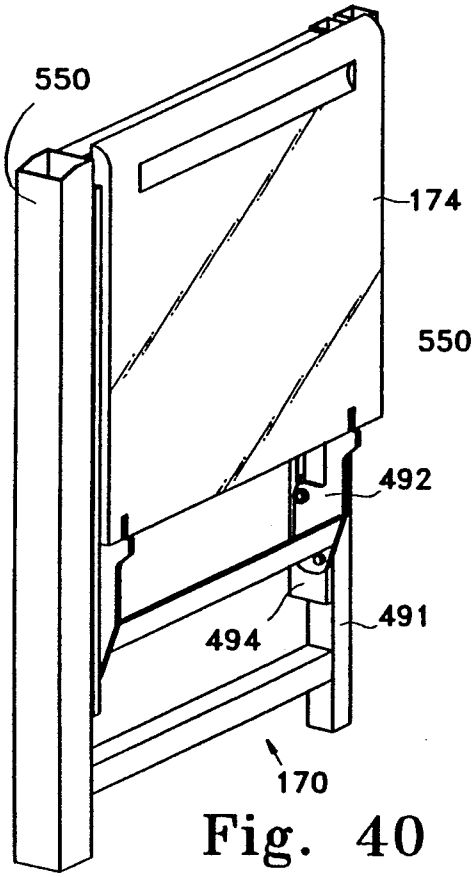

A lock extension 493*a* of the slot is positioned near the top to accommodate a repositioning of the bracket so that pin 486 is supported in it when the table is in the raised position, as is shown in FIGS. 42 and 38. Slot 493 is offset outwardly from the footboard panel at the bottom to hold the base of the table against the footboard panel during storage, as is shown in FIG. 40. FIG. 41 shows the table at an intermediate position during elevation.

The top of bracket 492 has opposing shoulders or stops 492*b* and 492*c* for supporting the table in the inboard and outboard positions.

Figure 43:
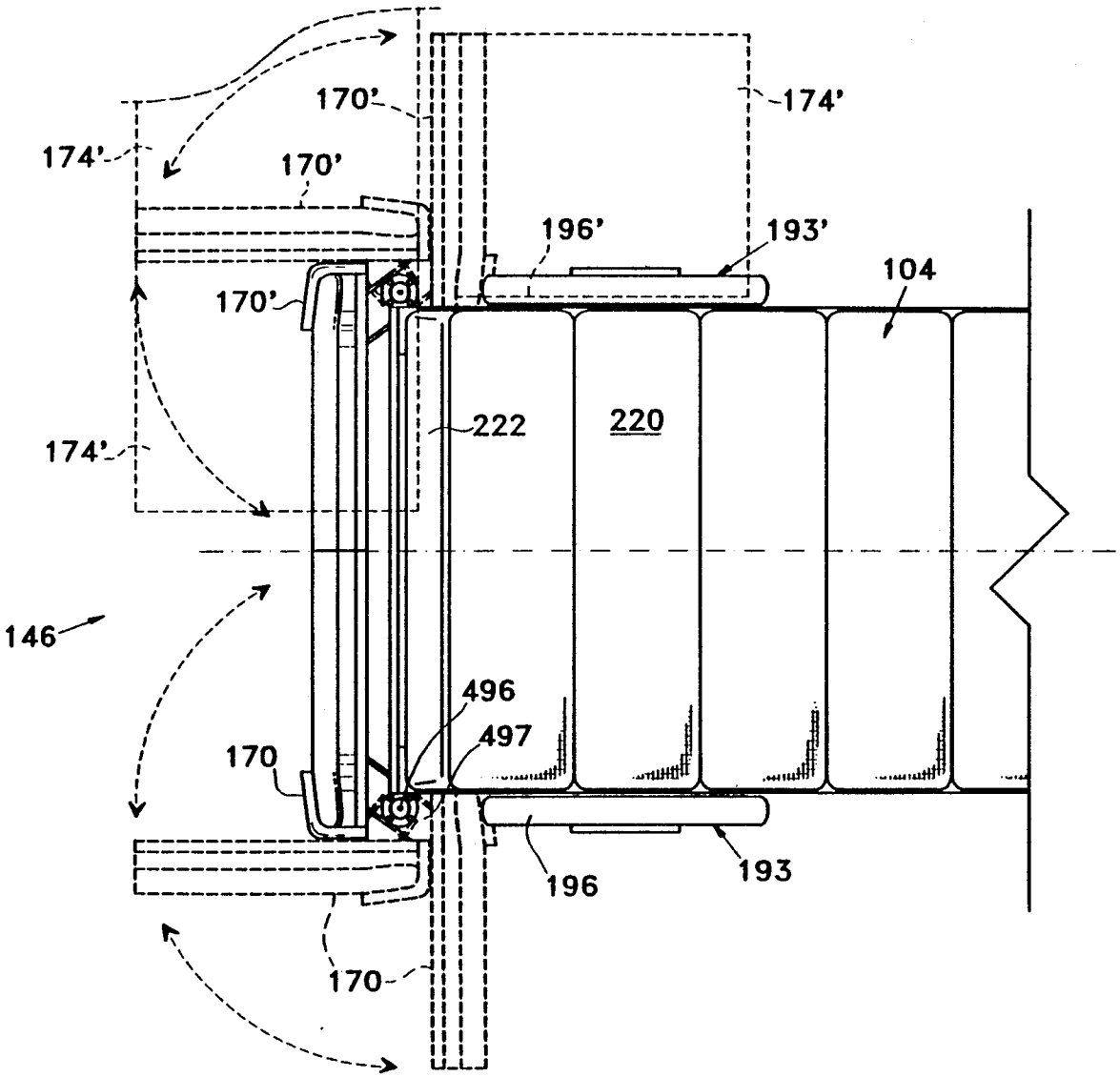
FIG. 43 is a plan view of a portion of the bed showing alternative footboard gate positions.
Figure 44:
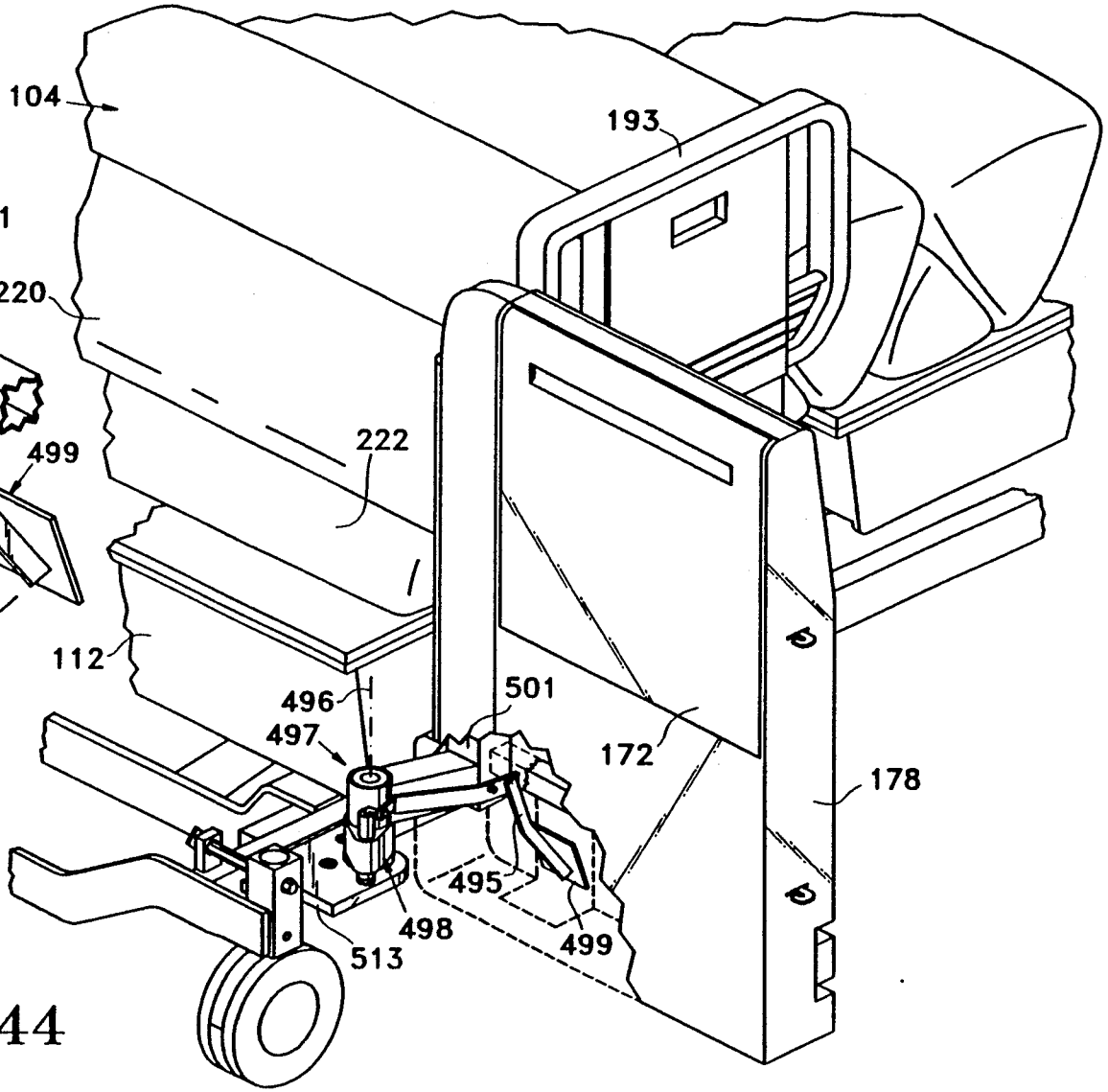
FIG. 44 is a partial isometric of a corner of the bed with a footboard gate in a swing-out position.
Figure 45:
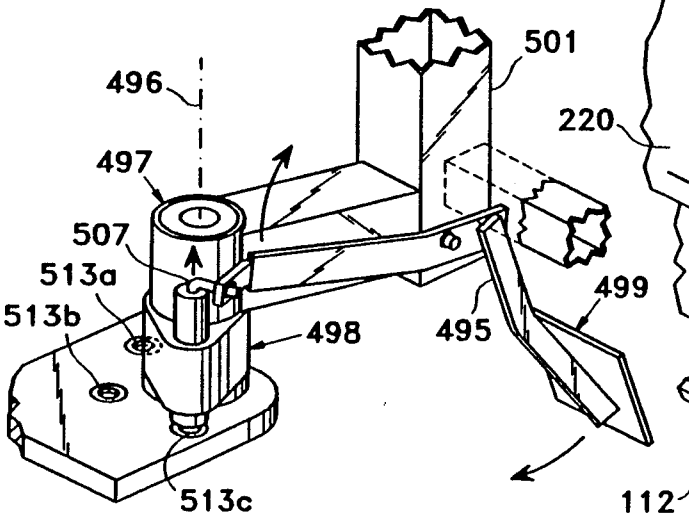
FIG. 45 is an enlarged view of the foot-lever-operated detent mechanism of FIG. 44.

FIGS. 43 and 44 show different views of footboard assembly 146. Each footboard panel 178 is pivotable about a vertical axis, such as axis 496 by a hinge 497. A detent mechanism 498 is operable by activation of a mechanical release by a foot pedal 499 for selectively fixing the footboard panel in three positions as shown particularly in FIG. 43. As shown generally in FIG. 44, and in greater detail in FIG. 45, an arm 495, fixed to foot pedal 499, pivots relative to a gate frame member 501 to raise a spring-biased detent member 507 out of the one of indents 513*a*, 513*b* or 513*c*, of a frame plate 513, in which it is positioned.

In a normal position, as represented by the solid lines, the footboard panels are in line and adjacent to the foot of the bed. When pivoted 90°, the panels or gates extend outwardly from the foot of the bed in what will be seen to be a "hand rail" position. When the panel is in this position, the table may be positioned outboard from the foot of the bed, not unlike the outboard position when the footboard panel is in the normal position, or alternatively, out from the corner of the bed, as shown in dashed lines at the top of FIG. 43.

Panel 178 is further pivotable another 90° to a side position, generally normal to the side of the bed. The table is positionable along the side of the bed, over guard rail 196 when it is lowered.

Figure 46:
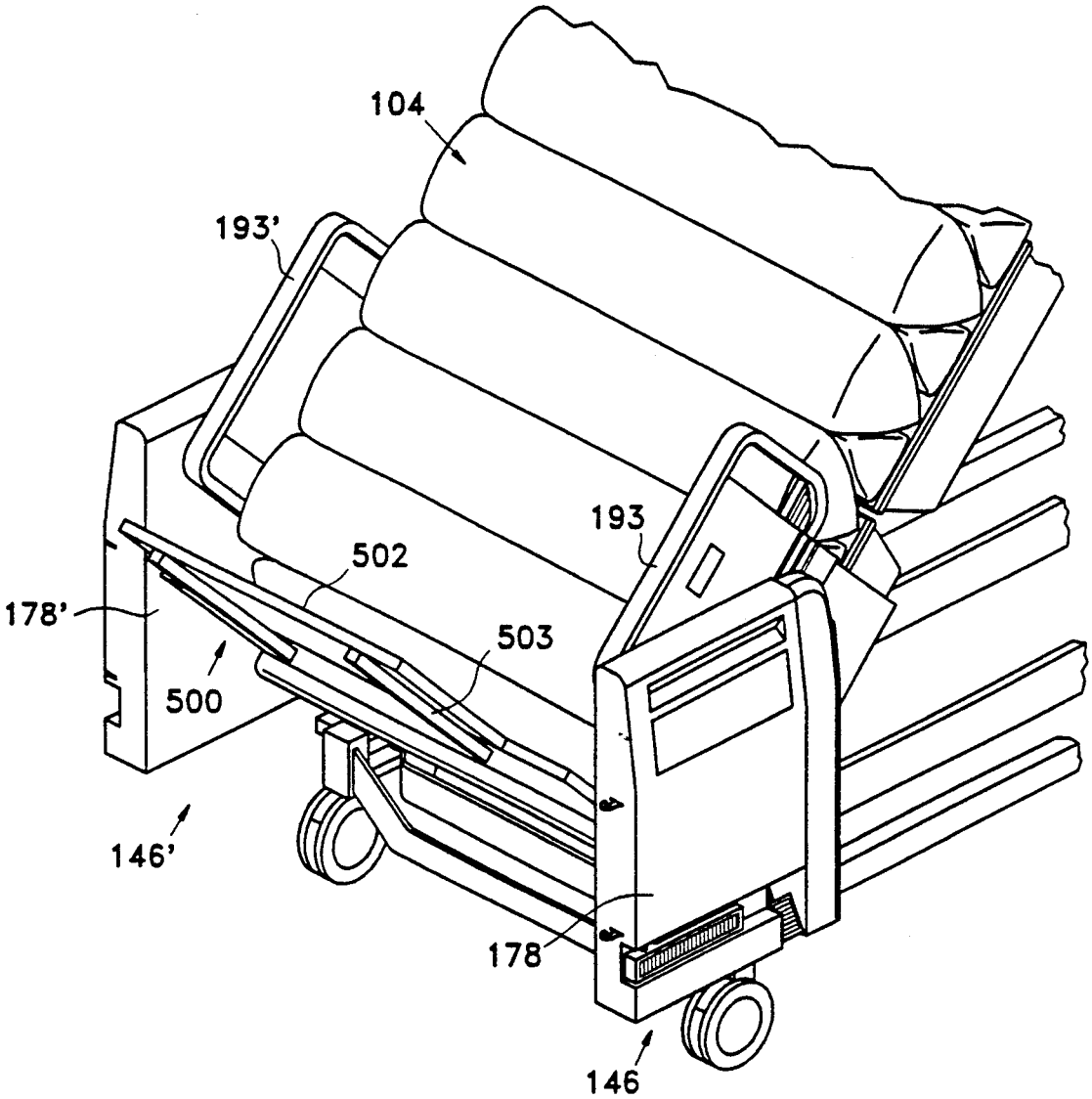
FIG. 46 is a partial isometric of the foot end of the bed in a tilted position with a stand board and the footboard gates in a "hand rail" position.

The requirement for having pivoting footboard gate panels is evident in FIG. 46, which figure shows a bed platform partially raised toward a standing position, as is described in the previously referenced patent to Ferrand. When used to stand the bed up, the footboard gate panels must be opened to allow for the foot of the bed to be lowered toward the floor. Also, by locking the footboard panels in the "hand rail" position, a patient getting in or out of the bed while the platform is in the standing position can use the footboard panels as supports or handrails to provide stability. The foot-end hand rails are positioned for convenient use during this procedure as well.

FIGS. 47–51 illustrate a latching assembly 452 for holding footboard panels 178 and 178'. Assembly 452 is controlled by a handle 453 that allows the two panels to swing independently when it is pulled outwardly from its position in the base of panel 178, as shown. Handle 453 is connected to a pivot rod 454 that has mounted on it two latch mechanisms, such as latch mechanism 455.

Latch mechanism 455 includes a mounting bracket 456 that is mounted on a footboard gate frame member 457. Pivot rod 454 extends pivotably through a hole, not shown, in the bracket. A slot 456*a* guides the travel of a first guide pin 458 that extends through it. A second guide pin 459, spaced from slot 456*a* is fixedly mounted to bracket 456. A latch plate 460 rests on bracket 456 and has a slot 460*a* through which second guide pin 459 extends. Plate 460 also has a hole, not shown, through which first guide pin 458 extends.

Plate 460 extends through a slot 178*a* in the side of panel 178, and when in the closed or locked position, also extends through a corresponding slot 178*a*' in the other panel. The distal end 460*b* of plate 460 is formed as a laterally extending hook that extends through a corresponding slot 461*a* of a frame member 461. Pivot rod 454 extends through a corresponding slot 460*c* in the plate that allows movement of the plate relative to the rod.

Figure 47:
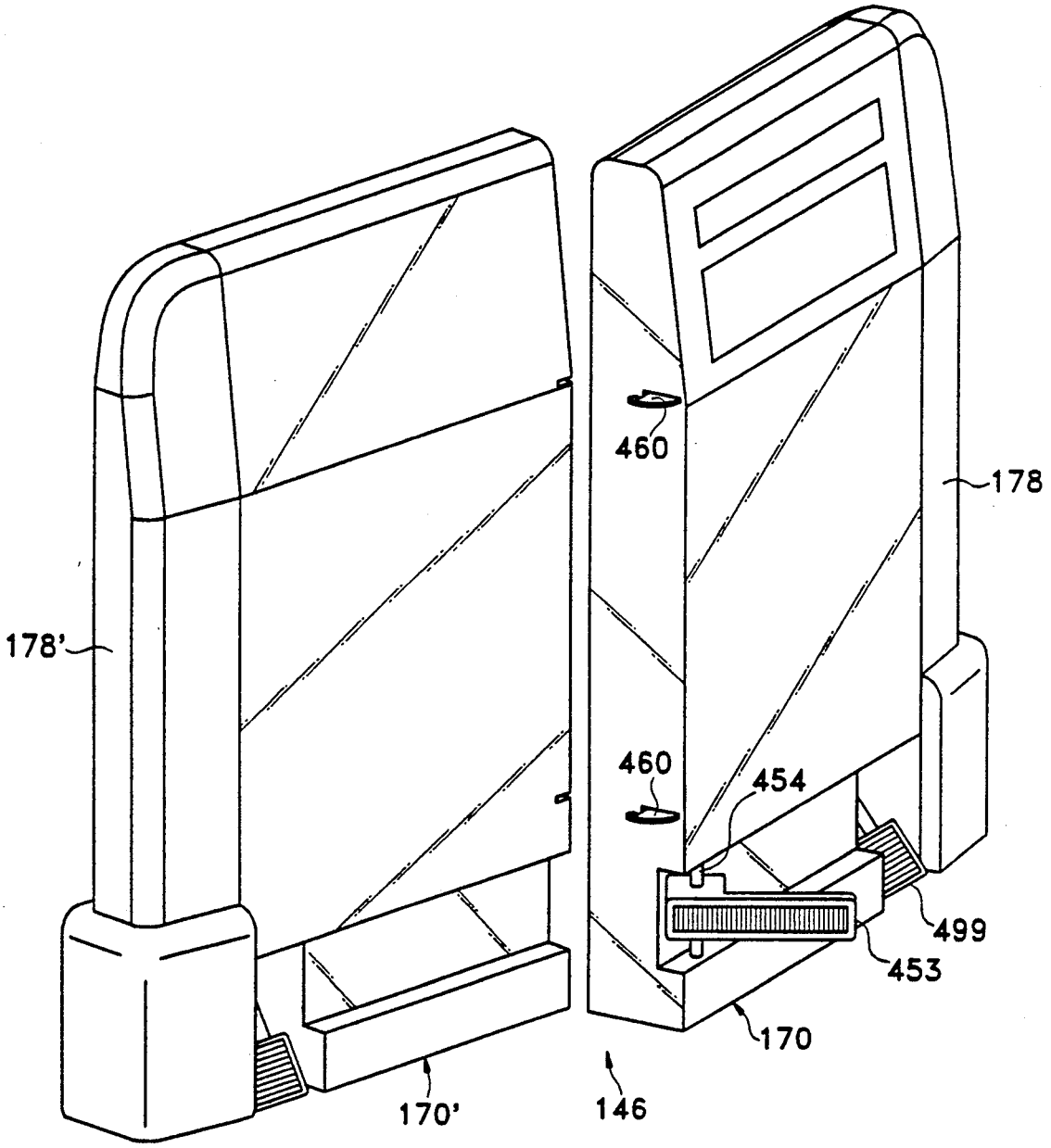
FIG. 47 is an isometric view of the two footboard gates of the invention.
Figure 49:
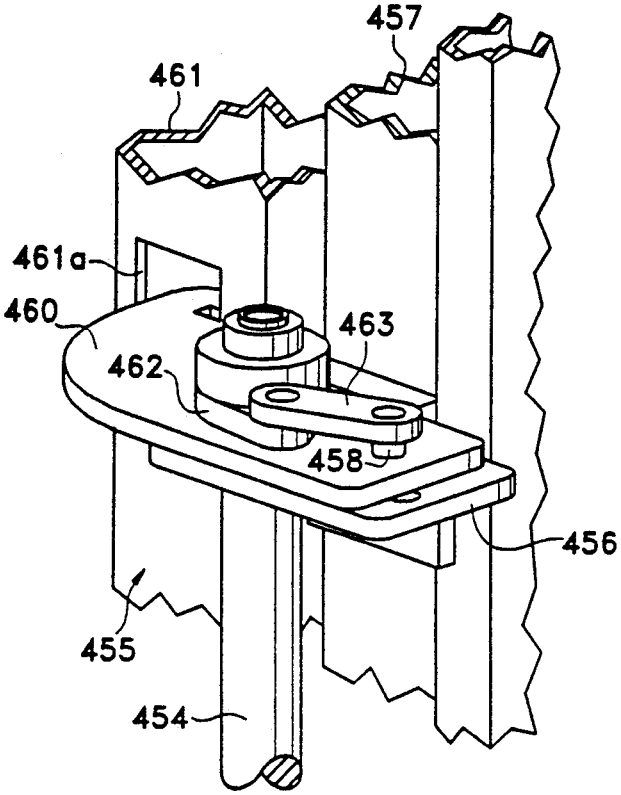
FIG. 49 is an enlarged view of a latch mechanism of the latching assembly of FIG. 48.
Figure 48:
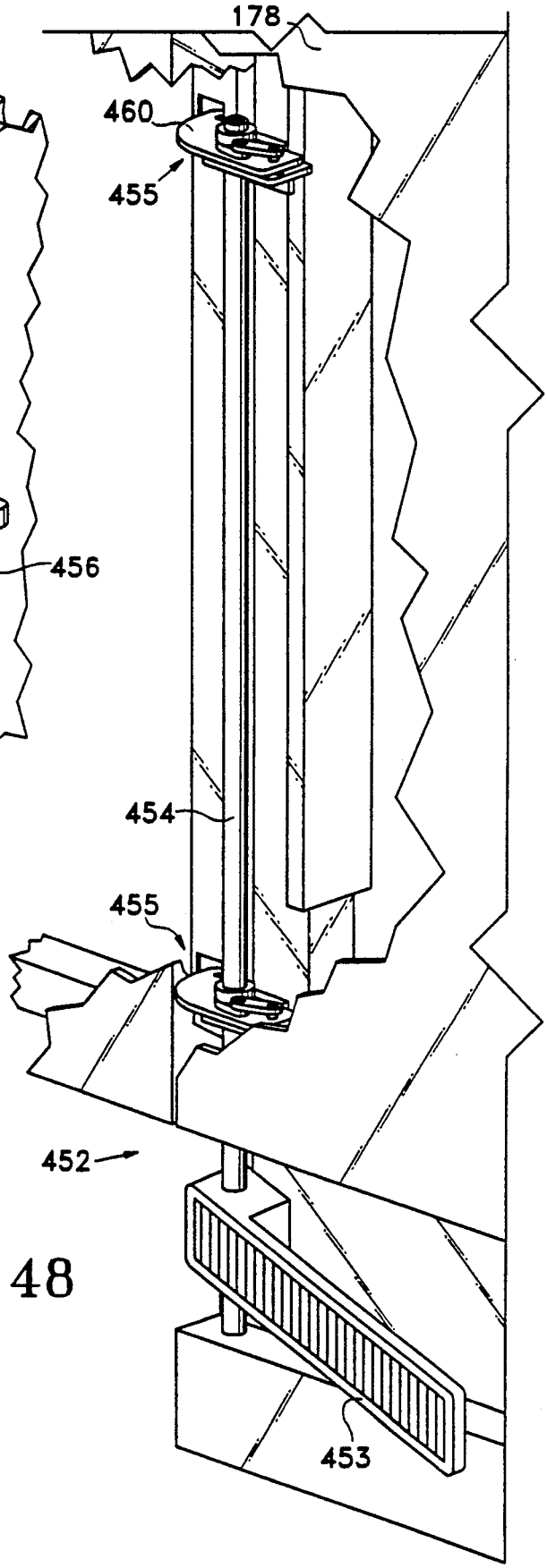
FIG. 48 is a partial fragmented view of the latching assembly for securing the footboard gates of FIG. 47.
Figure 50:
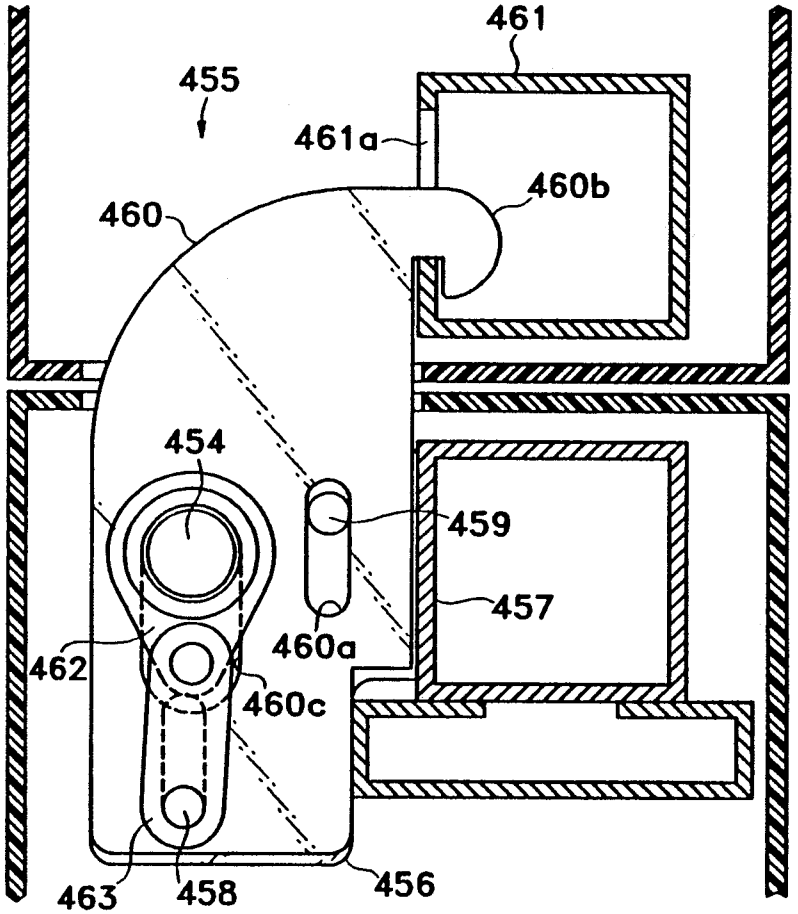
FIGS. 50 and 51 are plan views of the latch mechanism of FIG. 49 in two operative positions.
Figure 51:
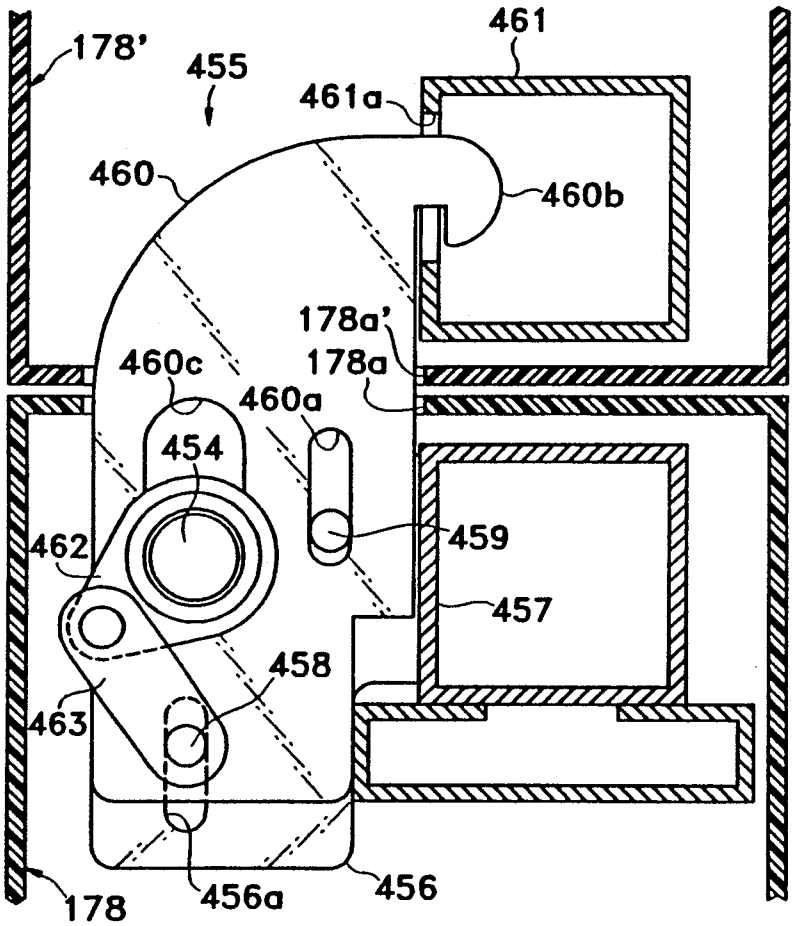

An eccentric drive arm 462 is fixedly mounted to the rod. A drive link 463 is pivotally connected at one end to arm 462 and attached to first guide pin 458 at the other end. When the pivot rod is rotated, latch plate 460 is moved in line with slots 456*a*, 460*a*, and 460*c*. When handle 453 is flush in panel 178 in a storage position, hook end 460*b* engages the edge of frame member 461, as is shown in FIG. 50. When the handle is pulled out, as shown in FIG. 47, the hook end disengages frame member 461, allowing the two footboard gates to swing open.

3. Stand-Up Board

It will be noticed in FIG. 46 that a stand board assembly 500 is mounted to the foot of the platform. A stand board 502 is mounted on a frame 503 to extend above the top surface of the mattress. The structure of the stand board assembly is shown more clearly in FIGS. 52–55. Frame 503 includes a pair of legs 505 and 506 that are positionable in corresponding openings 508 and 509 of platform extension portion 112. Each leg has a mounting hole 510 and 511 for receipt of a securing pin 512 that is positioned in one of the associated positioning holes 514, 515 and 516 or 517, 518 and 519 in a corresponding side plate 520 or 521 of the platform extension portion.

A fixed stand board plate 523 is fixedly attached to legs 505 and 506 so that it is positioned adjacent to the platform surface during use. Stand board 502 is pivotally mounted to the tops of legs 505 and 506 by a pivot rod 525.

Figure 52:
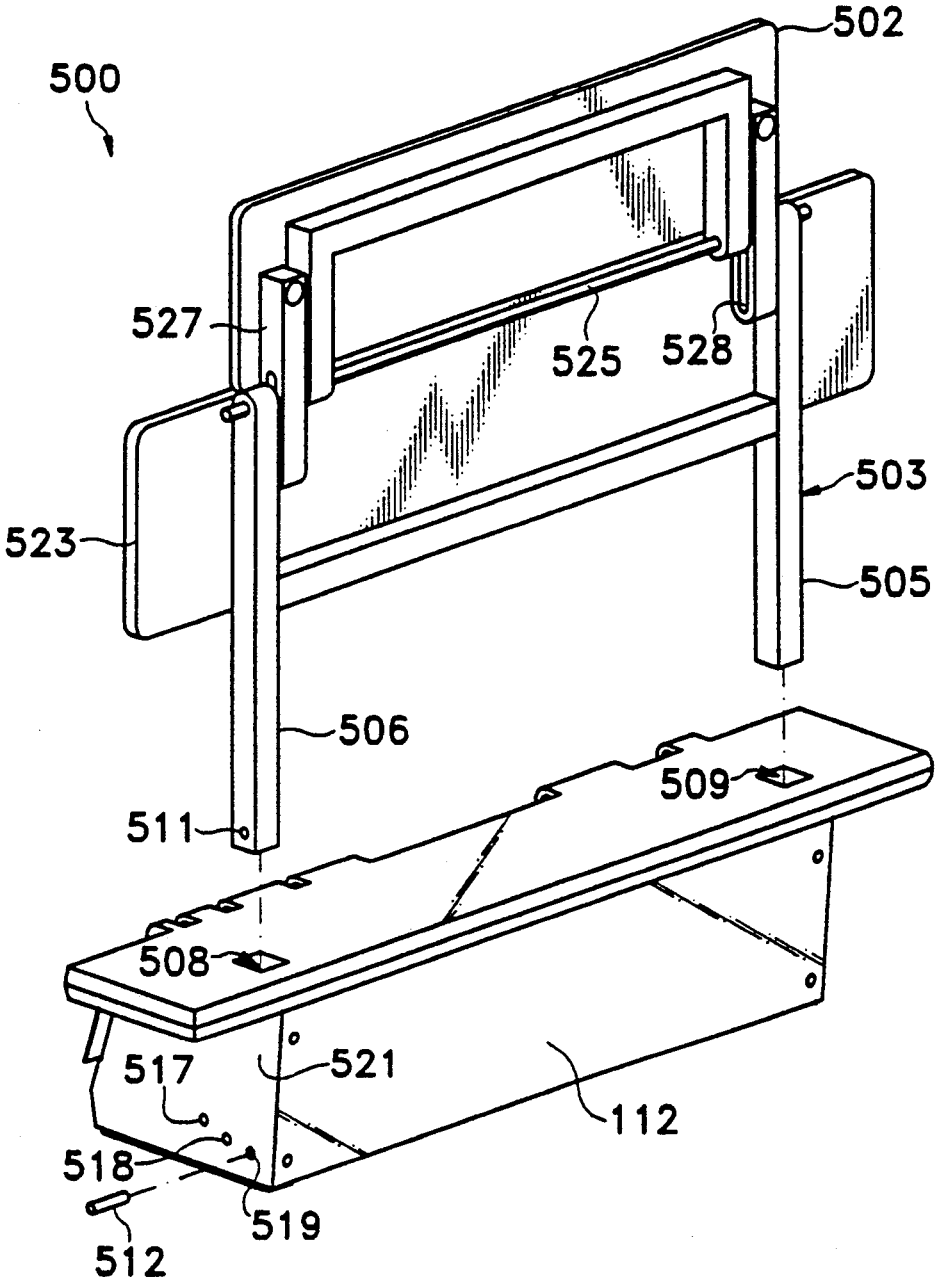
FIG. 52 is an isometric view of the platform extension member and an unfolded stand up board positioned for installation.
Figure 54:
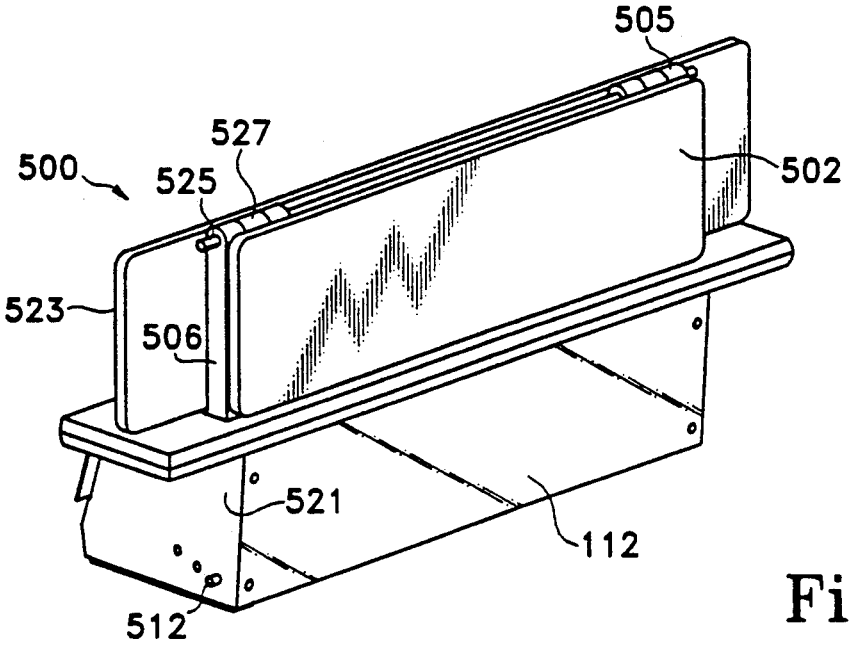
FIG. 54 is a view similar to FIG. 53 showing the stand up board folded and installed.

Board 502 is pivotable from an upright position, shown in FIG. 52 to a storage or collapsed position shown in FIG. 54. A pair of pivot locking members 527 are elongate and have closed slots 528 through which rod 525 extends. It will be noted that the slot extends close to the lower end of the member, but only midway up it. When the stand board is in the upright position, member 527 is in a lock position in which rod 525 is in the upper end of the slot. The member is held in this position by gravity and extends along both the stand board and the fixed plate.

Figure 53:
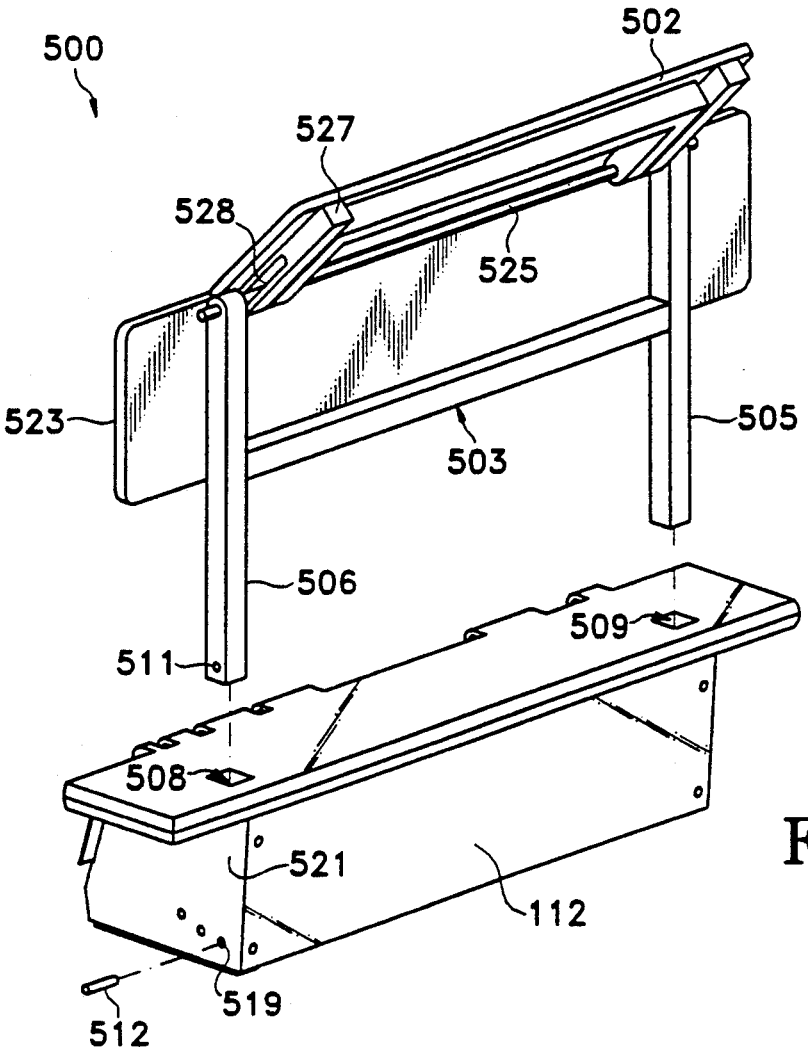
FIG. 53 is a view similar to FIG. 52 showing the stand up board partially folded.

When members 527 are raised to an unlock position, the locking member is pivotable about rod 525, thereby also allowing stand plate 502 to pivot. FIG. 53 shows the locking member in the unlock position, and pivoting with stand board 502 relative to fixed plate 523. The position of the stand board when fully pivoted to the storage position is shown in FIG. 54.

Figure 55:
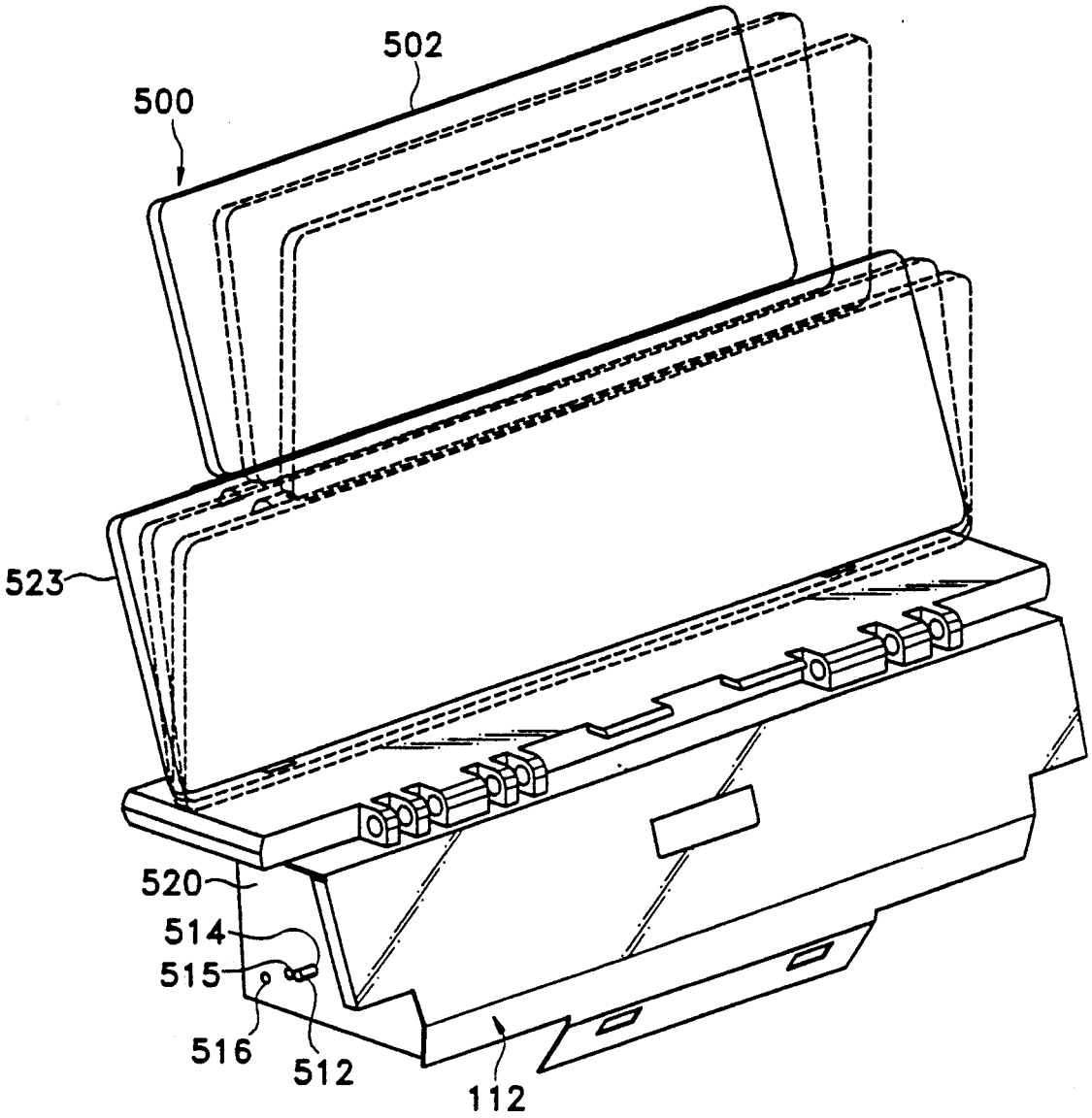
FIG. 55 is a view reverse to the view of FIG. 54 showing the unfolded stand up board in alternative positions relative to the platform extension.

Positioning holes 514 and 517, holes 515 and 518, and holes 516 and 519 are correspondingly positioned so that stand board 502 may be positioned at various angles relative to the platform. FIG. 55 illustrates, in a view opposite to the view of FIG. 54, in phantom and solid lines the various angles that the stand board may have. The position of the stand board in solid lines corresponds to an angle greater than 90°, so that when the mattress is tilted just shy of 90° from the floor, the stand board will be approximately parallel to the floor. In the opposite position shown, corresponding to the position shown in FIG. 54, the stand board is substantially normal to the platform. An intermediate position is also available, as shown.

4. Headboard

Figure 56:
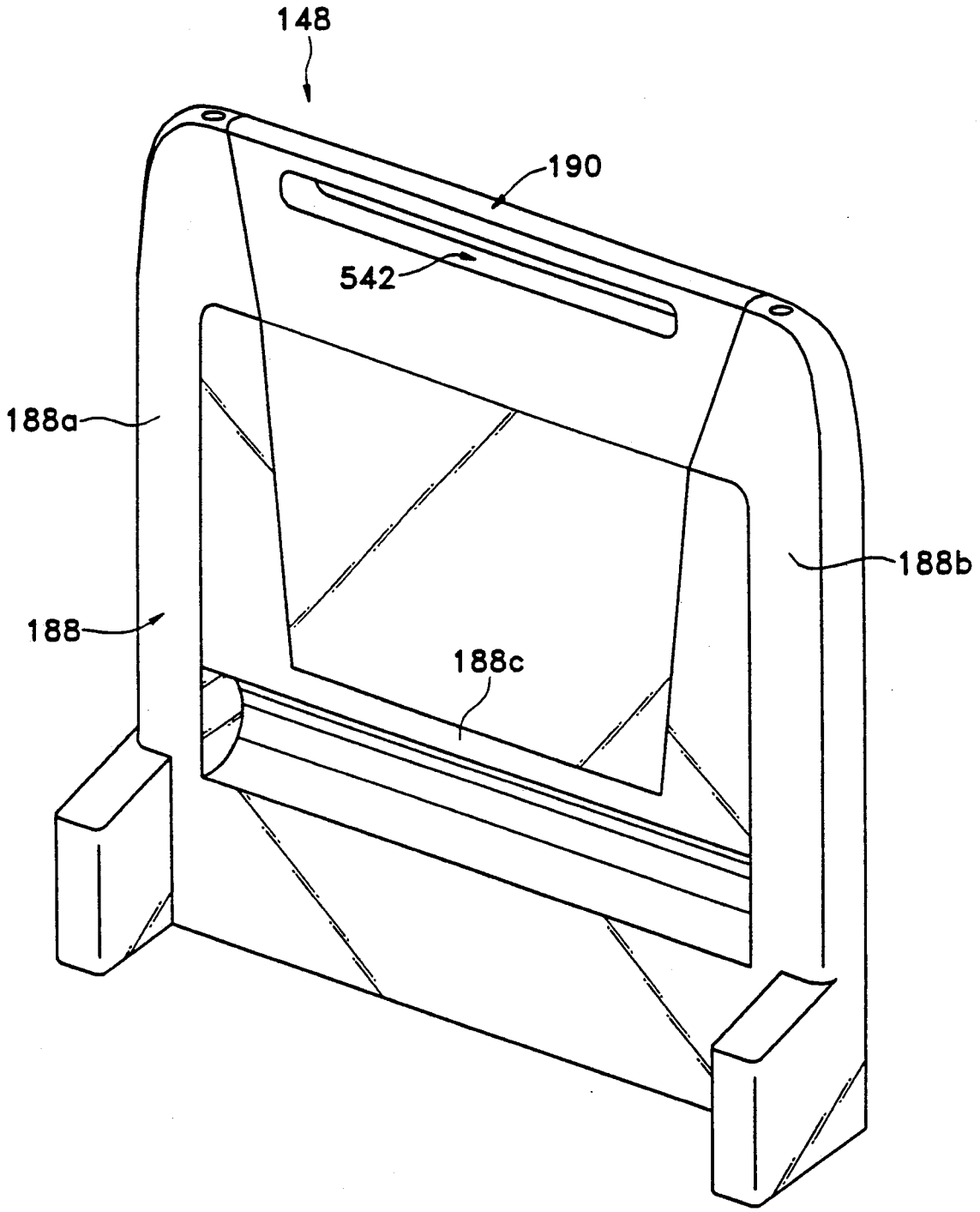
FIG. 56 is an isometric view of a headboard made according to the invention with a panel removable for providing patient access.
Figure 57:
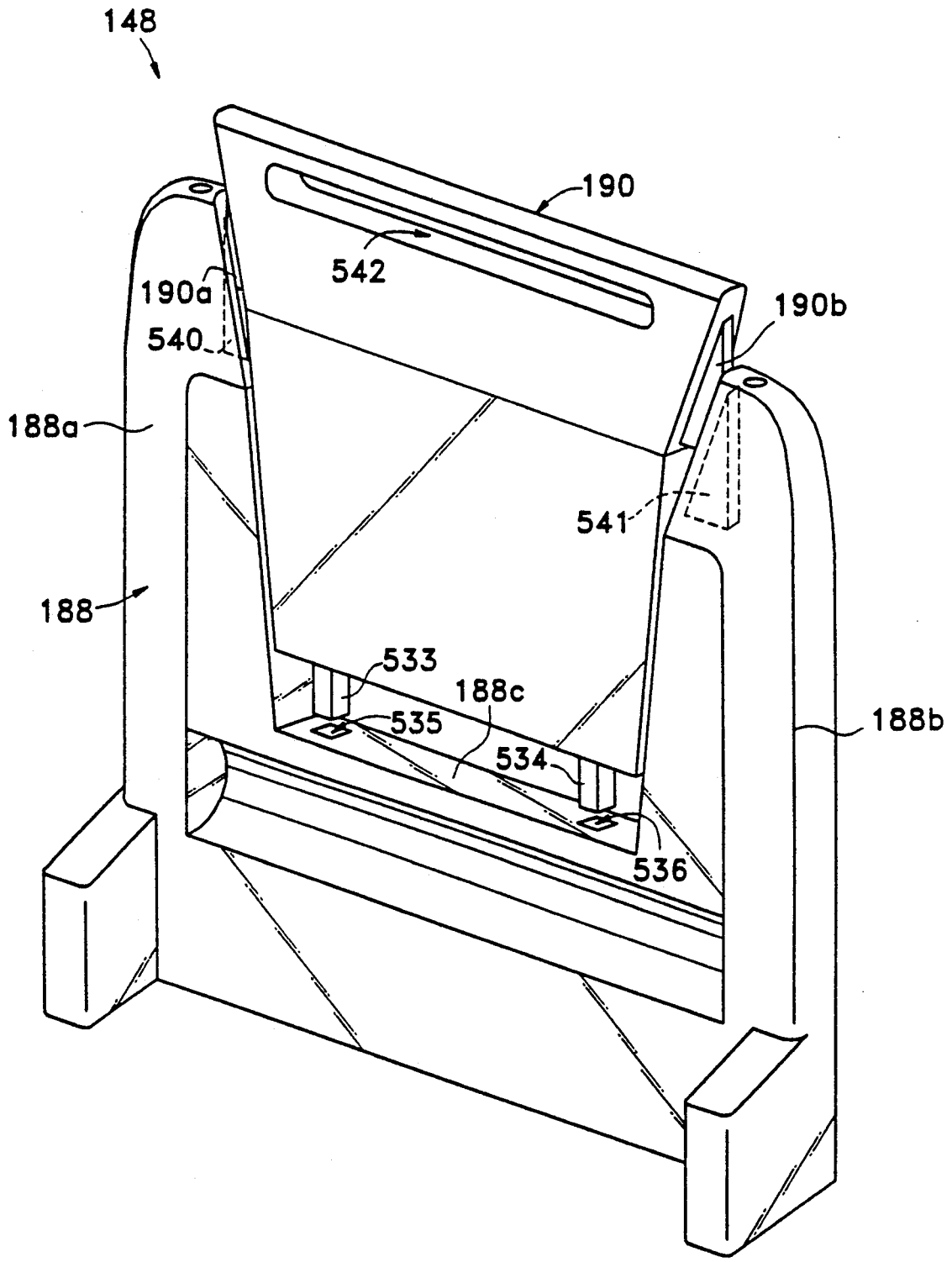
FIG. 57 is a view similar to FIG. 56 with the removable panel partially lifted out of the headboard fame.

FIGS. 56 and 57 illustrate a headboard assembly 148 made according to the invention. This assembly includes base end board 188 having raised side portions 188*a* and 188*b*, and a low intermediate portion 188*c*. The side portions extend well above the mattress of the bed, as shown in FIG. 1, and the intermediate portion preferably extends below the level of top plate 115 when the bed is in the lowest position. A removable panel 190 fills the space left open by intermediate portion 188*c* and is fixedly positionable on the intermediate portion, as shown in FIG. 56. Panel 190 preferably conforms with the size and shape of end board 188 to form a uniform head board assembly.

As shown in FIG. 57 panel 190 is removable from end board 188. To accomplish this, panel 190 has a pair of subtending legs 533 and 534 that are received in mating holes 535 and 536 in the intermediate portion of the end board. Alternatively, the removable panel can have the holes, and the end panel the legs. In order to provide lateral stability to the panel and to allow weight to be applied to it during use and transport of the bed, the panel upper sides preferably include respective wings 190*a* and 190*b*. The facing edges of side portions 188*a* and 188*b* have corresponding slots 540 and 541 into which the wings are received when the panel is lowered into position in end board 188.

Also, to facilitate removal of the end panel, it preferably has means for gripping the panel, such as by an elongate hand slot 542.

Figure 58:
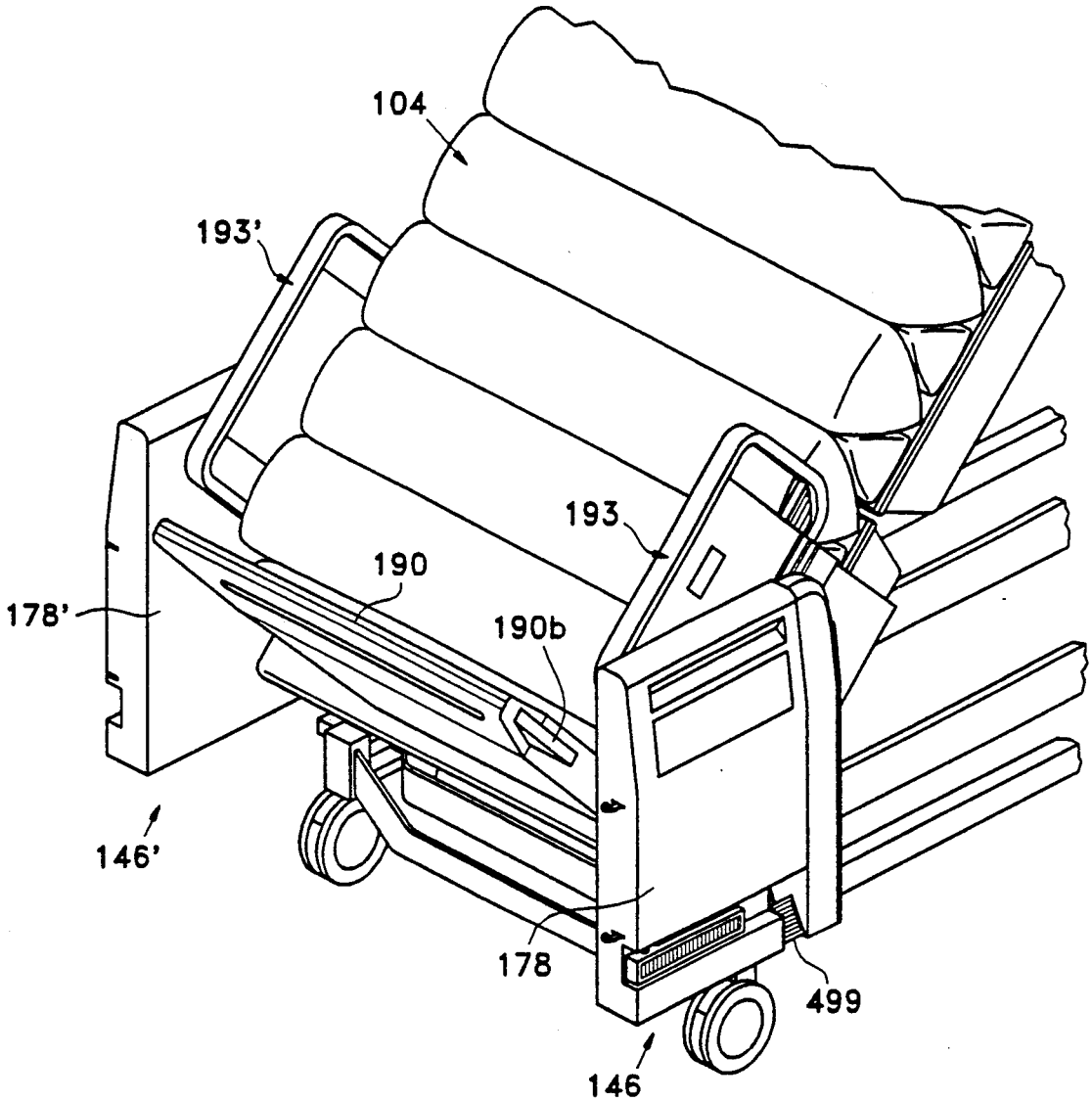
FIG. 58 is a view similar to FIG. 46 showing the headboard panel used as a stand up board.
Figure 60:
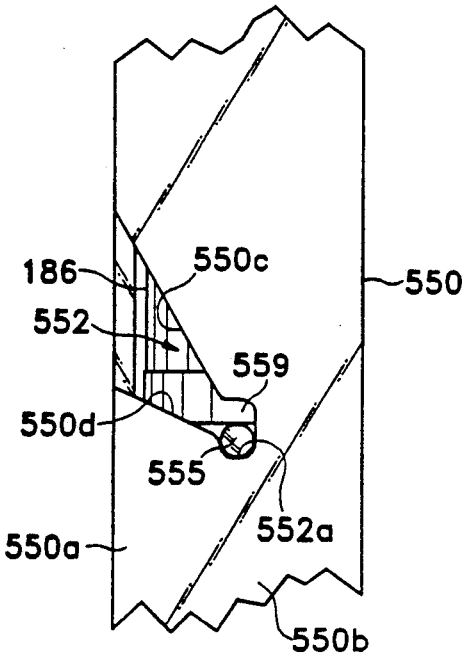
FIG. 60 is an enlarged side view of a portion of FIG. 59 showing a lock opening.

With the embodiment of the footboard panel illustrated, legs 533 and 544 preferably correspond in size and length to legs 505 and 506 of the stand board assembly just described. If so, panel 190 may be used in lieu of stand board assembly 500. The use of panel 190 as a stand board is illustrated in FIG. 58. It could also be made angularly adjustable using the same structure as provided for the stand board assembly.

As has been described with reference to FIG. 1, located in each corner of the bed, imbedded in the edges of the foot and head boards, are equipment support assemblies, such as assemblies 176 and 176'. Assembly 176' associated with the foot board will typically not have equipment support apparatus 184, as it is generally to be used for traction or other heavy types of equipment.

Figure 61:
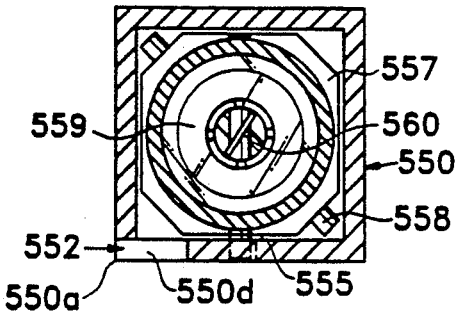
FIG. 61 is a cross section taken along line 61—61 of FIG. 59.
Figure 59:
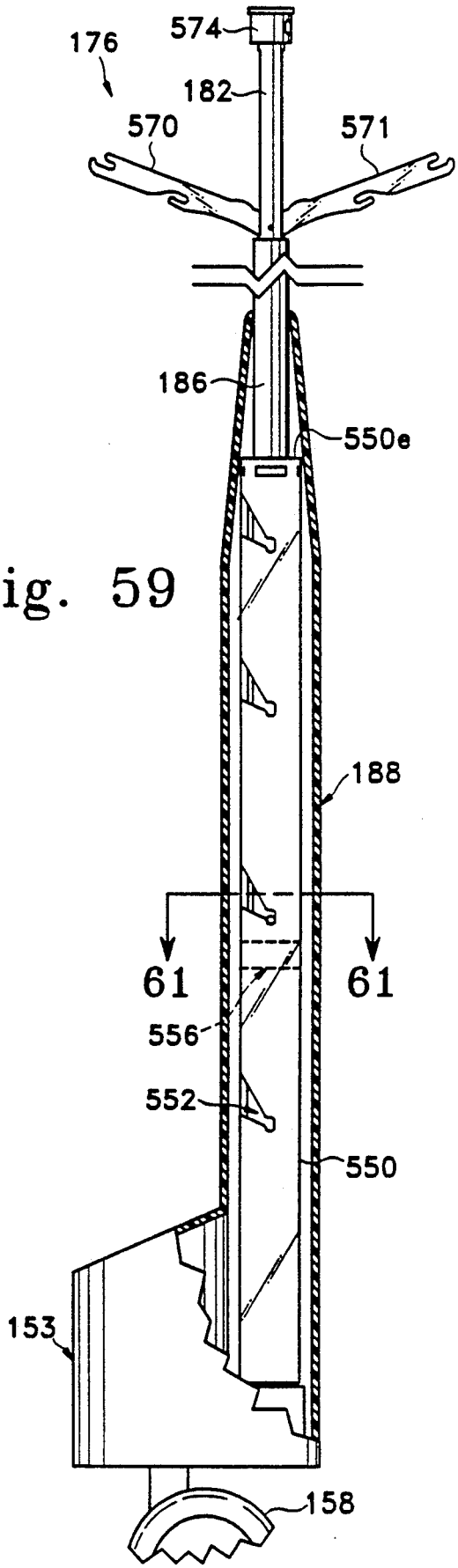
FIG. 59 is a fragmented cross section of a corner of the headboard of the invention showing the structure of a telescoping equipment support assembly.

The structure of equipment support assembly 176 is shown in further detail in FIGS. 59–70. In FIG. 59, a channel base member 550 is fixedly mounted in a side portion of base board 188 of the head board assembly 148. It has a square cross section, as shown in FIG. 61 and has a series of downwardly angled, generally triangle shaped openings 552. Each opening 552 extends from a corner 550*a* to the middle of a side, such as side 550*b*. Each triangular opening terminates in a recess 552*a* at its lowest point, and has upwardly directed sides formed by upper edge 550*c* and lower edge 550*d*. The base member ends in a top opening 550*e* positioned below the top surface of the base head board.

Figure 62:
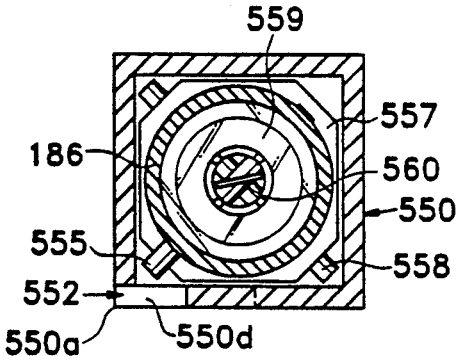
FIG. 62 is a view similar to FIG. 61 showing a different operative position.

Intermediate hollow rod 186 is disposed within base member 550, as shown in FIG. 61 for sliding vertically. A pin 555 is mounted in a bushing assembly 556 attached to the bottom end of rod 186 to extend radially from the rod, as shown particularly in FIGS. 67–70. The rod is rotated so that pin 555 is moved from recess 552*a* to the corner of the base member, as shown in FIG. 62. In this position the intermediate rod can be freely moved up and down relative to the base member. As shown in FIG. 68, a bushing 556 is mounted in the base of rod 186 which applies a counterclockwise torque to the rod relative to the base member. This torque urges pin 555 into the triangular openings 552 and once in an opening, toward the associated recess 552*a*. This causes the intermediate rod to be somewhat self positioning if allowed to rotate in base member 550 while being lifted. If the rod is not allowed to rotate, it can be lifted freely to any position. When being lowered, the pin will further be directed into a triangular opening recess by the angle of edges 550*c* and 550*d*.

Figure 67:
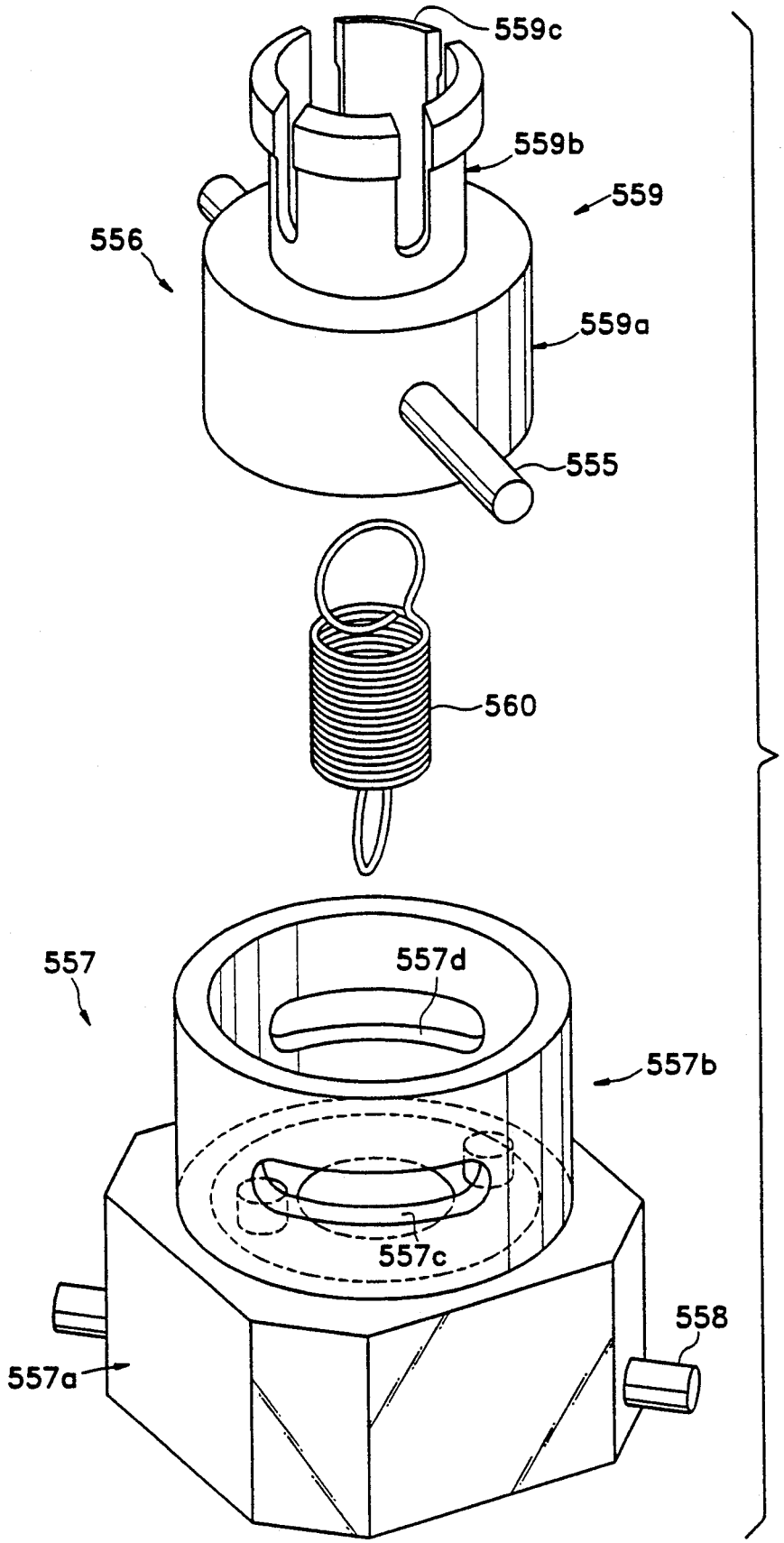
FIG. 67 is an enlarged exploded view of a torsion bushing used in the equipment support assembly of FIG. 59.
Figure 68:
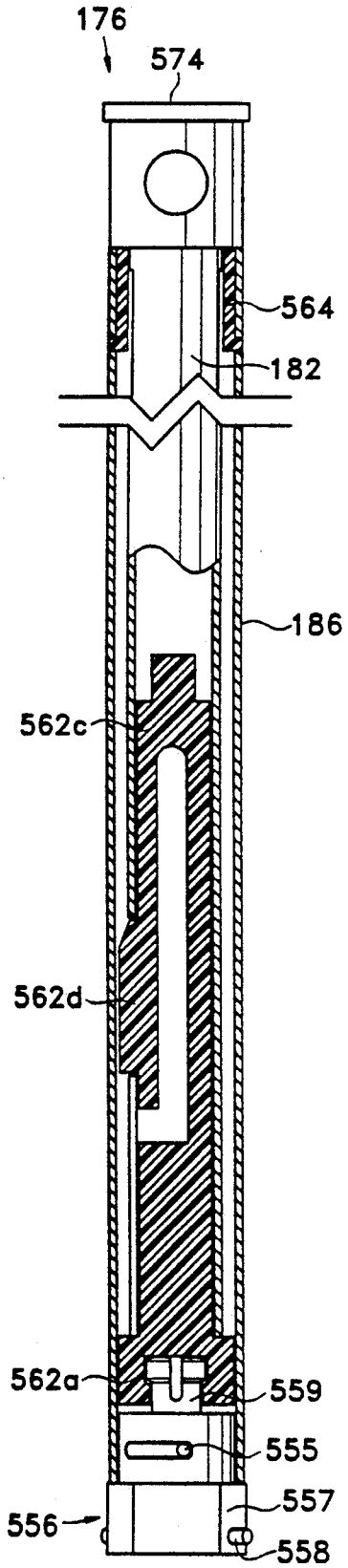
FIGS. 68, 69 and 70 are enlarged cross-sections of a portion of the equipment support assembly of FIG. 59 illustrating operation of a telescoping rod bushing.

Referring to FIG. 67 bushing assembly 556 includes a base unit 557 having an anchor pin 558 in the lower portion. A base section 557*a* is hollow and has an exterior constructed to fit into base member 550 and yet too large for intermediate bar 186. The base unit has an upper portion 557*b* sized to fit within bar 186, as shown in FIG. 68. The upper portion os also hollow and has opposite circumferential slots 557*c* and 557*d*.

A hollow insert unit 559 has a lower portion 559*a* that fits into upper portion 557*b* of the base unit. Pin 555 extends through lower portion 559*a* sufficiently far to also extend through slots 557*c* and 557*d* and out through one sidle of intermediate bar 186, as has been discussed.

The upper portion 559*b* of the insert unit is in the form of resilient fingers 559*c*. Upper portion 559*b* is releasably insertable in a snap bushing 562, a base end 562*a* having a cavity 562*b* conforming with the upper portion. Insert unit 559 is held in place on inner shoulder 557*e* between the upper and lower portions by a spring 560 that is attached to pins 555 and 558. The spring is twisted before assembling assembly 556 so that pin 555 is given a counter clockwise torque, from a perspective above the assembly. This causes pin 555 to rotate into recesses 552 in base member 550 as has been described.

Support assembly 176 is stored in a collapsed position with upper bar 182 positioned in insert unit 559, as is shown in FIG. 68. Bushing assembly 556, attached to intermediate bar 186, is seated in the bottom of base member 550. When upper bar 182 is lifted out of the headboard, intermediate bar 186 rises with it, due to the connection provided by insert unit 559 in cavity 186*c* of the intermediate bar.

Figure 69:
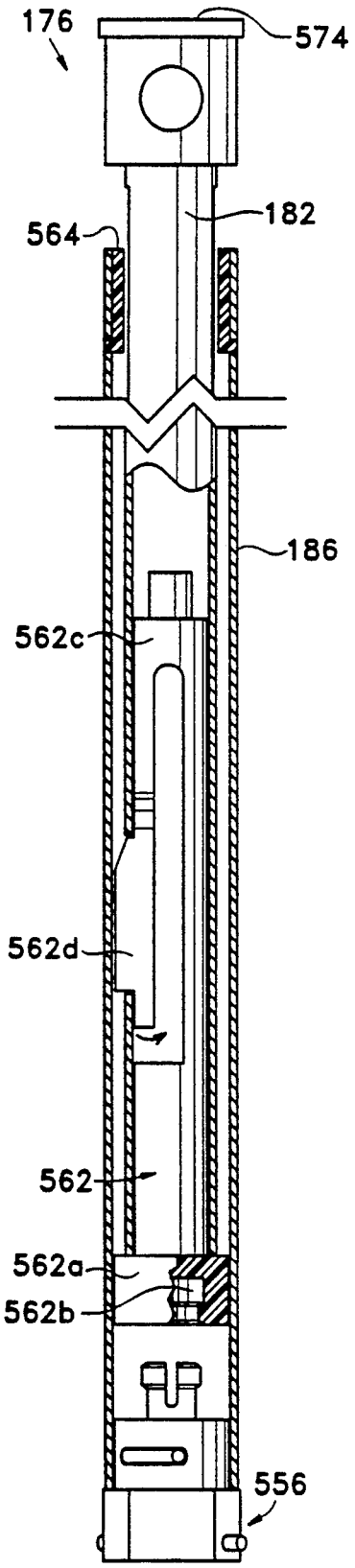

When pin 555 enters the first opening 552, the intermediate bar rotates under the torsion of spring 560 into the associated recess 552*a*. This stops the initial upward travel of the intermediate bar at a position suitable for attaching traction equipment to the top of it. Further upward force on upper bar 182 releases it from the intermediate bar, as shown in FIG. 69.

Figure 70:
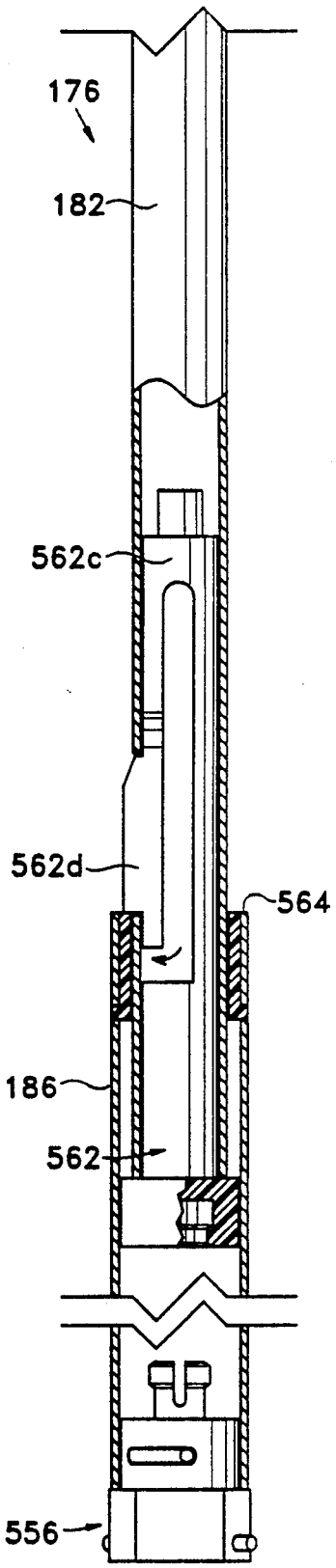

Snap bushing 562 extends up into the bottom end of upper bar 182 to an upper end 562*c* from which it extends back down to a trigger 562*d*. This trigger extends out through an opening 182*b* in the side of the upper bar. As the upper bar is pulled up out of intermediate bar 182, the trigger is deflected inwardly as it passes through a spacer bushing 564 at the top of the intermediate bar. After it passes the spacer bushing it snaps back out through opening 182*b*. The upper bar is held in an extended position, as shown in FIG. 70, by the seating of trigger 562*d* on the top of spacer bushing 564.

Figure 63:
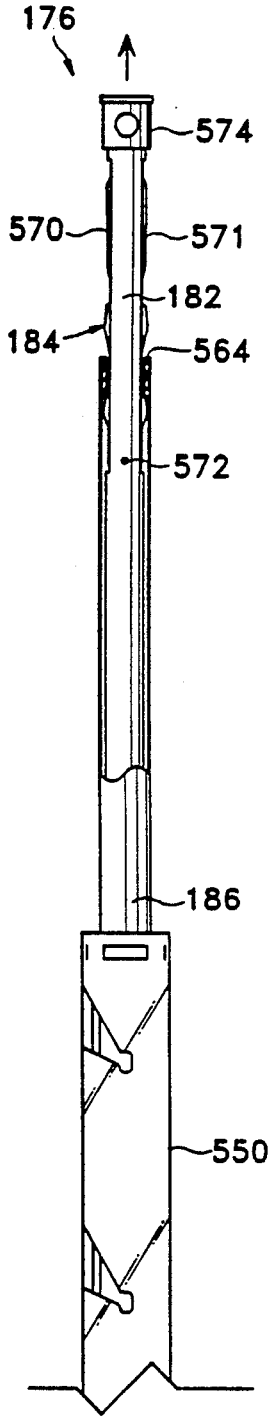
FIGS. 63, 64 and 65 are partial views of the equipment support assembly of FIG. 59 in stages of setup.
Figure 65:
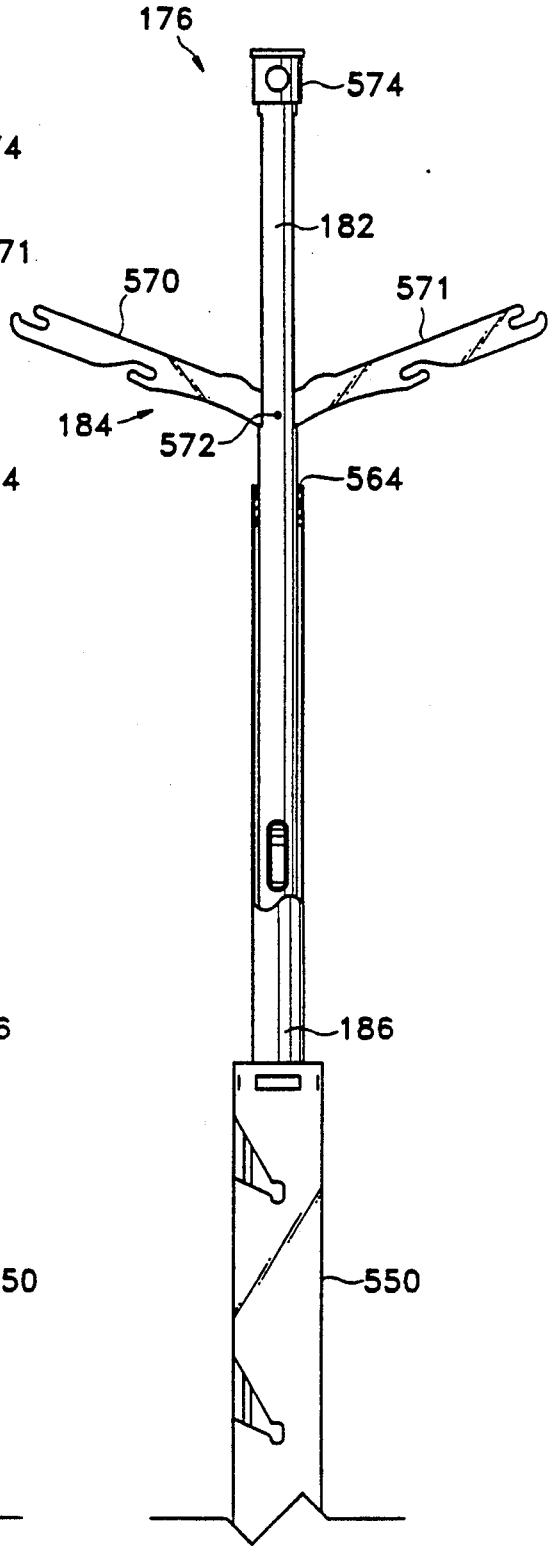

As has been mentioned, mounted in the top of upper rod 182 is equipment support apparatus 184. The upper end of rod 182 has a slot 182*a* that receives opposing, generally planar, equipment support arms 570 and 571. These arms are mounted to rod 182 for pivoting about a pivot rod 572 between a storage position in slot 182*a*, as is shown in FIG. 63, and an equipment support position, as is shown in FIGS. 2, 59 and 65. The distal ends of the arms have an upwardly opening slot 570*a* and 571*a*. At an intermediate location along the underside of the arms are intermediate slots 570*d* and 571*b*. These slots are for supporting various patient related equipment, such as IV bottles.

Figure 66:
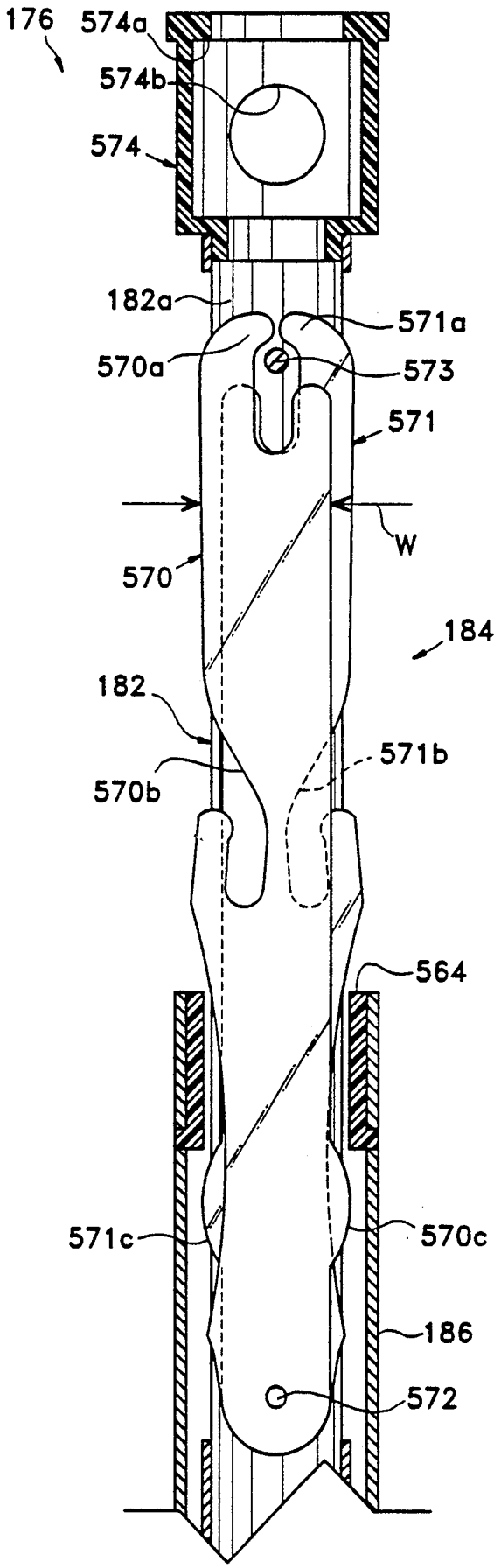
FIG. 66 is an enlarged cross section of the equipment support assembly of FIG. 59.

As is shown particularly in FIG. 66, the distal ends of arms 570 and 571 have a general width W that corresponds to the width of rod 182. The arm distal ends thereby pass through spacer bushing 564 readily. However, curved protrusions 570c and 571c extend outwardly from the sides of the arms opposite from the direction they pivot away from the top of rod 182. These protrusions are sized to engage bushing 564 when rod 182 is lifted out of intermediate rod 186. When the protrusions engage the bushing they are forced into slot 182a, and this forces the tops of the arms out of slot 182a in order to accommodate passage of the protrusions past the bushing.

Figure 64:
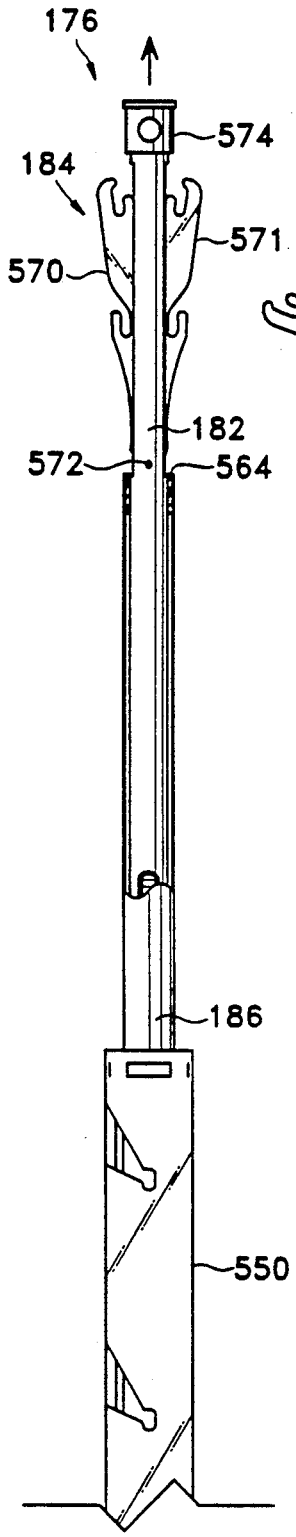

This automatic extension of the equipment support arm ends is illustrated in FIGS. 63–65. In FIG. 63, the tops of the arms, housed in slot 182a have passed through bushing 564, but protrusions 570c and 571c have not contacted the bushing. In FIG. 64, the protrusions have contacted the bushing and have been forced into the slot, thereby moving the tops of the arms out of the slot. The arms are then moved into a full open position, determined by the contact of the arms on the lower edge of the slot, by gravitational or manual pull to the position shown in FIG. 65.

As is shown in FIG. 66, when arms 570 and 571 are returned to their storage position, a limit pin 573 prevents the arms from pivoting past the vertical position.

It will also be noted that the very tip of upper rod 182 has a hollow cylindrical handle 574 mounted to it. This handle also preferably has in inward directed upper lip 574a and opposing holes 574b and 574c. The lip and holes provide means for gripping the top of rod 182 with a finger when the handle is in a storage position flush with or below the top surface of the headboard, as is shown in FIGS. 56 and 57.

5. Weight-Sensing System

FIGS. 71–78 illustrate weigh system 133. The mechanical structure is shown in plan view in FIG. 71. Weigh frame 132 is shown supported on base frame 142. The weigh frame is formed of structural members 138 and 140 forming a wishbone shape that extends from central support 134 at the head of the bed to lateral supports 135 and 136 at the foot of the bed.

Figure 72:
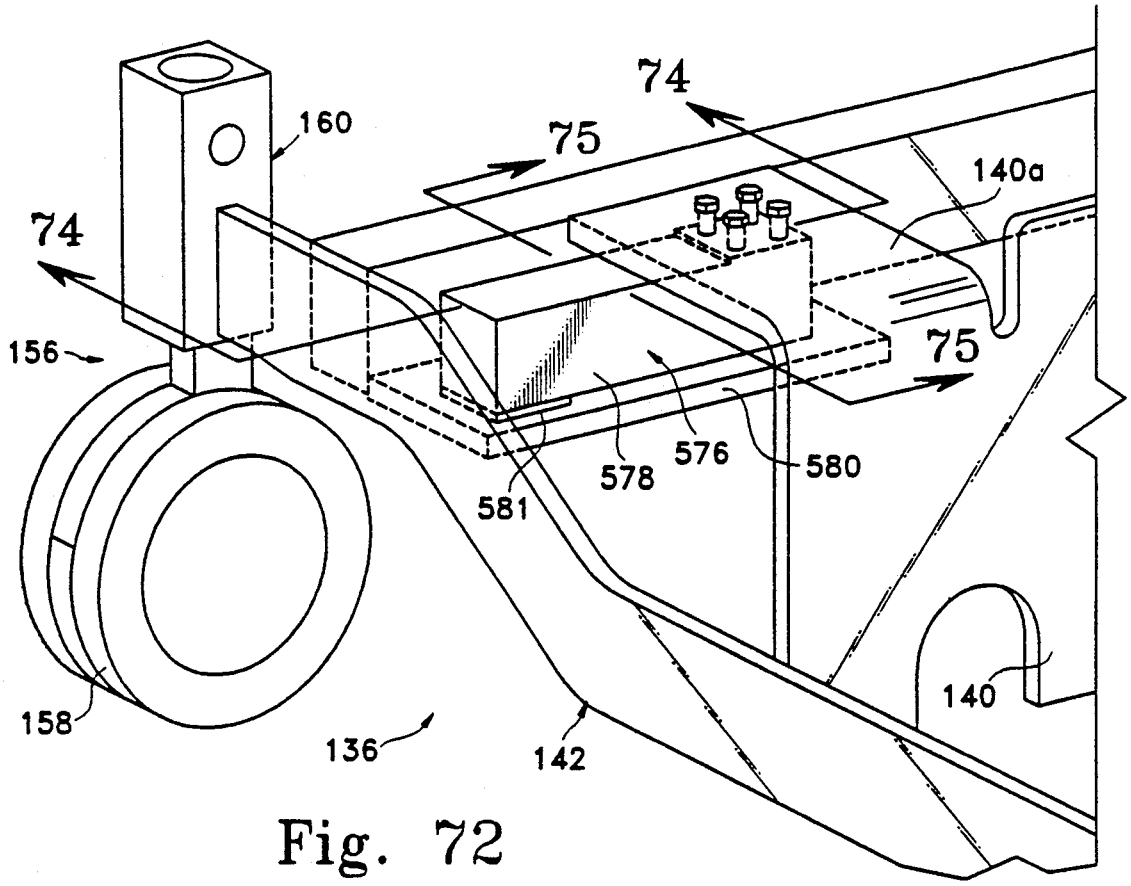
FIG. 72 is a simplified isometric of a corner of the base and weigh frames of FIG. 71 showing of a single weight-sensing load cell used between the weigh frame and base frame.
Figure 73:
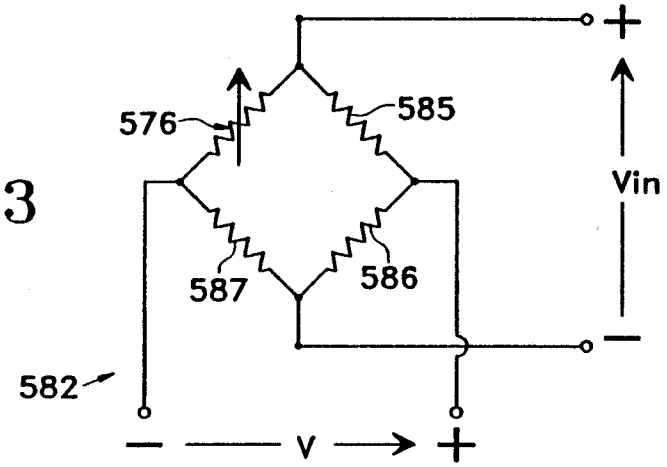
FIG. 73 is a circuit schematic illustrating the electrical structure of the load cell of FIG. 72.
Figure 74:
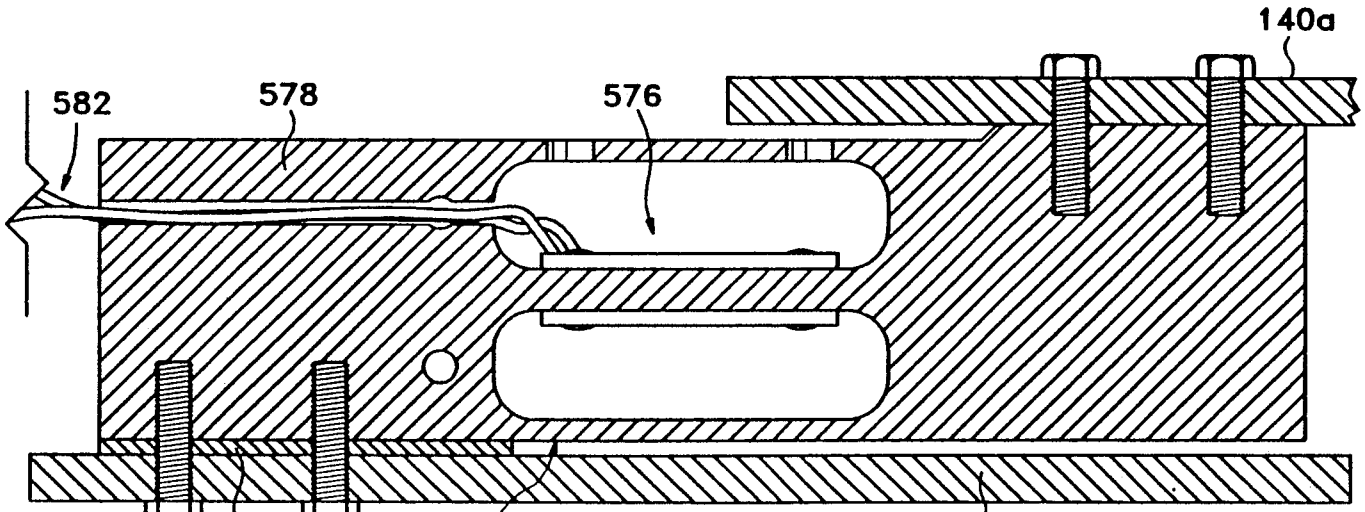
FIG. 74 is a partial cross-section taken along line 74—74 in FIG. 72.
Figure 75:
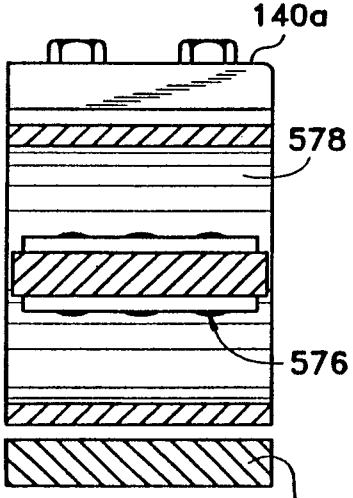
FIG. 75 is a partial cross-section taken along line 75—75 in FIG. 72.

Each support includes a load cell 576 mounted in a block 578, as is shown in isometric view in FIG. 72 and in cross-section along lines 74—74 and 75—75 in FIGS. 74 and 75, respectively, for lateral foot support 136. Block 578 is elongate and is supported at one end on a base plate 580 and a shim 581 by suitable bolts. The other end supports a wing 140a of the structural member, as shown. The load cell is mounted centrally in the block, with conventional structure to generate an electrical signal on wires 582 representative of the weight supported by the block. The generation of the weight signal is based on a bridge network having fixed resistors 585, 586 and 587. The load cell acts as a variable resistance. The driving voltage is shown as Vin. The sensed output voltage is Vout.

Figure 76:
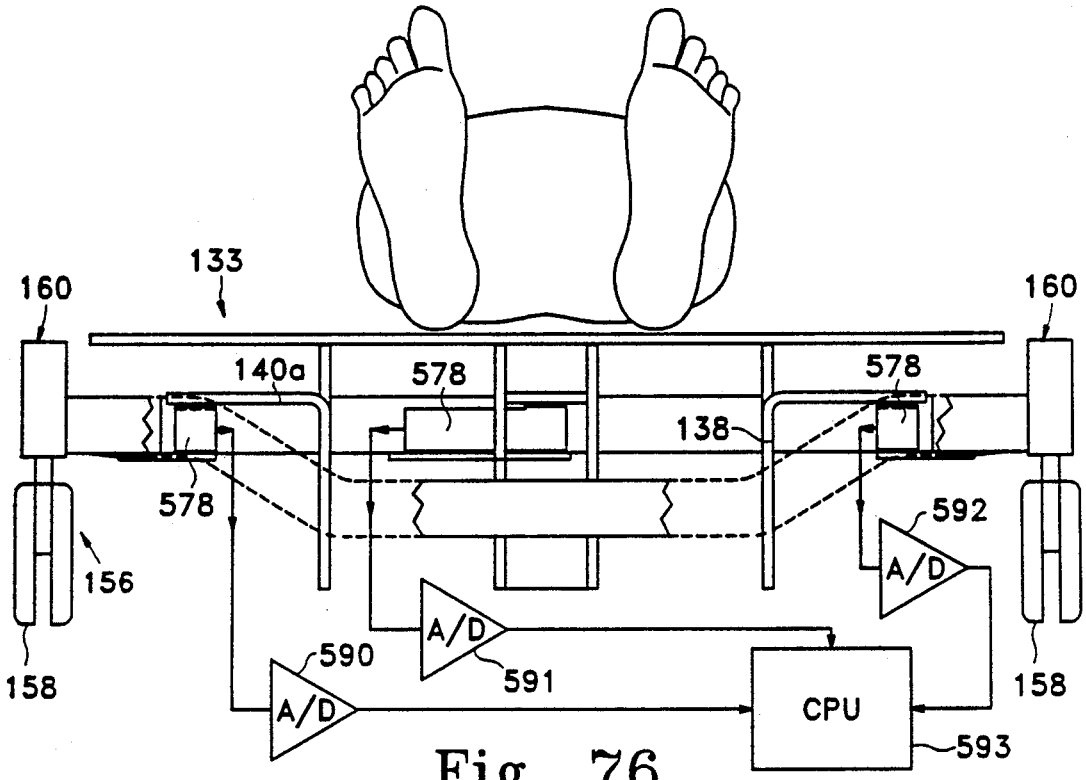
FIG. 76 is a simplified illustration of the weigh system of the invention.

FIG. 76 shows in a simplified, symbolic drawing the overall structure of weigh system 133. The load cells associated with each of supports 134, 135 and 136 generate separate signals that are input to respective analog-to-digital converters 590, 591 and 592. The separate digital weight signals are then input into a computer or CPU shown generally at 593.

Figure 77:
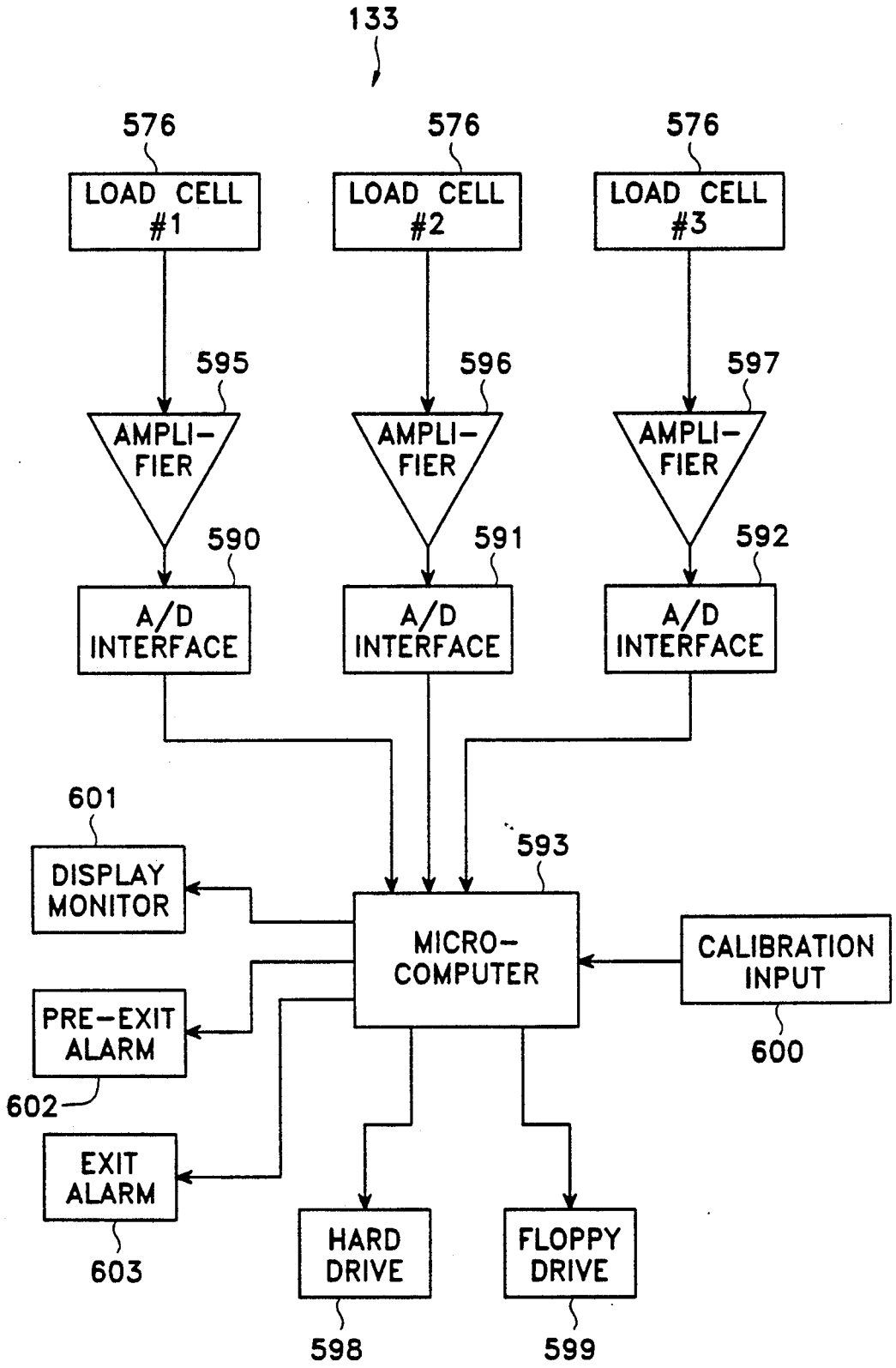
FIG. 77 is a block diagram of the weigh system of FIG. 71.

A more detailed diagram is shown in FIG. 77. This diagram shows an amplifier 595, 596 and 597 coupling the load cell of each support to the respective A/D converter. CPU 593 is connected to various accessories, including memory devices, such as hard and floppy disk drives 598 and 599. An input device 600, such as a keyboard, is used to input calibration information. A monitor display 601 provides a visual display of data and instructions for inputting calibration data. Based on movement of the patient, as described below, the CPU generates a pre-exit alarm and an exit alarm on output devices 602 and 603.

Figure 78:
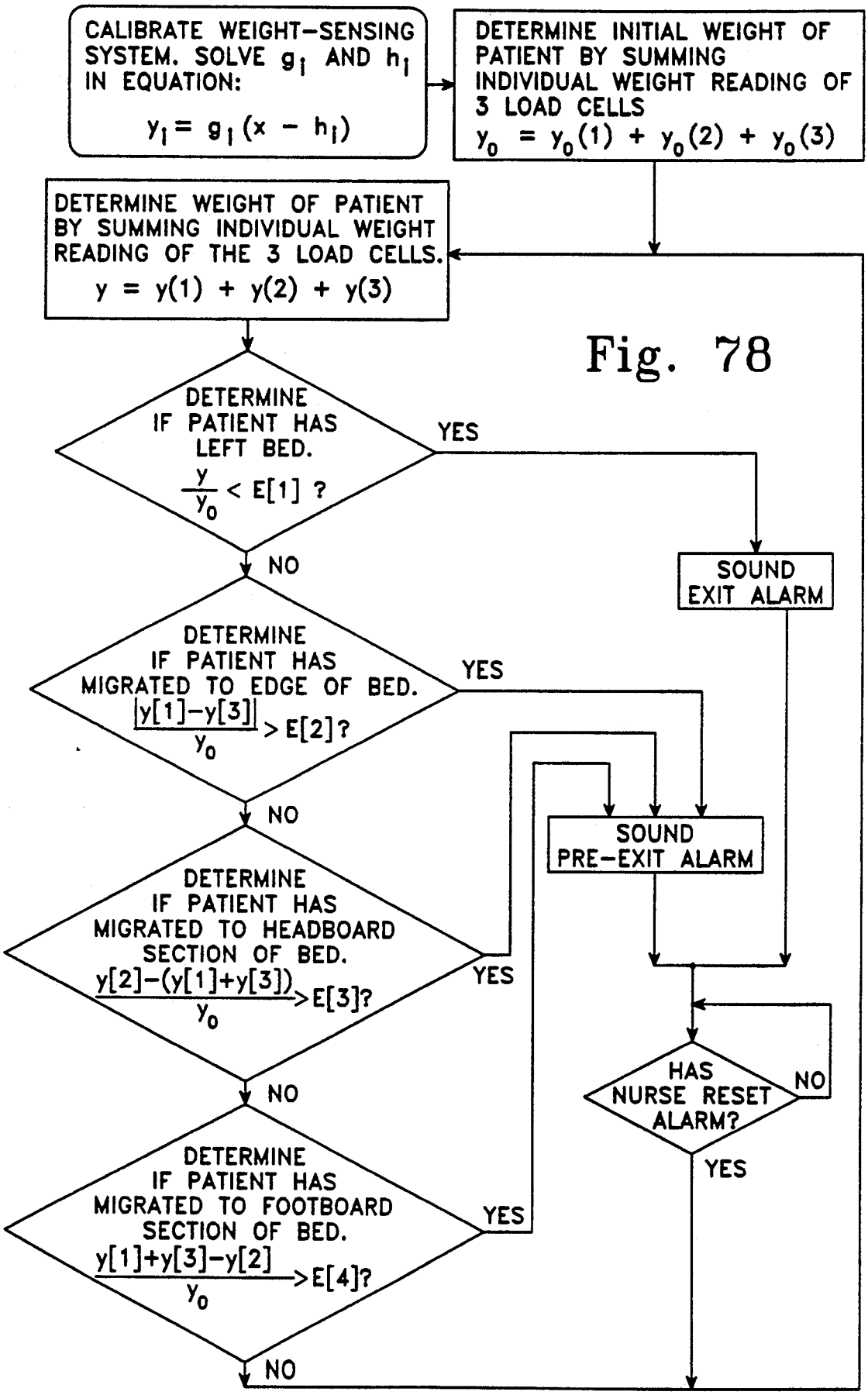
FIG. 78 is a flow-chart illustrating operation of the weigh system of FIG. 71.
Figure 79:
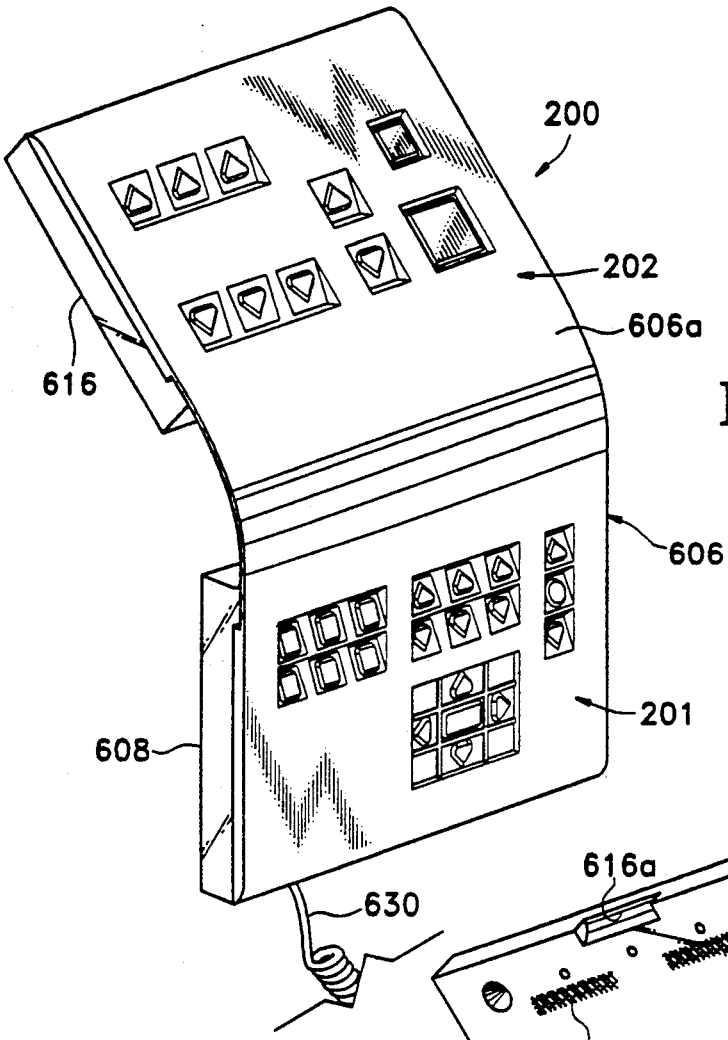
FIGS. 79 and 80 are isometric views of different sides of a saddle-bag controller made according to the invention.
Figure 80:
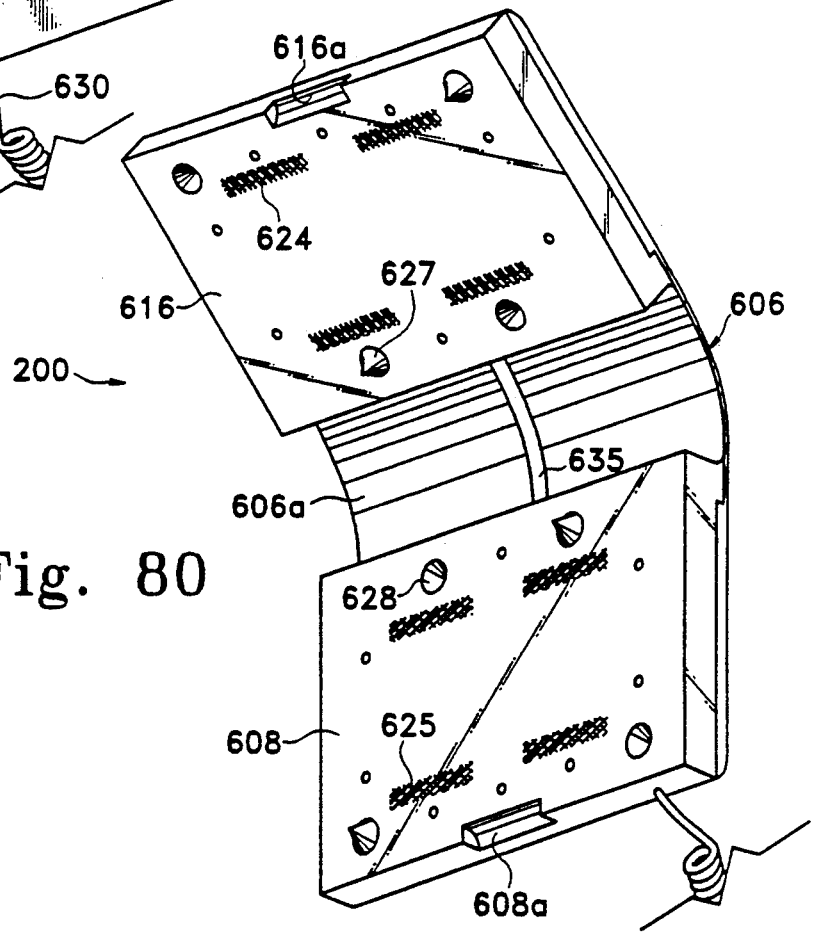

The operation of weigh system 133 is provided in FIG. 78. When the bed is first installed the weigh system is calibrated by placing a standard weight at three spaced-apart locations on the mattress. The mattress should be placed in a horizontal orientation in order to avoid unusual torques on the load cells. The locations are arbitrary, but for the best results they should be as far apart as possible. In each instance, the total weight equals the sum of the weights read by the three sensors. The basic equation for each sensor is $$y[i]=g[i](x-h[i]) \tag{1}$$

where y=patient weight, x=the A/D converter output, and g[i]and h[i] are constants. In words, x is a sensed value proportional to the total weight sensed by the load cell, h[i] is the sensed value corresponding to the weight of the bed without a patient, and g[i] is a constant to convert the digital signal into a weight unit of measure, such as pounds.

Initially, then, three equations are formed by removing all patient loading. The three equations are $$0=g[1](x[0,1]-h[1]) \tag{2}$$

$$0=g[2](x[0,2]-h[2]) \tag{3}$$

$$0=g[3](x[0,3]-h[3]) \tag{4}$$

These equations reduce to $$h[1]=x[0,1] \tag{5}$$

$$h[2]=x[0,2] \tag{6}$$

$$h[3]=x[0,3]. \tag{7}$$

With a standard weight applied to the three locations, three more equations are derived based on the equation for total sensed loading (patient) weight $$y=y[1]+y[2]+y[3]. \tag{8}$$

The three resulting equations are $$y=\sum_{i-1}^{3} g[i](x[1,i]-h[i]) \tag{9}$$

$$y=\sum_{i-1}^{3} g[i](x[2,i]-h[i]) \tag{10}$$

$$y=\sum_{i-1}^{3} g[i](x[3,i]-h[i]) \tag{11}$$

where x[j,i] for j,i=1,2,3 are the respective A/D converter readings and y is the standard weight.

Using a standard Gauss-Jordan or other appropriate elimination method, equations (5)–(7) and (9)–(11) are solved to obtain values for g [1], g [2], g [3], h [1], h[2], and h [3].

When a patient is initially put in the bed, the patient's weight is measured and set equal to $y_0$. Thereafter, the dynamic weight of the patient, y, is measured. In determining if the patient has left the bed, the ratio of measured weight to original weight is determined and compared to a constant E[1], which is some value less than one, such as 0.75. This value can be adjusted to make the system appropriately sensitive. It should not be set to activate the exit alarm if the patient momentarily unweights the bed, such as by shifting position or holding on to the guard rails or traction equipment.

While a change in total weight flags an exit condition, a change in weight distribution flags a pre-exit condition, such as a patient positioned next to a side or end of the bed. If the patient is lying in the middle of the bed, $y[1] \approx y[3]$, or $y[1]-y[3] \approx 0$ where y[1], and y[3] correspond to the two laterally spaced load cells at the foot of the bed. If the patient moves to the left or to the right, $y[1]-y[3] <> 0$. Thus, a pre-exit condition exists when $$\frac{|y[1] - y[3]|}{y_0} > E[2] \tag{13}$$

where E[2] is a constant nominally set to 1.00, and adjusted to make the system more or less sensitive. Although logic would seem to indicate that the constant should have a value less than 1.00, since some of the weight will be on the head load cell, i.e., $y[2] > 0$ experience indicates that the dynamics of the system require the value suggested.

If desired other pre-exit conditions could be determined. For instance, if the patient approaches the head of the bed, y[2] increases and y[1] and y[3] decrease. Thus, a further pre-exit condition exists:

$$\frac{y[2] - (y[1] + y[3])}{Y_0} > E[3] \tag{14}$$

If the patient approaches the foot of the bed, y[2] decreases and y[1] and y[3] increase. The corresponding pre-exit condition is $$\frac{y[1] + y[3] - y[2]}{y_0} > E[4] \tag{15}$$

When the mattress is articulated, the center of mass of both the bed and the patient move. It may be desirable to alter the values of the constants corresponding to the configuration of the articulated bed, although this has not been determined at the time of this writing.

After a pre-exit or exit alarm has sounded, the system preferably waits for the nurse or other attendant to reset the alarm. This requires an acknowledgement that the alarm has occurred. Once reset, the system returns to a monitoring procedure until the next alarm condition is identified.

6. Bed Control Unit

FIGS. 79–86 illustrate the structure of portable "saddle-bag" controller 200. Outer, nurse-operated, and inner, patient-operated control panels 201 and 202 are formed in a unitary, resilient membrane 606. Panels 201 and 202 are coupled together by a support portion 606*a*. Mounted behind panel 201 is a housing 608 containing a circuit board 610 on which are mounted LEDs 612 and other conventional circuit components, not shown. The circuit board includes an embedded metallic ground plane 614. Similarly, behind panel 202 is mounted a housing 616, also enclosing a circuit board 618 with LEDs 620 and embedded ground plane 622.

Figure 81:
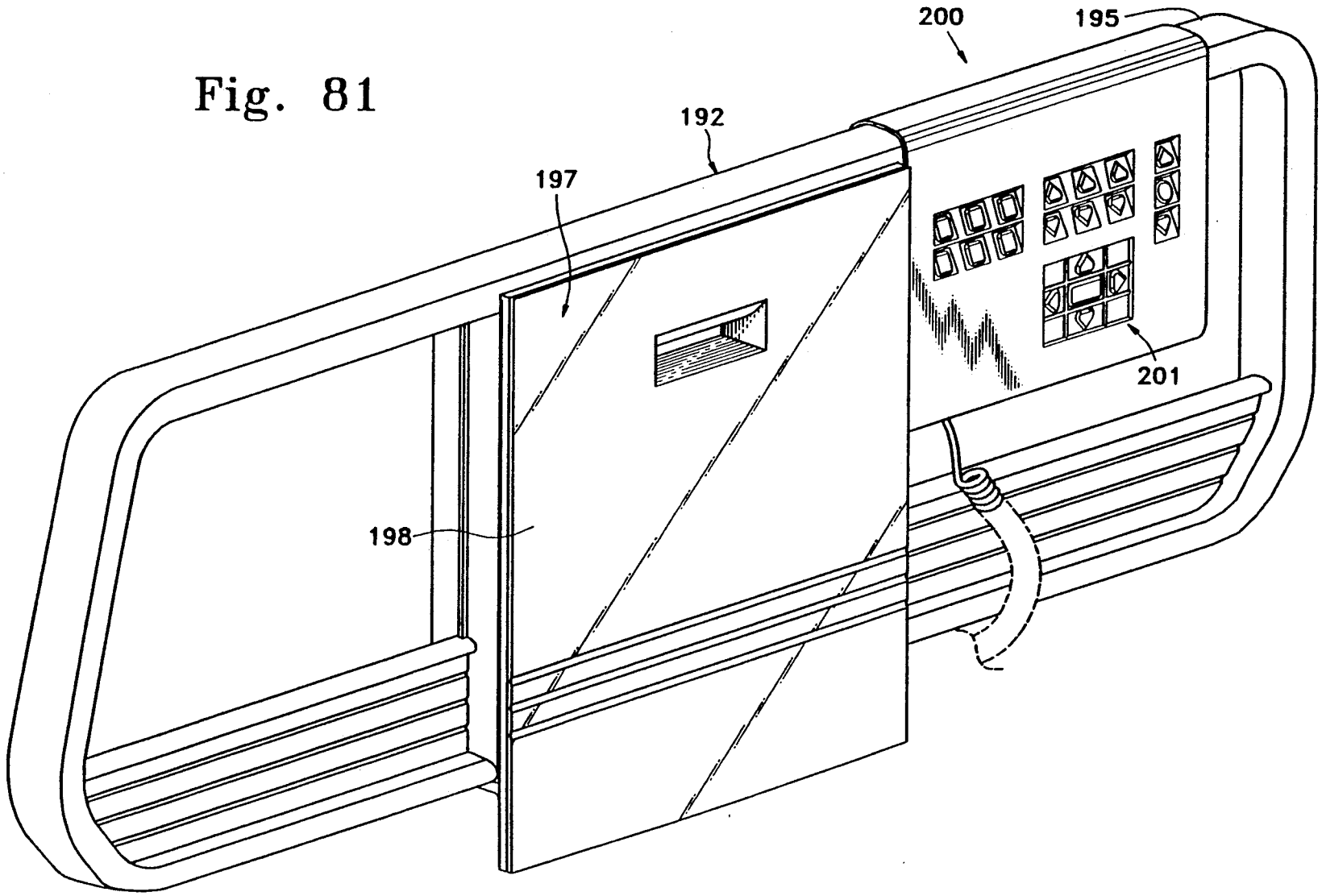
FIG. 81 is an enlarged isometric view of the saddle-bag controller of FIG. 79 installed on a guard rail.

The backs of housings 608 and 616 have hook-and-loop fabric strips, such as strips 624 and 625 that hold the housings together when placed around a guard rail, such as rail 195 shown in FIG. 81.

The housing backs also have mating cones and cavities, such as cone 627 and cavity 628. This provides for alignment of the housings when they are folded against each other. The outer edges of the housings also preferably have recesses 608*a* and 616*a* to provide a place to grip the housings when it is desired to separate them. Also disposed along the side edges are channels, such as channels 608*b* and 616*b* shown in FIG. 86. This figure shows a view of the top of controller 200 when mounted on a rail, with a fragmentary section removed to show the structure adjacent to the guard rail.

Channels 608*b* and 616*b* receive a corresponding ridge 195*a* in the guard rail for preventing pivoting of the controller when buttons are pushed. If membrane 606 requires sufficient stretch when the controller is positioned on a guard rail, the resulting friction grip has been found to adequately support the controller without engaging ridge 195*a*. A control and power cord 630 joins outer housing 608 to the bed CPU.

Outer panel 201 has a plurality of flexible control buttons, such as button 632. Similarly, inner panel 202 has buttons, such as button 634. When pressed, these buttons have conductive hidden surfaces that contact a conductor array on the corresponding circuit board to function as a switch using well known techniques.

Figure 82:
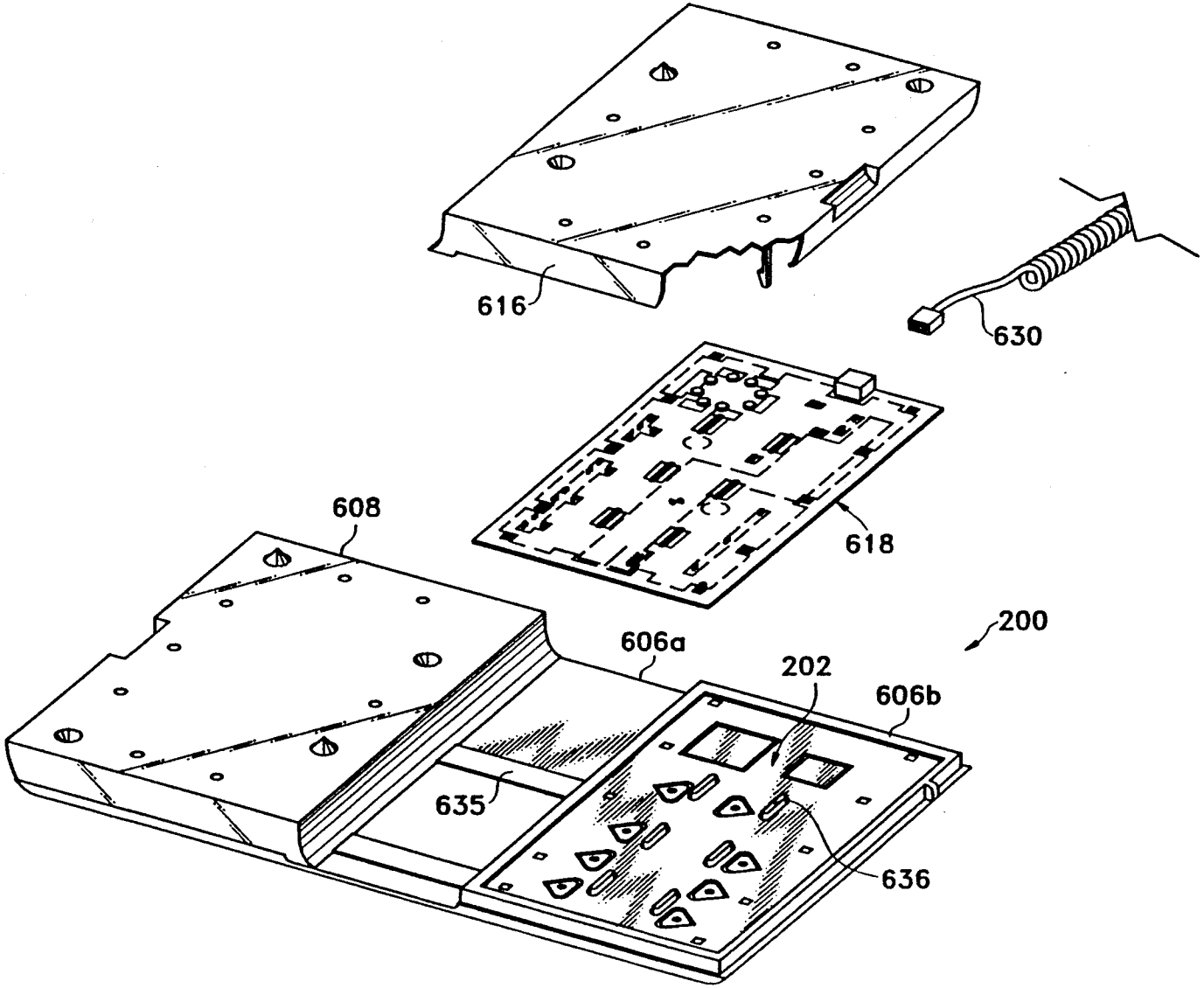
FIG. 82 an isometric exploded, partial fragmented view showing the components of the controller of FIG. 79.
Figure 83:
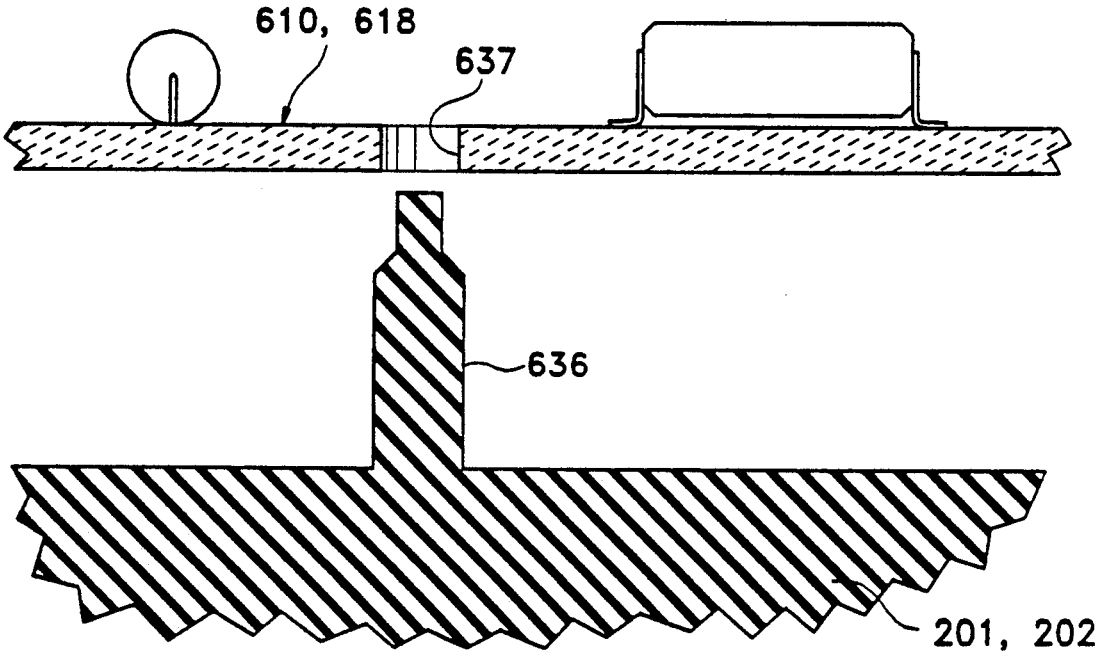
FIGS. 83 and 84 are enlarged, partial cross sections illustrating structure and installation of a circuit board in the controller of FIG. 79.
Figure 84:
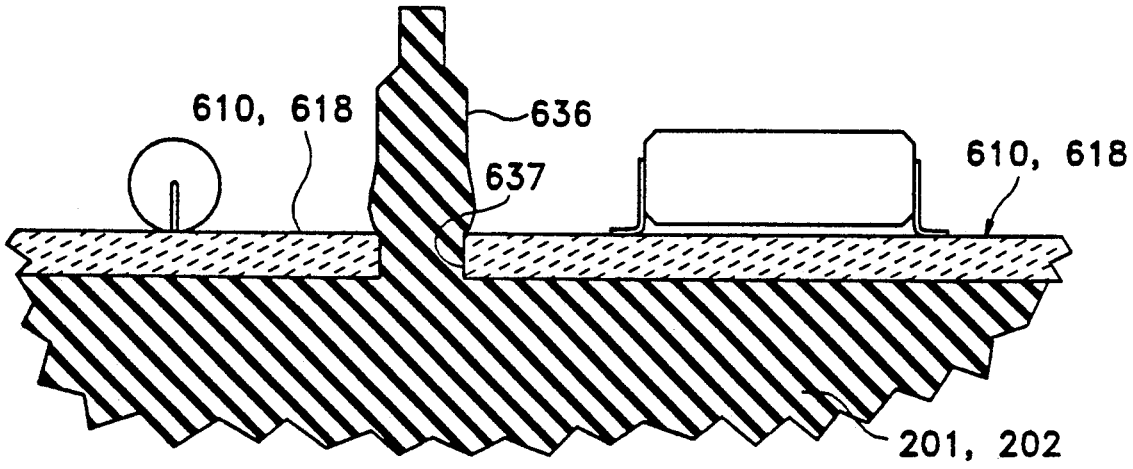

FIGS. 82–84 illustrate how the circuit boards are attached to membrane 606. FIG. 82 shows an exploded view of the membrane, circuit board 618 and housing 616. The inside surface of the membrane has a plurality of elongate tabs, such as tab 636, that extend toward the circuit board. The circuit board has corresponding slots, such as slot 637, sized to snugly receive the tabs. FIGS. 83 and 84 show the position of the circuit board relative to a tab prior to and after installation.

It is found that if the circuit board side edge is positioned under the corresponding portion of a lip 606*b* that extends inwardly around panel 202 and then pivoted down, the tabs readily feed into the slots, initially by a top corner, after which they are easily manually pulled through. Conventional cylindrical pillars are found to be very difficult to align with corresponding circular holes in the circuit board. Thus, the circuit board of the invention is substantially easier to install.

Figure 85:
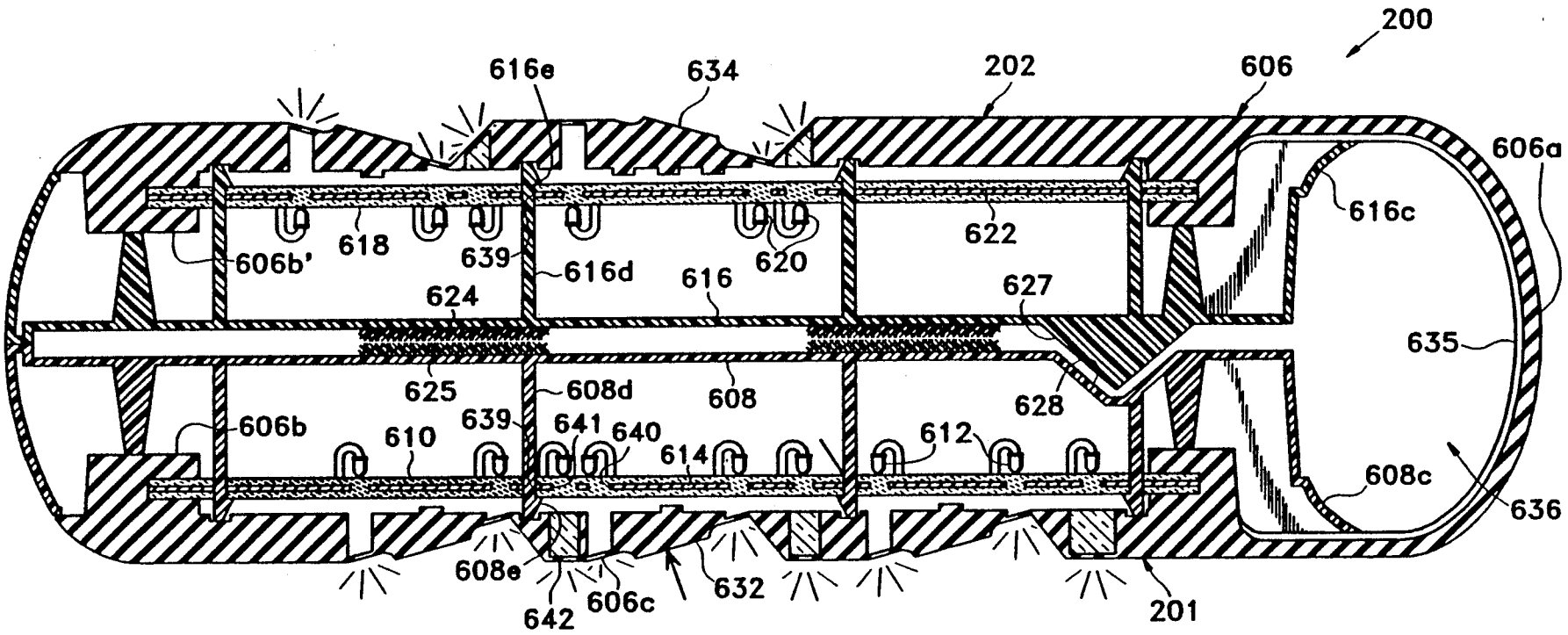
FIG. 85 is a cross-section of the controller of FIG. 79.
Figure 86:
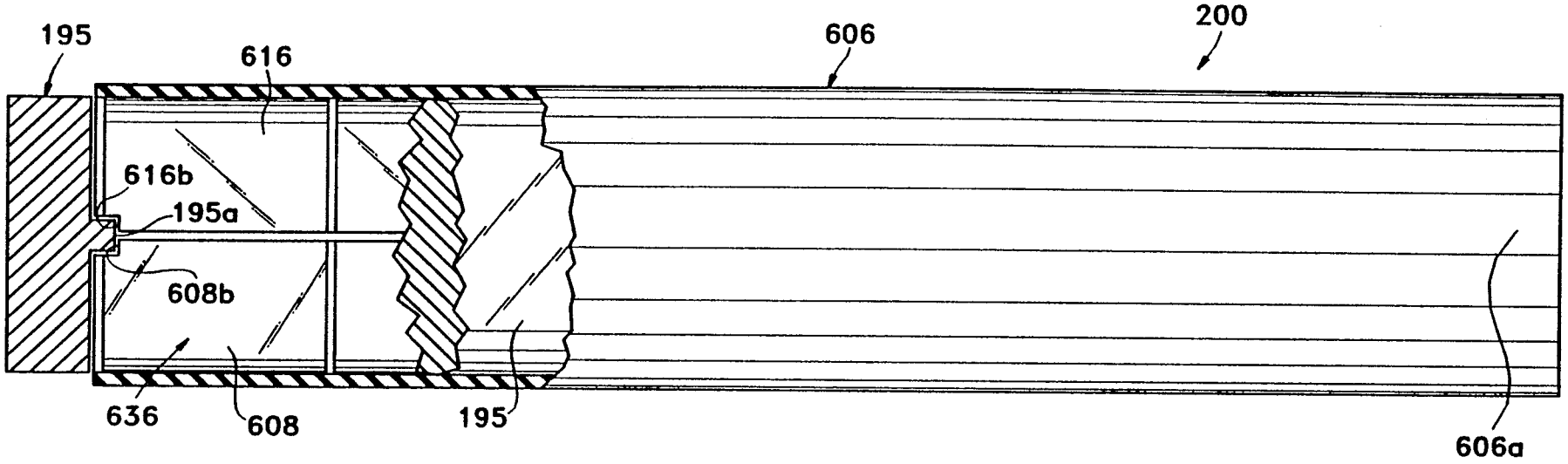
FIG. 86 is a top view of the controller of FIG. 79 when installed on a guard rail with a partial fragmented cut away section.

FIG. 85 shows a simplified cross-section of controller 200 in a folded position, as it would appear when wrapped around a guard rail. An electrical conductor ribbon 635 wraps around the arch formed by support portion 606*a*. Preferably the stretch has a channel formed in it to accommodate this conductor ribbon. The upper margins 608*c* and 616*c* of the housings adjacent to the support stretch are arched to form, with the stretch, a channel 636 conforming to the curve of the guard rail.

The housings are fastened to membrane 606 by legs, such as legs 608*d* and 616*d* having tapered feet 608*e* and 616*e*, respectively, that snap into corresponding apertures 638 and 639 in the respective circuit boards. The outer housing margin is pulled against the outer surface of lip 606*b* to form a seal.

Light is transmitted from LEDs mounted on the circuit boards in two ways. In both ways, openings, such as openings 640 and 641, exist in the ground plane of the circuit board. LEDs are mounted on the protected inside surface of the circuit board adjacent to the rigid housing. The light passes through the circuit board and associated openings, which results in diffuse light being directed toward membrane 606.

In positions corresponding to the LEDs and associated button, the membrane is formed as a bridge, such as bridge 606c. These bridges serve three functions. They support the button in suspension over the circuit board; they are flexible, allowing the buttons to be pressed against the circuit board; and by the thinness of them, light from the LEDs is transmitted through them, illuminating the margins of the buttons.

Illumination of legends on the membrane are provided by the same circuit board structure. However, instead of leaving the membrane thin, since flexibility is typically not desirable in these locations, a relatively rigid and transparent plastic filler, such as filler 642, as a backing to support the otherwise flexible bridge. In this way, the continuity of the membrane is maintained, while providing illumination in rigid regions.

7. Bed Transport Guide Wheels

FIGS. 87-90 illustrate guide wheel assembly 162. There is a guide wheel assembly on each side of the bed, and they are connected together by actuator rod 163, manually controlled by foot pedal lever 164. As is conventional, lever 164 has opposing pedals 644 and 645 used to move a guide wheel 646 from a storage position shown in FIG. 87, to an engaged position shown in FIG. 89. The guide wheel is mounted to a support rod 648 extending slidingly through an opening 650a in a flange 650b of a wheel mounting frame 650. The top of the rod passes through a second opening 650c in an upper flange 650d. Flange 650d has a mass sufficient to counter the weight of wheel 646 when the wheel is in the storage position. A disk 652 is attached to the rod between flanges 650b and 650d. A compression spring 653 is positioned around rod 648 and between disk 652 and flange 650d. The spring urges disk 652 toward flange 650b, and thereby, urges wheel 646 toward flange 650b, and thereby toward the floor when the wheel is in the engaged position.

Wheel mounting frame 650 is coupled to actuator rod 163 via a mechanical linkage system 654 connected to an arm 650e subtending from flange 650b toward wheel 646. A sleeve 656 is connected to the back of wheel mounting frame 650 and receives actuator rod 163 for pivoting of the guide wheel thereabout.

A wheel link 658 is pivotally attached at a pivot pin 659 to the bottom of arm 650e. The opposite end is attached at a pivot pin 657 to a generally triangular coupling plate 660 pivotally mounted by pivot pin 661 to bed frame side rail 152. A spacer block 662 is fixedly mounted to the bed rail between plate 660 and the rail, and has a sloping surface 662a with a rounded bulge 662b. A tension spring 663 is connected at one end to pivot pin 657 and at the other end to a mounting pin 667 fixedly attached to the distal end of spacer block 662. A connecting link 664 also is pivotally connected at a pivot pin 665 to a third point on coupling plate 660, as shown, and has a rounded recess 664a conforming with rounded bulge 662b.

The opposite end of connecting link 664 is pivotally attached by a pivot pin 666 to the end of an arm 668a of a V-shaped drive link 668. The base of drive link 668 is fixedly attached to actuator rod 163.

The other arm 668b has a pin 669 attached to it so that it extends outwardly. The pin engages an L-shaped slot 670 in an upstanding arm 671a of a castor-actuating plate 671. Plate 671 has elongate, horizontal slots, such as slot 671b that receive mounting pins 672. Plate 671 thus rides on pins 672 during horizontal movement of the plate during actuation of the guide wheel assembly by pedal lever 164.

The distal ends of plate 671 have a vertical slot 671c. A castor-actuating rod 674 is attached to a radially extending arm 675, the distal end of which is attached to a pin 676 that slides up and down in slot 671c. Movement of rod 674 secures the corner castors, such as castor 678 by means of a castor actuator 679, as is conventionally known, and commercially available.

In operation, the guide wheels are normally stored in the storage position shown in FIG. 87. The counterweight of flange 650d keeps the wheels from swinging down toward the floor and spring 663 is relaxed. Also, in this mode, castor-actuating plate 671 is in the leftmost position, as viewed in the figure, and the V-shaped drive link is in the position shown, with pin 669 in the upper portion of slot 670. Arm 675 is in a position rotated to the left, which locks the castors in position. Connecting link 664 is in an extended position against surface 662a of the spacer block with recess 664a engaged by bulge 662b. Foot pedal lever 164 is in a generally horizontal position.

To engage the guide wheels, pedal lever 164 is rotated clockwise, as viewed in FIG. 87, by applying force to pedal 644. This rotates actuator rod 163 and V-shaped link 668 clockwise. Pin 669 pushes against the side of L-shaped slot 670, sliding castor-actuating plate 671 to the right. This rotates castor rod 674 counterclockwise, freeing the castors to pivot. When arm 668b pivots far enough down, pin 669 slides out of slot 670, and movement of plate 671 stops.

During this movement, coupling plate 660 pivots clockwise, causing frame 650 and guide wheel 646 to pivot counterclockwise, lowering the wheels until they come in contact with the floor. This is an intermediate position in which the wheel support rod 648 is not quite vertically disposed, but in which spring 663 is generally aligned over pivot pin 661.

Figure 89:
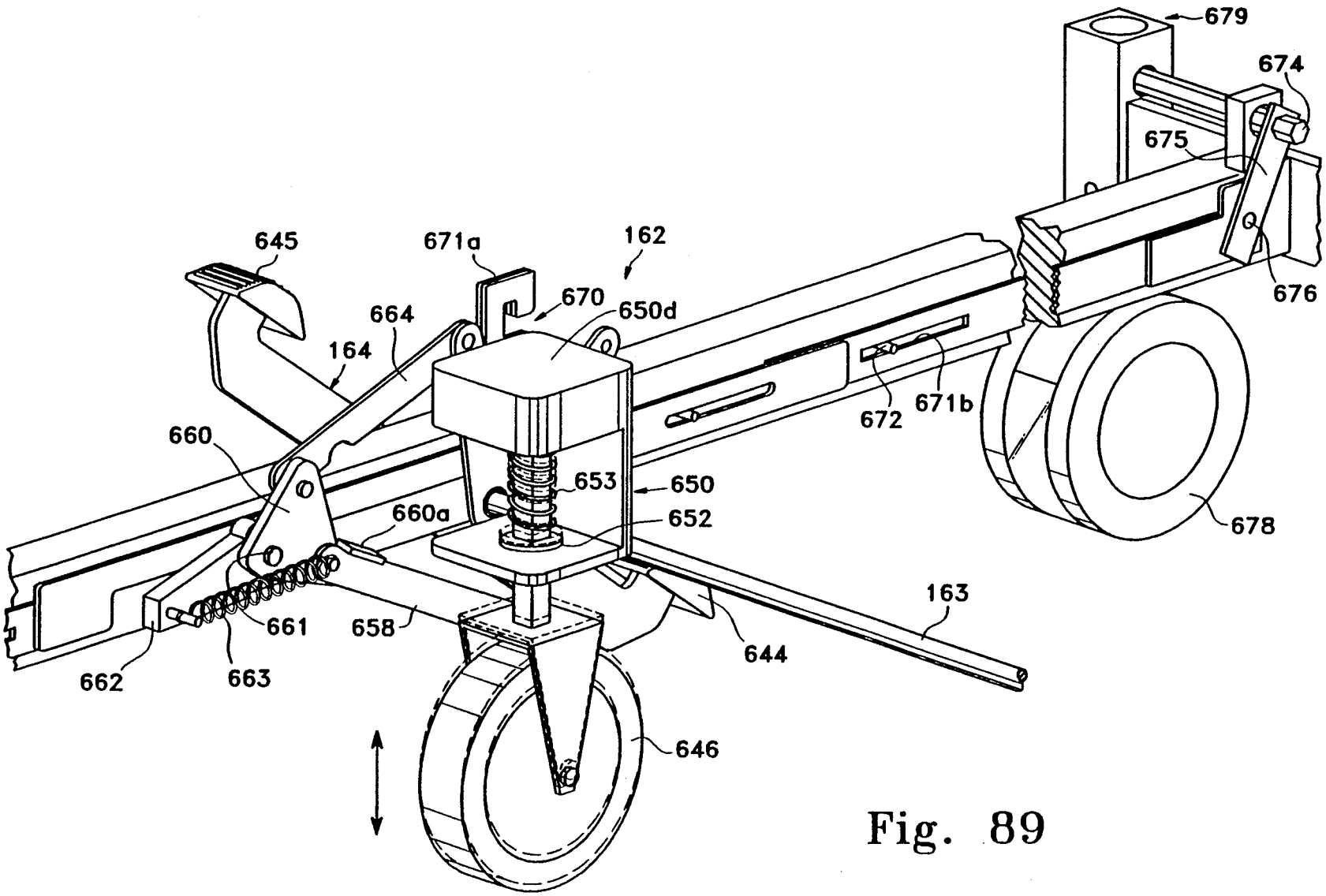
Figure 90:
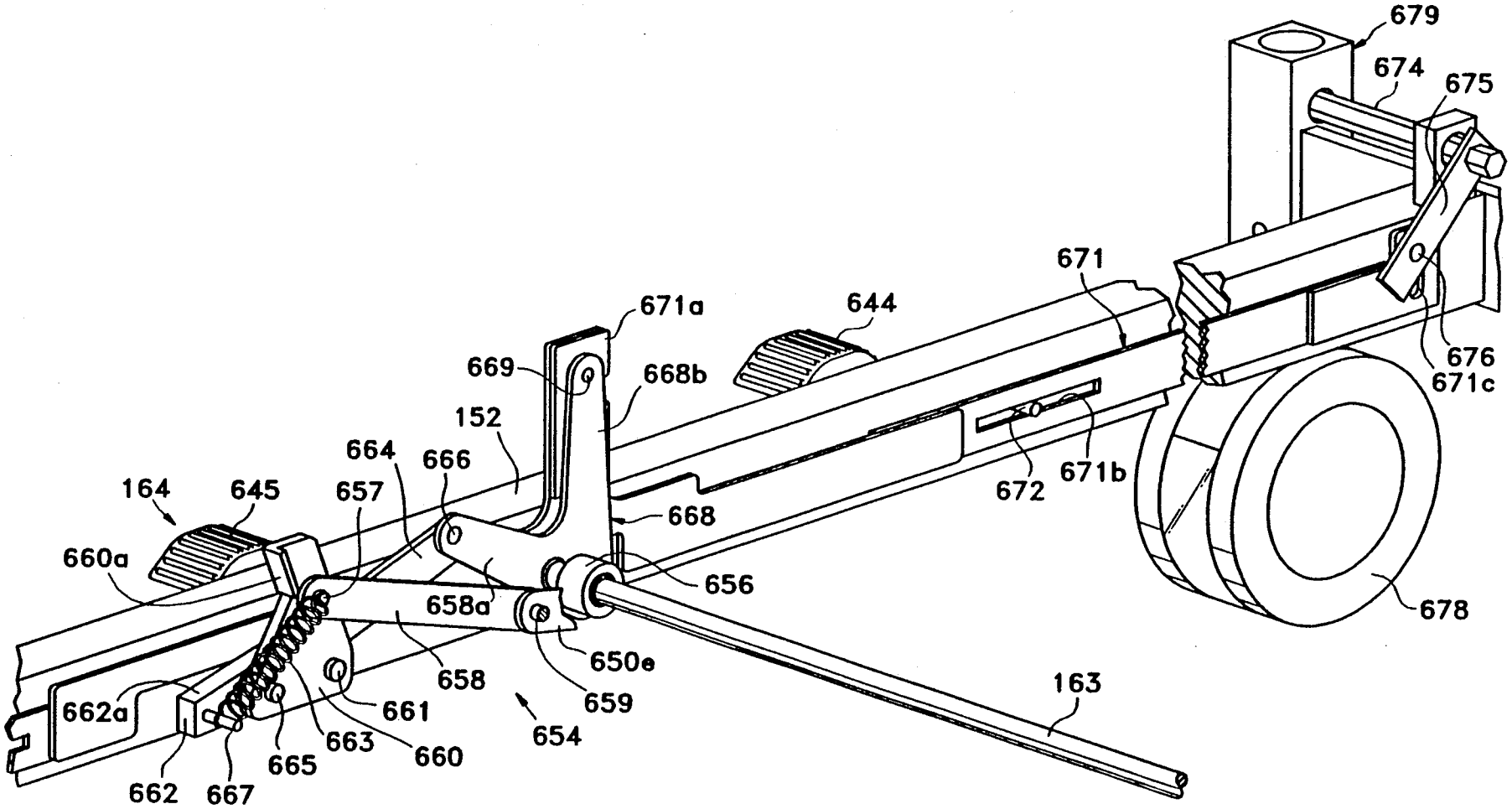
FIG. 90 is a view similar to FIG. 87 with the guide wheel removed to show the linkage assembly of the guide wheel assembly.

As the pedal lever is pushed further, the wheel is rolled along the floor, with the weight of the bed causing spring 653 to compress, so that downward pressure is applied on the guide wheels, and it is maintained in contact with the floor. This assures the traction necessary for guiding the bed while the castors are freewheeling. When this position of the wheel is reached, coupling plate 660 has pivoted further, so that tension spring 663 has moved over pivot pin 661 of the coupling plate, and thereby locks the plate in this position. The spring force and leverage prevents counterclockwise rotation of coupling plate 660, and thereby, raising of the wheel. A boss or flap 660a extends out from the plane of coupling plate 660 so that wheel link 658 engages it and is stopped from further rotational movement in this direction. This final position is shown in FIG. 89. Reverse movement of the pedal lever returns the wheel to the storage position, and locks the castors.

It has been found that movement of a bed having a freely pivoting castor at each corner is very difficult to control, particularly when the bed is moved along straight stretches, such as along a corridor. By adding a fifth wheel and preferably a sixth wheel to the bed frame, which wheels are secured in alignment for motion along the longitudinal length of the bed, the bed is much easier to control.

8. Guard Rail Elevation System

Figure 91:
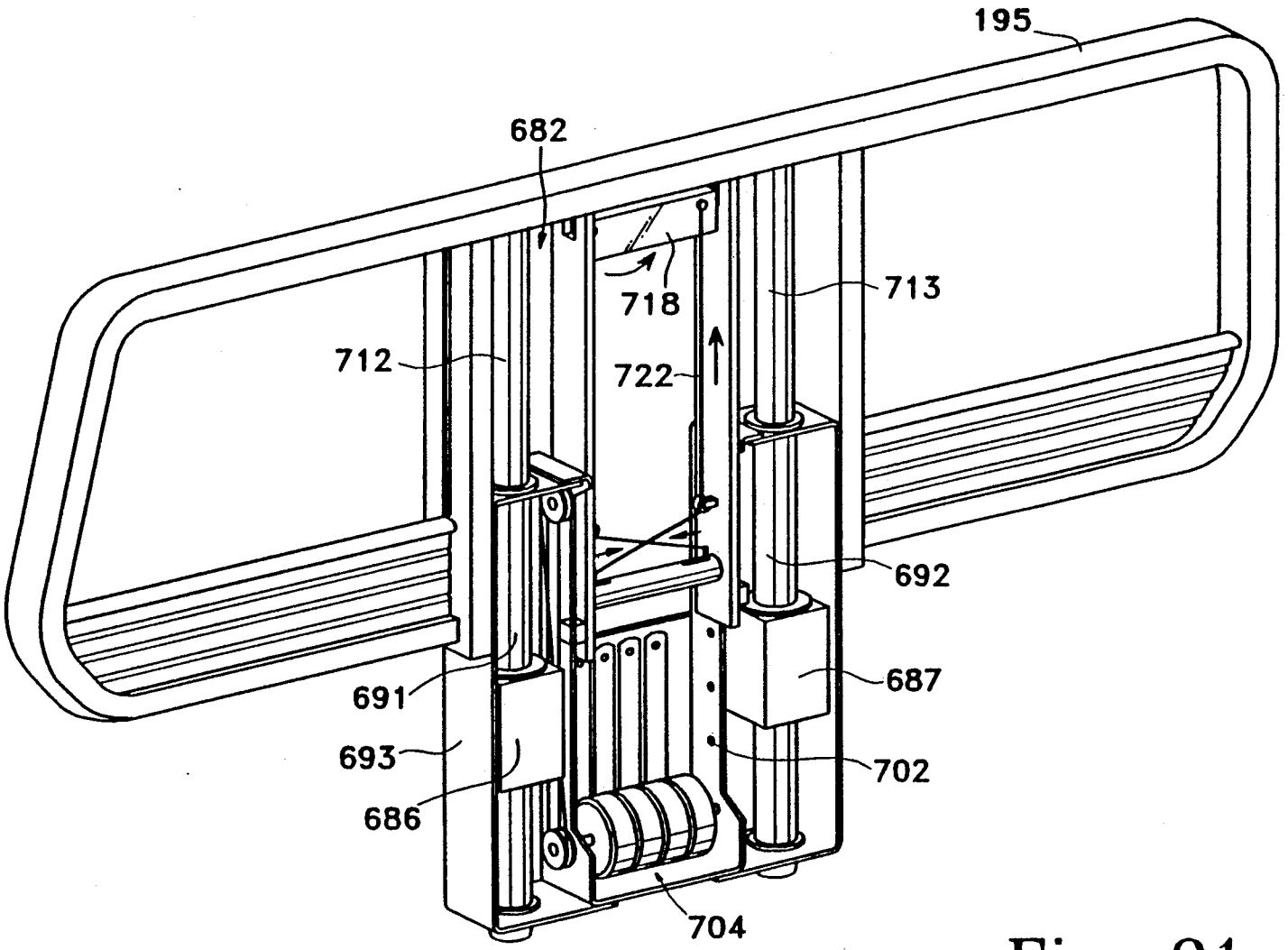
FIG. 91 is an isometric view of a guard rail assembly made according to the invention in an intermediate position.
Figure 92:
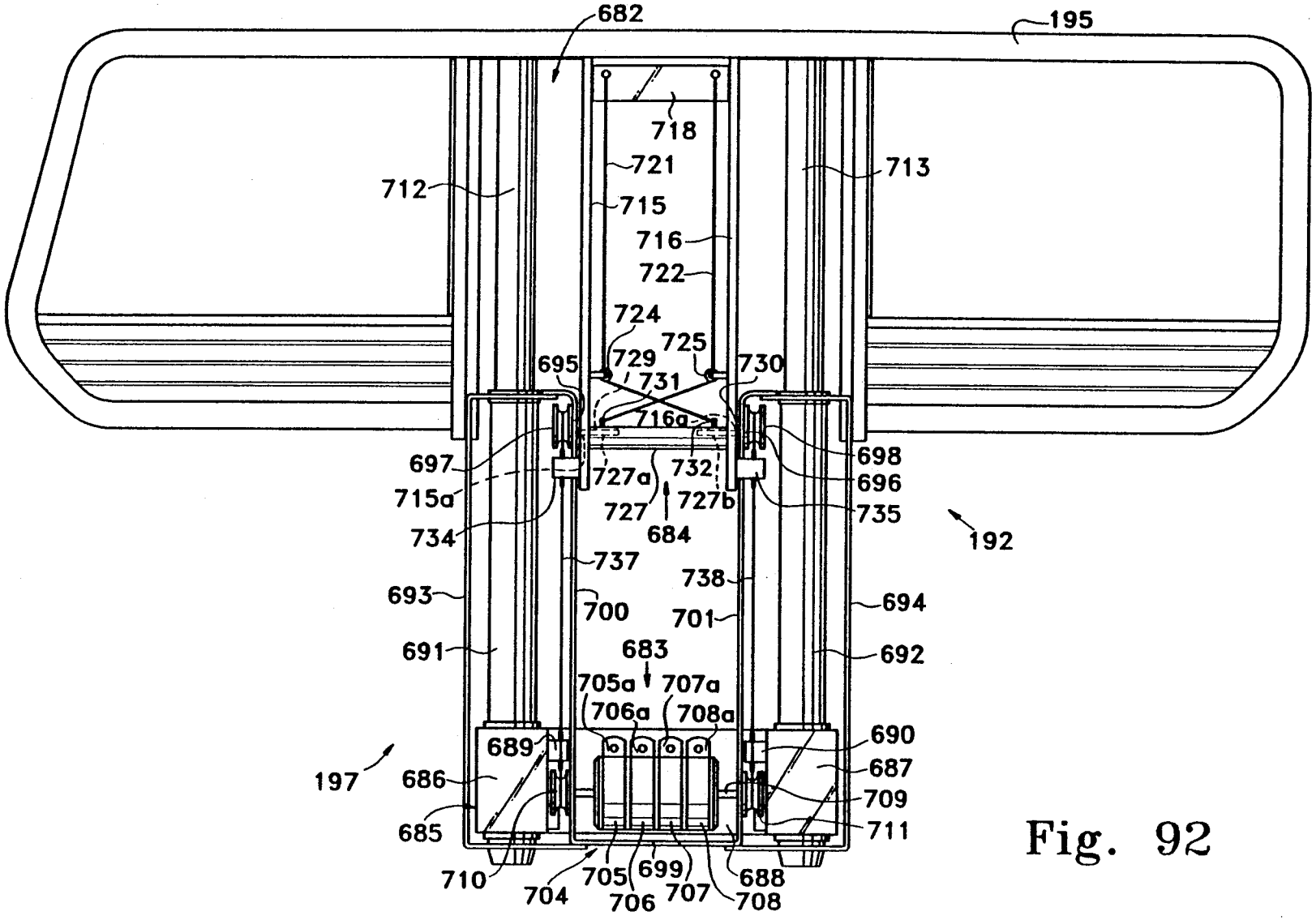
FIGS. 92, 93 and 94 are side views of the guard rail assembly of FIG. 91 in different positions.
Figure 93:
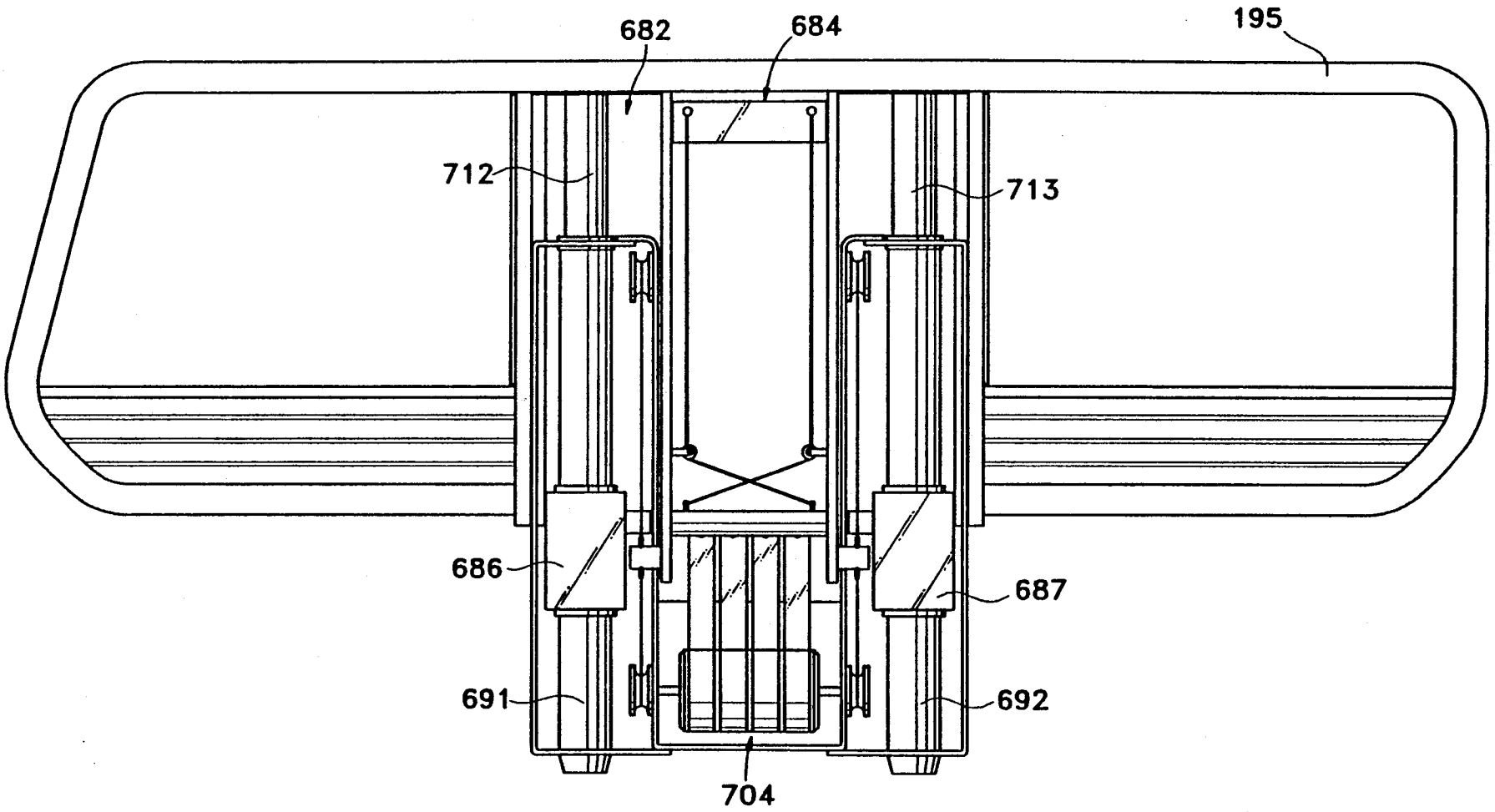
Figure 94:
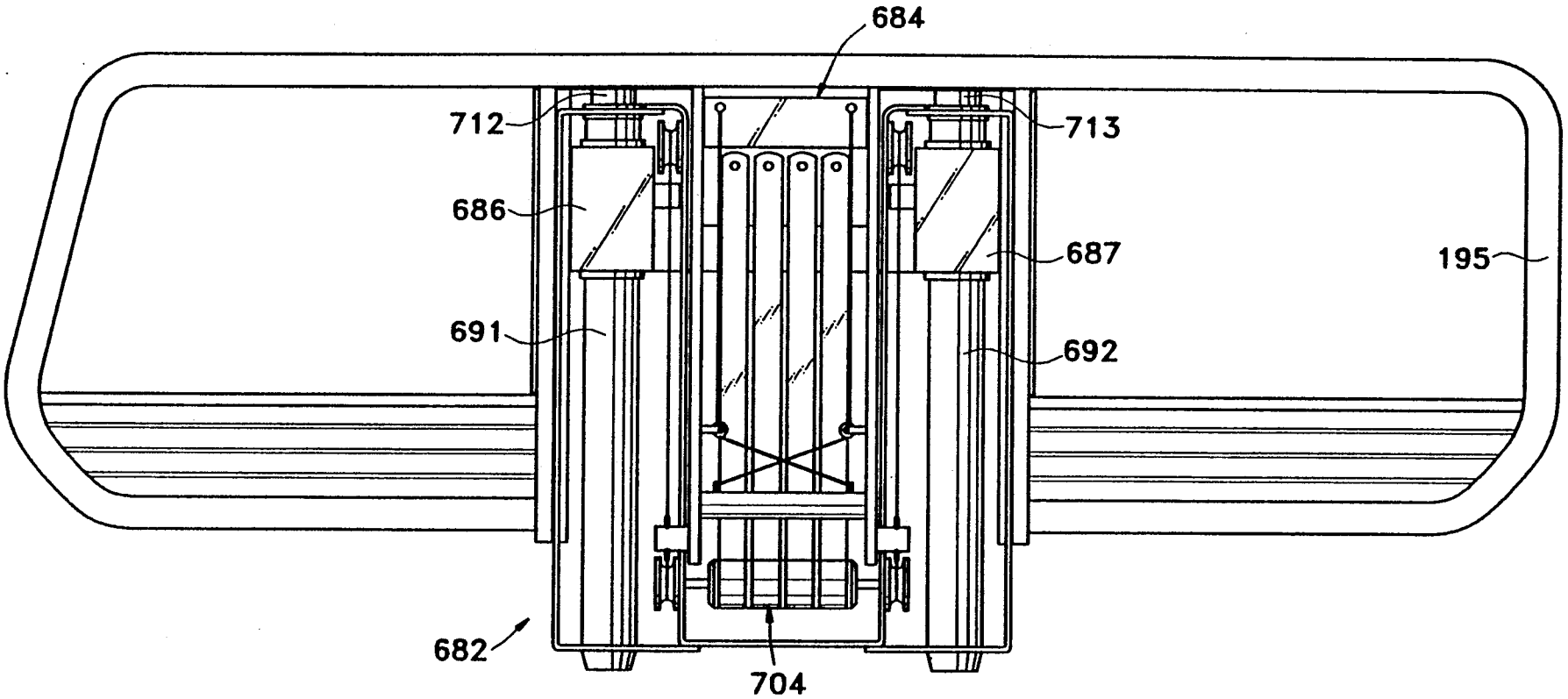

FIGS. 91–94 illustrate guard rail assembly 192 having guard rail 195 and elevator mechanism 197 housed in housing 199 (as is shown in FIG. 1). FIG. 92 shows assembly 192 in a raised or barrier position without housing 199. FIG. 94 shows it in a lowered or storage position, and FIG. 93 shows it in an intermediate position. FIG. 91 is an isometric view of the assembly of FIG. 93.

Mechanism 197 includes a telescoping mounting assembly 682, an energy storage assembly 683, and a lock assembly 684. The telescoping assembly includes a base member 685 fixedly mounted to platform panel 109. Base member 685 includes sleeves 686 and 687, and adjoining plate 688. A pair of cable anchor blocks 689 and 690 are mounted to the outer surfaces of sleeves 686 and 687, respectively, adjacent to plate 688. Hollow, tubular intermediate members 691 and 692 are slidingly received in sleeves 686 and 687. Plate-like stabilizing members 693 and 694 are fixed at each end to the opposite ends of members 691 and 692 and extend there between outside of sleeves 686 and 687.

The inside edges of the upper ends of the stabilizing members have plates 695 and 696 extending downwardly for supporting a first pair of pulleys 697 and 698. The inside edges of the lower ends of the stabilizing members are joined by a plate 699 having upwardly extending bars 700 and 701. These bars have a vertical series of holes, such as hole 702. A set 704 of coil leaf springs 705, 706, 707 and 708 are mounted for rotation about a rod 709 between bars 700 and 701. The ends 705*a*, 706*a*, 707*a* and 708*a* are mounted to plate 688, as shown. A second pair of pulleys 710 and 711 are mounted to the lower ends of bars 700 and 701 opposite from spring set 704, and in line with pulleys 697 and 698.

Upper, tubular inner telescoping members 712 and 713 are attached at upper ends to guard rail 195. The lower ends are received, slidingly in the upper ends of intermediate members 691 and 692. Extending parallel with and between members 712 and 713 are bars 715 and 716. These bars are also parallel to, and overlap bars 700 and 701, as shown.

Mounted between bars 715 and 716 is lock assembly 684. This assembly locks the position of the guard rail relative to intermediate members 691 and 692. A trigger plate 718 is mounted between the upper ends of bars 715 and 716 for pivoting. Plate 718 is accessible through hand holes in the guard rail housings, such as hole 720 shown in FIG. 1. Attached to the edges of the sides of plate 718 are trigger cables 721 and 722. These cables extend down along bars 715 and 716 to small pulleys 724 and 725. A brace bar 727 extends between the lower ends of bars 715 and 716. Mounted inside cavities 727*a* and 727*b* in the upper ends of bar 727 are spring-biased pins 729 and 730. These pins extend through holes 715*a* and 716*a* and into aligned holes in bars 700 and 701, such as hole 702. The pins are connected to cables 721 and 722 by connectors 731 and 732.

By manually pivoting trigger plate 718, cables 721 and 722 are pulled upwardly. This in turn pulls pins 729 and 730 out of holes 702, releasing the upper members 712 and 713 from intermediate members 691 and 692.

To the outer lower ends of bars 715 and 716 are mounted a second set of anchor blocks 734 and 735. A pair of cables 737 and 738 extend from blocks 734 and 735 upward and around upper pulleys 697 and 698, and downward and around lower pulleys 710 and 711. From pulleys 710 and 711, the cables extend to base anchor blocks 689 and 690. As a result of the cable/pulley mechanism, when the upper telescoping member is locked in position relative to the intermediate telescoping member, the intermediate member is locked in position relative to the base member, and therefore the mattress platform. The cable/pulley mechanism also regulates the rate of movement of the intermediate and upper telescoping members relative to the base member, as is illustrated in the illustration of the guard rail assembly in the figures.

Additionally, the set 704 of springs act to store energy when the guard rail is lowered and return the energy when it is raised. As shown in FIG. 92, when the guard rail is in the fully raised position, bottom plate 699, adjacent to which the springs are mounted, is adjacent to plate 688 to which the spring ends are fastened and which is fixed relative to the bed platform. When the trigger is activated and the guard rail lowered, plate 699 drops below plate 688, causing the springs to uncoil. When the guard rail is in the lowest position, plates 688 and 699 are separated a maximum distance corresponding to the travel distance of the intermediate members 693 and 694 relative to sleeves 686 and 687. The springs have thus stored the maximum amount of available energy, since the springs are biased to form a tight coil. In this position the top of the guard rail is adjacent to base member 685 which is mounted to the side of the platform tray. The top of the guard rail is thus below the top surface of the platform, making the mattress and patient fully accessible.

When it is desired to return the guard rail to the raised position, the reverse procedure is followed. The trigger is activated to release the guard rail. A manual force is applied to lift the guard rail. The stored energy of the springs is applied in a direction to also raise the guard rail, assisting in returning the springs to a fully coiled condition. As the guard rail is raised, the springs recoil, thereby recovering the spring energy. Thus, the person raising the guard rail only has to apply a force corresponding to the weight of the guard rail less the spring force. This makes an otherwise heavy guard rail relatively manageable, both as to the "braking" force applied by the springs during lowering of the guard rail, and as to the "assisting" force applied when the guard rail is raised, permitting single-handed operation.

9. Swing Arm Extension Brace

Figure 95:
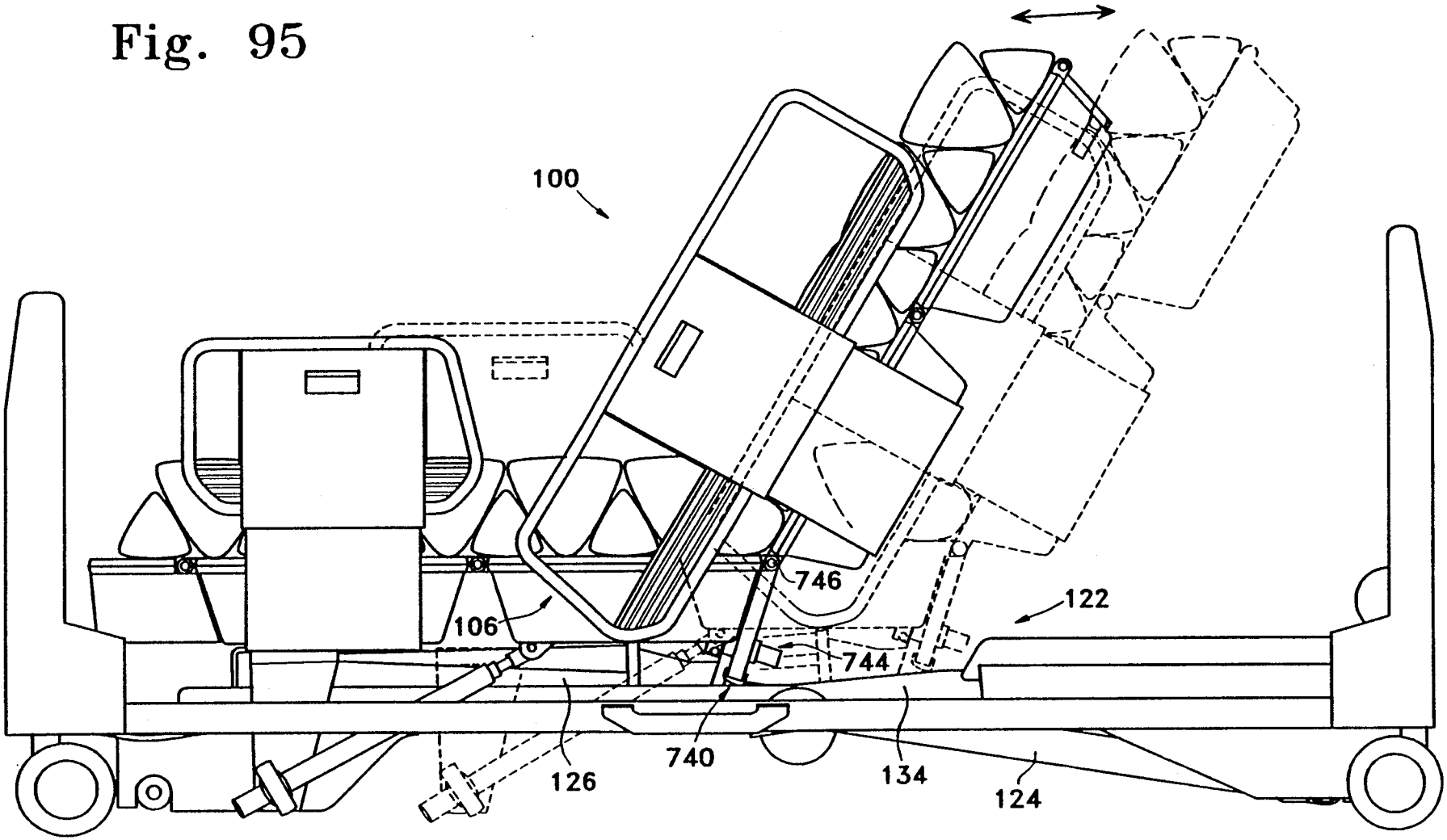
FIG. 95 is a side view of the bed articulated into a low sitting position and showing a mechanism for transferring weight directly between the platform and weigh frame.
Figure 96:
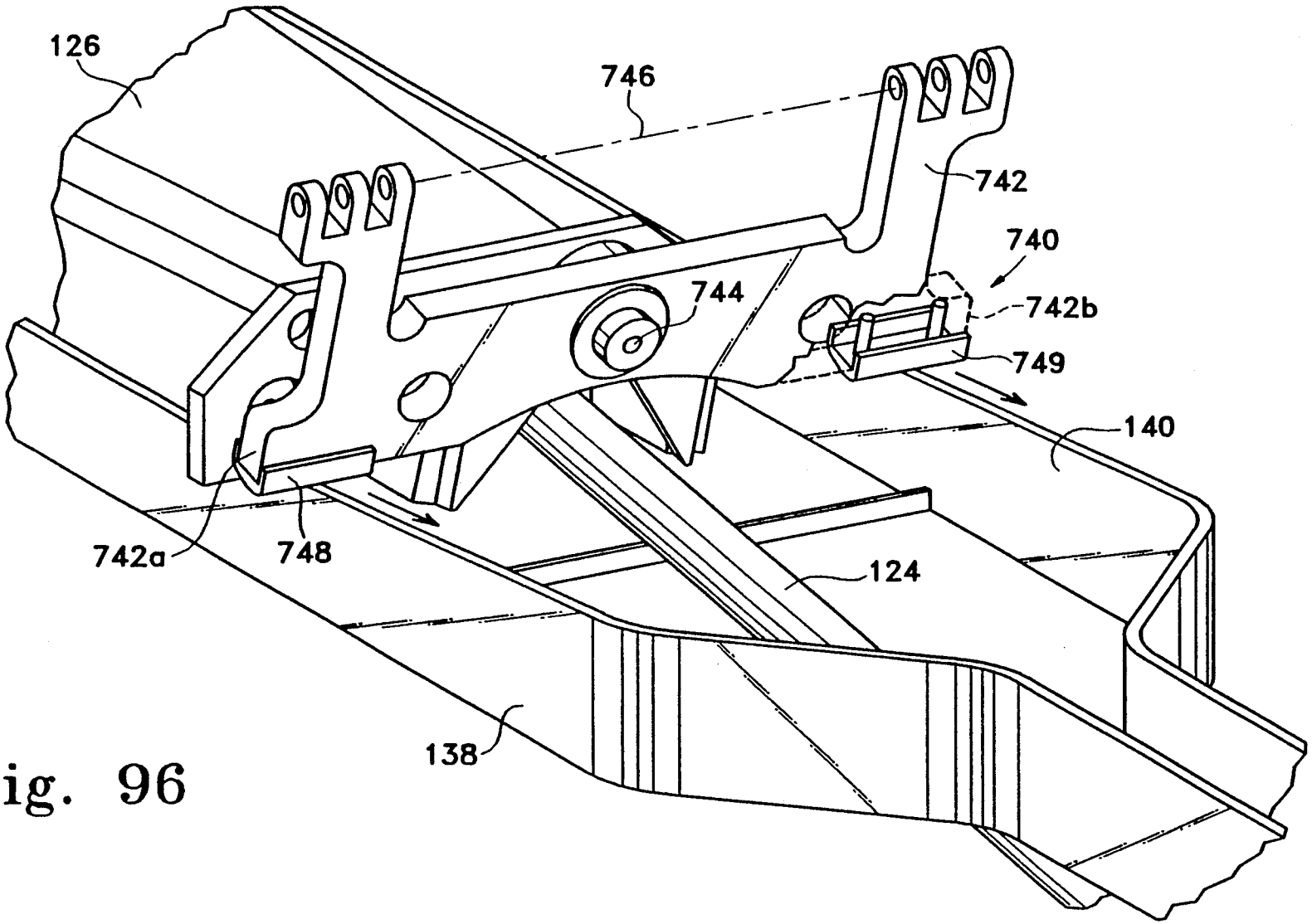
FIG. 96 is an isometric view of a portion of the structure of FIG. 95 showing the weight-transferring mechanism.

Finally, FIGS. 95 and 96 illustrate an improvement on the apparatus for supporting the bed platform above the base frame, and in particular in the preferred bed, above the weigh frame. FIG. 95 shows a side view of bed 100 with platform 106 articulated in a low sitting position. Supporting apparatus 122 has the capability of moving the platform toward the head of the bed, in order to maintain the position of the patient relative to the head of the bed. When such a low position is used, drive support 124 and swing arm 126 extend toward each other at a very wide relative angle. This angle puts substantial stress on these support arms.

In order to reduce the amount of stress, a means 740 for transferring weight directly from the platform to the weigh frame is provided. As can be seen most clearly in FIG. 96, platform 106 is hingedly attached to swing arm 126 by a yoke 742. Yoke 742 is pivotable relative to the swing arm about pivot 744 and is hinged relative to the platform about a hinge axis 746. The yoke thus functions generally as a universal joint coupling the swing arm to the platform. Drive cylinder 124 is then pivotally attached to the upper end of the swing arm near the yoke.

Yoke 742 includes downwardly extending shoulders 742*a* and 742*b* in line with the weigh frame rails 138 and 140. Covering the lower faces of shoulders 742*a* and 742*b* are friction-reducing covers 748 and 749. In order to fully benefit from this weight transferring system, it is preferably that platform 106 be laterally supported horizontally, i.e., without any roll. This puts both of covers 748 and 749 in contact with the weigh frame. As shown by the phantom lines in FIG. 95, the swing arm is then extended and the drive cylinder ram shortened to position the bed closer to the head of the bed. This movement back and forth along the weigh frame is also represented by the arrows shown in FIG. 96. The strength of swing arm 126 and drive cylinder ram 124 can thereby be reduced, since a substantial amount of force is removed from them through the use of weight-transferring means 740.

It will be apparent to one skilled in the art that many variations in form and detail may be made in the preferred embodiments as illustrated and described above without varying from the spirit and scope of the invention that the claims define or are interpreted or modified according to the doctrine of equivalents. The preferred embodiments of the various features of the invention are thus provided for purposes of explanation and illustration, but not limitation.

We claim:

1. A bed comprising:

platform means having an end and a side for supporting a patient above a floor;

a board mounted generally vertically adjacent the end of the platform means;

means for pivoting the board about a generally vertical axis, whereby the board is movable between a first position in which the board extends along the end, a second position in which the board is pivoted away from the end, and a third position extending away from the side; and a table mounted on the board for moving between a storage position in which the table is positioned vertically against the board and a raised position in which the table is positioned horizontally;

whereby the table is positioned alongside the platform means when the table is in the raised position and the board is in the third position.

2. The bed according to claim 1 wherein the board is parallel to the foot end of the bed when in the first and third positions.

3. A bed comprising:

platform means for supporting a person above a floor and having a foot end and a side extending from the foot end;

a base for supporting the platform means on a floor;

a board mounted generally vertically on the base independently of the platform means and adjacent the foot end;

means for pivoting the board about a generally vertical axis, whereby the board is movable between a first position in which the board is adjacent to the foot end and a second position in which the board is pivoted away from the foot end;

means for lowering the foot end toward the floor while maintaining the board in the second position relative to the base, and the board thereby being positioned for use as a support by a person supported on the platform means while the foot end is lowered toward the floor.

4. A bed comprising:

a base supported on a floor;

platform means for supporting a person and having a foot end and opposite sides, each side meeting the foot end at a corresponding corner;

means for supporting the platform means on the base, including means for tilting the platform means toward an upright position relative to the base in which the platform means has a generally vertical orientation with the foot end adjacent to the base;

a first board mounted to the base independently of the platform means and extending adjacent to and higher than the foot end when the platform means is disposed generally horizontally; and first means for pivoting the board about a generally vertical axis positioned adjacent to a first one of the corners, whereby the board is movable between a first position in which the board is adjacent to the foot end and a second position in which the board is pivoted away from the foot end, the board being positioned in line with the side of the platform means when the board is in the second position and the platform means is tilted toward the upright position, the board thereby remaining in the second position relative to the base for use as a support by a person on the platform means.

5. A bed according to claim 4 wherein the first board extends partially along the length of the foot end, and the bed further comprises a second board mounted to the base frame independently of the platform means and extending, when in a first position, along a portion of the length of the foot end means toward the first board when the first board is in the first position, and second means for pivoting the second board about a generally vertical axis positioned adjacent to the second one of the corners, whereby the second board is movable between a first position in which the board is adjacent to the foot end and a second position in which the board is pivoted away from the foot end, whereby the first and second boards are adjacent to opposite sides of the platform means when the first and second boards are in the respective second positions and the platform means is tilted toward the upright position, the first and second boards remaining in the respective second positions relative to the base for providing side supports for a person supported on the platform means.

6. A bed according to claim 5 further comprising means for releasably securing the first and second boards in the respective second positions, and thereby preventing pivoting of the first and second boards during use by a person.

7. A bed comprising:

platform means having opposite ends for supporting a patient above a floor;

a board mounted generally vertically adjacent one end of the platform means and having horizontally spaced, generally vertically extending channels;

means for pivoting the board about a generally vertical axis, whereby the board is movable between a first position in which the board is adjacent to the one end of the platform means and a second position in which the board is pivoted away from the one end of the platform means;

a table positionable adjacent to the channels and having a guide element extending into each channel, which guide elements are slidable relative to the channels for moving the table between a storage position in which the guide elements are positioned in lower regions of the channels, and a raised position in which the guide elements are positioned at upper regions of the channels;

pivot means coupling the table to the guide elements for pivoting the table about a pivot axis between an upright position in which the table is generally vertically disposed and a lowered position in which the table is generally horizontally disposed; and first stop means for limiting the pivoting of the table relative to the channels in a first direction.

8. A bed comprising:

platform means having opposite ends for supporting a patient above a floor;

a board mounted generally vertically adjacent one end of the platform means;

means for pivoting the board about a generally vertical axis, whereby the board is movable between a first position in which the board is adjacent to the one end of the platform means and a second position in which the board is pivoted away from the one end of the platform means;

a stand-up board extending between the sides of the platform means; and means for mounting the stand-up board on the foot end of the platform means, the mounting means being adjustable for varying the angle of the stand-up board relative to the platform means.

9. A bed comprising:

platform means having opposite ends for supporting a patient above a floor;

a board mounted generally vertically adjacent one end of the platform means;

means for pivoting the board about a generally vertical axis, whereby the board is movable between a first position in which the board is adjacent to the one end of the platform means and a second position in which the board is pivoted away from the one end of the platform means;

an inflatable mattress having a predetermined thickness supported on the platform means and having a foot end on the foot end of the platform means;

a stand-up board extending between the sides of the platform means;

means for mounting the stand-up board on the foot end of the platform means adjacent to the mattress; and means for moving the stand-up board from a support position in which the stand-up board extends above the mattress for contact by the feet of a person when the platform means is tilted up with the foot end down, and a storage position in which the stand-up board is positioned below the upper surface of the mattress.

* * * * *